US011532297B2

(12) United States Patent
Goto

(10) Patent No.: US 11,532,297 B2
(45) Date of Patent: Dec. 20, 2022

(54) SOUND EMITTING APPARATUS AND BLADE NOISE REDUCTION APPARATUS

(71) Applicant: KABUSHIKI KAISHA TOSHIBA, Tokyo (JP)

(72) Inventor: Tatsuhiko Goto, Kawasaki (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 17/459,228

(22) Filed: Aug. 27, 2021

(65) Prior Publication Data

US 2022/0301539 A1 Sep. 22, 2022

(30) Foreign Application Priority Data

Mar. 17, 2021 (JP) ..... JP2021-043387

(51) Int. Cl.
*G10K 11/178* (2006.01)

(52) U.S. Cl.
CPC .... *G10K 11/17857* (2018.01); *G10K 11/1787* (2018.01); *G10K 11/17823* (2018.01); *G10K 2210/109* (2013.01); *G10K 2210/111* (2013.01); *G10K 2210/119* (2013.01); *G10K 2210/3212* (2013.01); *G10K 2210/3216* (2013.01)

(58) Field of Classification Search
CPC ..... G10K 11/17857; G10K 11/17823; G10K 11/1787; G10K 2210/109; G10K 2210/111; G10K 2210/119; G10K 2210/3212; G10K 2210/3216
USPC ..... 381/71.1
See application file for complete search history.

(56) References Cited

U.S. PATENT DOCUMENTS

| | | | | |
|---|---|---|---|---|
| 10,225,644 | B2 | 3/2019 | Goto et al. | |
| 2011/0266895 | A1* | 11/2011 | Ichimonji | H02K 1/185 310/51 |
| 2018/0204561 | A1* | 7/2018 | Goto | G10K 11/17857 |
| 2019/0088244 | A1* | 3/2019 | Goto | B64C 27/001 |

FOREIGN PATENT DOCUMENTS

| | | | |
|---|---|---|---|
| JP | 2001-54181 | A | 2/2001 |
| JP | 4295238 | B2 | 7/2009 |
| JP | 5215797 | B2 | 6/2013 |
| JP | 2017-204812 | A | 11/2017 |
| JP | WO 2018/003394 | A1 | 1/2018 |
| JP | 6503135 | B1 | 4/2019 |

* cited by examiner

*Primary Examiner* — Vivian C Chin
*Assistant Examiner* — Douglas J Suthers
(74) *Attorney, Agent, or Firm* — Oblon, McClelland, Maier & Neustadt, L.L.P.

(57) ABSTRACT

According to one embodiment, a sound emitting apparatus includes an elastic member, three or more excitation actuators, and a control circuit. The elastic member has an annular shape. The excitation actuators are arranged at a predetermined angular interval on the elastic member and are configured to apply vibration to the elastic member. The control circuit is configured to generate drive signals for driving the three or more excitation actuators. There is a phase difference between drive signals for two excitation actuators separated by the predetermined angular interval, the phase difference depending on an order of a Lobe mode being a vibration mode excited on the elastic member and the predetermined angular interval.

10 Claims, 43 Drawing Sheets

| | Pressure: None | Pressure: Weak | Pressure: Strong |
|---|---|---|---|
| M1 | 942Hz | 999Hz | 1051Hz |
| M2 | 1140Hz | 1184Hz | 1224Hz |
| M3 | 1742Hz | 1766Hz | 1789Hz |
| M4 | 2735Hz | 2748Hz | 2759Hz |
| M5 | 4064Hz | 4071Hz | 4077Hz |
| M6 | 5686Hz | 5689Hz | 5692Hz |

F I G. 15

$N = 2\beta > 2M+1$ $\text{phase shift}_i = -M\Phi_i$ $$\Phi_i = \frac{2\pi(i-1)}{N} = \frac{\pi(i-1)}{\beta}$$

| M | 1 | 2 | 3 | 4 | 5 | 6 | 7 | 8 |
|---|---|---|---|---|---|---|---|---|
| N=3M | 3 | 6 | 9 | 12 | 15 | 18 | 21 | 24 |
| N=4M | 4 | 8 | 12 | 16 | 20 | 24 | 28 | 32 |

M1 u1 : mod(i,24) = 6
u2 : mod(i,24) = 12
u3 : mod(i,24) = 18
u4 : mod(i,24) = 0

M2 u1 : mod(i,12) = 3
u2 : mod(i,12) = 6
u3 : mod(i,12) = 9
u4 : mod(i,12) = 0

M3 u1 : mod(i,8) = 2
u2 : mod(i,8) = 4
u3 : mod(i,8) = 6
u4 : mod(i,8) = 0

M6 u1 : mod(i,4) = 1
u2 : mod(i,4) = 2
u3 : mod(i,4) = 3
u4 : mod(i,4) = 0

M4 u1 : mod(i,6) = 2
u2 : mod(i,6) = 4
u3 · mod(i,6) = 0

M8 u1 : mod(i,3) = 1
u2 : mod(i,3) = 2
u3 : mod(i,3) = 0 u1 : mod(i,3) = 1
u2 : mod(i,3) = 2
u3 : mod(i,3) = 0

SOUND EMITTING APPARATUS AND BLADE NOISE REDUCTION APPARATUS

CROSS-REFERENCE TO RELATED APPLICATIONS

This application is based upon and claims the benefit of priority from Japanese Patent Application No. 2021-043387, filed Mar. 17, 2021, the entire contents of which are incorporated herein by reference.

FIELD

Embodiments described herein relate generally to a sound emitting apparatus and a blade noise reduction apparatus.

BACKGROUND

When an active noise reduction is used to reduce a blade noise, a blade rotation mode is simulated using a plurality of speakers arranged coaxially with the rotation axis of the rotational blades. For example, in a case where a noise due to an M-th order Lobe mode is reduced, 2M+1 or more speakers are discretely arranged. The noise due to the Lobe mode is a noise having a phase change on the circumference, and in the M-th order Lobe mode, a phase change of Mϕ[rad] occurs with respect to angle ϕ [rad]. When speakers are used for blade noise reduction, jigs for installing the speakers are required around the rotational blades, and the entire load becomes heavy due to the weights of the speakers. In addition, the speaker installation volume may disturb the sound field and the flow of the blades.

BRIEF DESCRIPTION OF THE DRAWINGS

FIG. 15 is a diagram illustrating a relationship between a pressing force to the annular plate illustrated in FIG. 1 and a natural frequency;

DETAILED DESCRIPTION

Figure 1A:
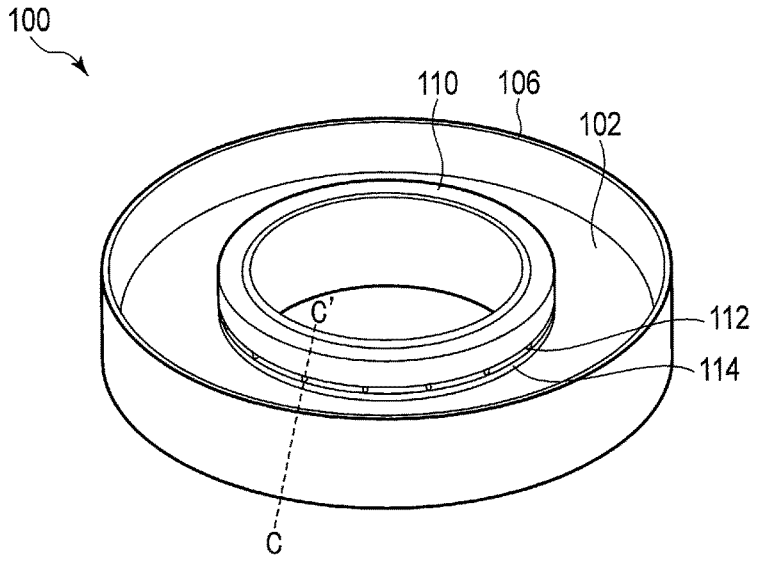
FIG. 1A is a perspective view illustrating a structural example of a sound emitting apparatus according to an embodiment.

According to one embodiment, a sound emitting apparatus includes an elastic member, three or more excitation actuators, and a control circuit. The elastic member has an annular shape. The three or more excitation actuators are arranged at a predetermined angular interval on the elastic member and are configured to apply vibration to the elastic member. The control circuit is configured to generate drive signals for driving the three or more excitation actuators. There is a phase difference between drive signals for two excitation actuators separated by the predetermined angular interval, the phase difference depending on an order of a Lobe mode being a vibration mode excited on the elastic member and the predetermined angular interval.

According to the embodiment, there is provided a sound emitting apparatus applicable to applications such as blade noise reduction.

Hereinafter, embodiments will be described with reference to the accompanying drawings. In order to avoid redundant description, like reference numerals are given to like components throughout the drawings. In addition, branch numbers are attached to the reference numerals in order to distinguish individual components. In some drawings, one or more components are not illustrated for simplicity.

The embodiment is directed to a sound emitting apparatus that emits a sound. The sound emitting apparatus according to the embodiment can be used for applications such as blade noise reduction and object floating. The blade noise is a noise generated by rotation of one or more rotational blades such as a propeller of a drone or a propeller fan. The blade noise includes noises due to Lobe modes. In the following description, it is mainly assumed that the sound emitting apparatus is used for blade noise reduction.

Figure 1B:
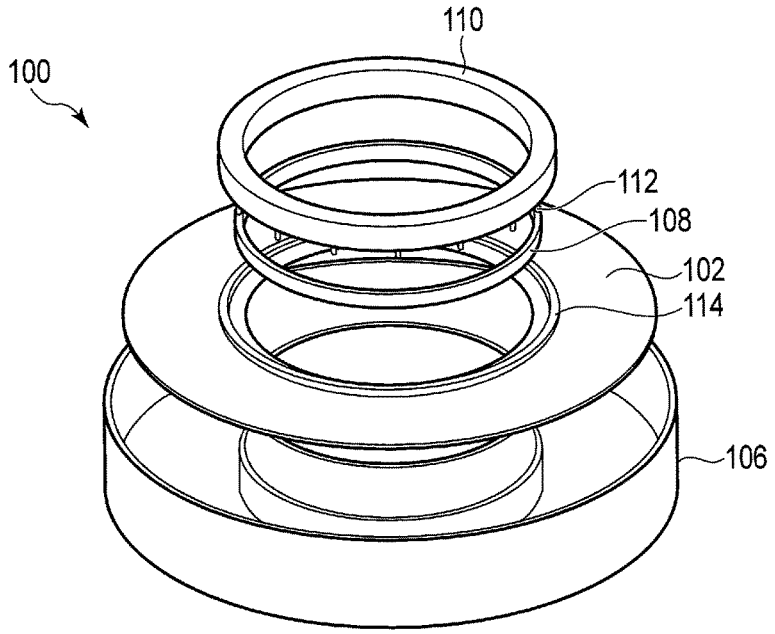
FIG. 1B is an exploded view of the sound emitting apparatus illustrated in FIG. 1A.
Figure 1C:
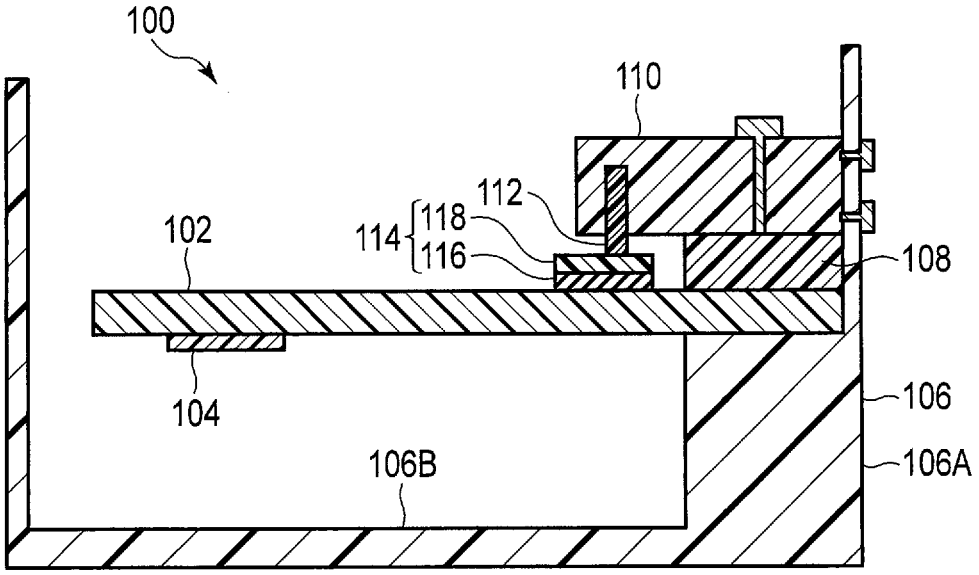
FIG. 1C is a cross-sectional view of the sound emitting apparatus illustrated in FIG. 1A.
Figure 1D:
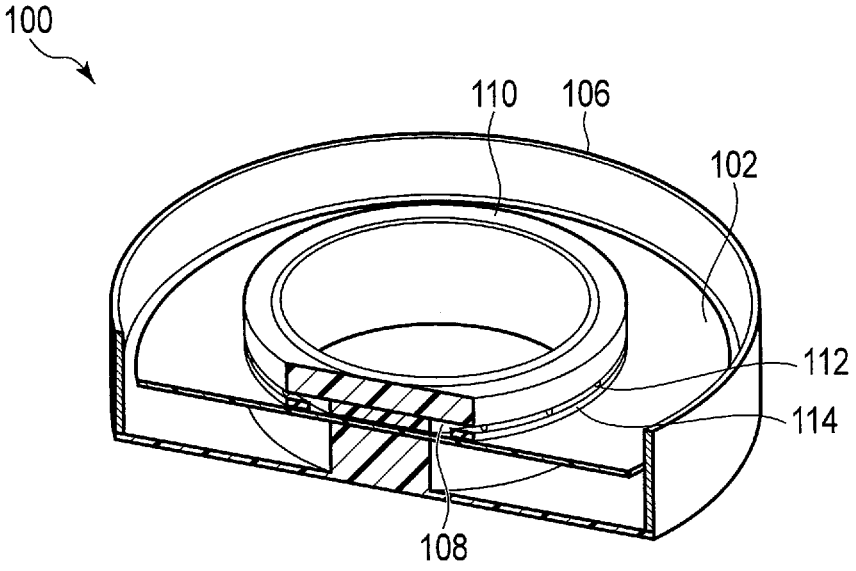
FIG. 1D is a partially cutaway cross-sectional view of the sound emitting apparatus illustrated in FIG. 1A.

FIG. 1A schematically illustrates a structural example of a sound emitting apparatus 100 according to an embodiment, FIG. 1B schematically illustrates the sound emitting apparatus 100 in an exploded state, FIG. 1C schematically illustrates a cross section of the sound emitting apparatus 100 taken along line C-C', and FIG. 1D schematically illustrates the sound emitting apparatus 100 in a partially cutaway state.

As illustrated in FIGS. 1A to 1D, the sound emitting apparatus 100 includes an annular plate 102, three or more excitation actuators 104, a case 106, supporting members 108 and 110, a plurality of pressurization actuators 112, and a pressure member 114. The sound emitting apparatus 100 further includes a control circuit 150 (FIG. 11) that controls the excitation actuators 104 and the pressurization actuators 112. The control circuit 150 of the sound emitting apparatus 100 will be described later.

The annular plate 102 is an annular diaphragm made of an elastic material. For example, the annular plate 102 is configured such that the natural frequency corresponding to the vibration mode excited on the annular plate 102 matches the frequency corresponding to the M-th order Lobe mode, which is a noise reduction target. Hereinafter, the vibration mode excited on the annular plate 102 may be referred to as a circumferential Lobe mode or simply a Lobe mode, and the Lobe mode being a noise reduction target may be referred to as a target Lobe mode. Furthermore, a frequency corresponding to the target Lobe mode may be referred to as a target frequency.

The dimensions (inner radius, outer radius, thickness) of the annular plate 102 are designed such that the natural frequency matches the target frequency. The natural frequency matching the target frequency means that the natural frequency is within a frequency range having a predetermined width around the target frequency. For example, when the target frequency is f [Hz], the natural frequency is set to a value within a frequency range from (f−100) Hz to (f+100) Hz. The natural frequency increases as the thickness increases, the natural frequency increases as the Young's modulus of the material increases, and the natural frequency increases as the outer radius decreases. Dimensional design is performed in consideration of this.

Figure 2:
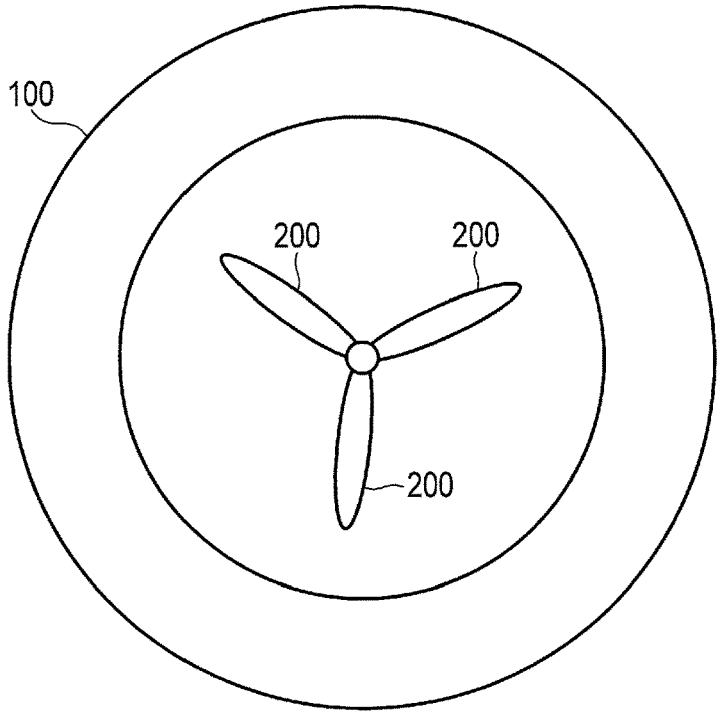
FIG. 2 is a plan view illustrating an example in which the sound emitting apparatus illustrated in FIG. 1A is applied to blade noise reduction.

In an example in which the sound emitting apparatus 100 is applied to blade noise reduction, as illustrated in FIG. 2, rotational blades 200 corresponding to a noise source are arranged inside the sound emitting apparatus 100. When the rotational blades 200 are arranged inside the sound emitting apparatus 100, the inner radius of the annular plate 102 is larger than the dimension (length) of each rotational blade 200.

Figure 3:
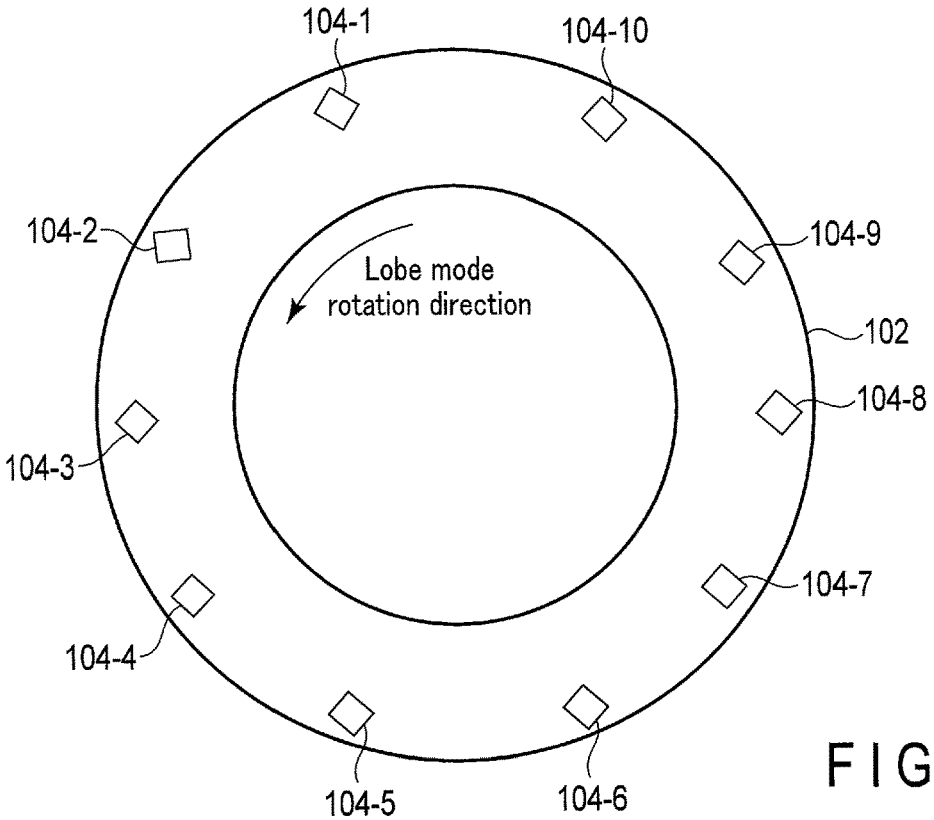
FIG. 3 is a bottom view illustrating an arrangement of excitation actuators illustrated in FIG. 1A.

As illustrated in FIG. 1C, the excitation actuators 104 are arranged on the lower surface of the annular plate 102 at a predetermined angular interval. Note that the excitation actuators 104 may be arranged on the upper surface of the annular plate 102. The upper surface of the annular plate 102 refers to the main surface of the annular plate 102 facing the space into which a sound is to be radiated, and the lower surface of the annular plate 102 refers to the main surface of the annular plate 102 opposite to the upper surface of the annular plate 102. The angular interval refers to an interval in the circumferential direction of the annular plate 102 and is expressed by an angle with respect to the center. In the example illustrated in FIG. 3, ten excitation actuators 104-1 to 104-10 are arranged on the annular plate 102 at the angular interval of 36 degrees. The branch numbers are sequentially assigned along the rotation direction of the Lobe mode. Assuming that the order of the target Lobe mode is M, the number of the excitation actuators 104 is 2M+1 or more.

Figure 4A:
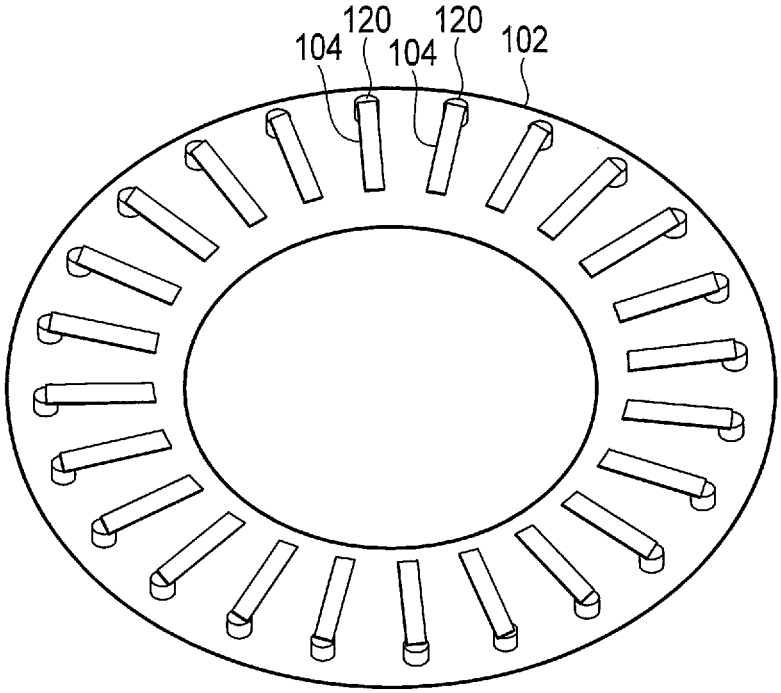
FIG. 4A is a perspective view illustrating an example in which each excitation actuator illustrated in FIG. 1A is a beam-type piezoelectric element.
Figure 4B:
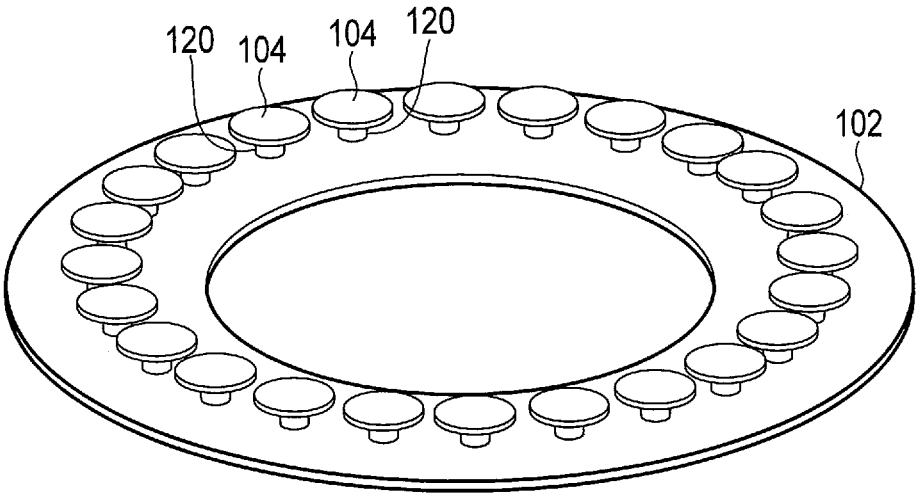
FIG. 4B is a perspective view illustrating an example in which each excitation actuator illustrated in FIG. 1A is a disk-type piezoelectric element.

The excitation actuators 104 are configured to apply vibration to the annular plate 102 to radiate a sound. As the excitation actuator 104, a small and lightweight vibration device such as a small voice coil actuator or a piezo actuator may be used. The piezo actuator may be a beam-type piezoelectric element as illustrated in FIG. 4A or a disk-type piezoelectric element as illustrated in FIG. 4B. When the excitation actuator 104 is a beam-type or disk-type piezoelectric element, the excitation actuator 104 is attached to the annular plate 102 via a vibration transmission member 120 as illustrated in FIG. 4A or 4B. The piezoelectric element may be a unimorph piezoelectric element or a bimorph piezoelectric element.

As illustrated in FIG. 1C, the case 106 accommodates the annular plate 102, the excitation actuators 104, the supporting members 108 and 110, the pressurization actuators 112, and the pressure member 114. The case 106 includes a supporting part 106A and an enclosure part 106B, which are annular. The supporting part 106A supports the annular plate 102. The enclosure part 106B covers the lower surface of the annular plate 102. The enclosure part 106B prevents a reduction in sound pressure due to a radiation sound from the lower surface of the annular plate 102. As described above, the case 106 has a role of supporting the annular plate 102 and increasing sound radiation efficiency.

Figure 5:
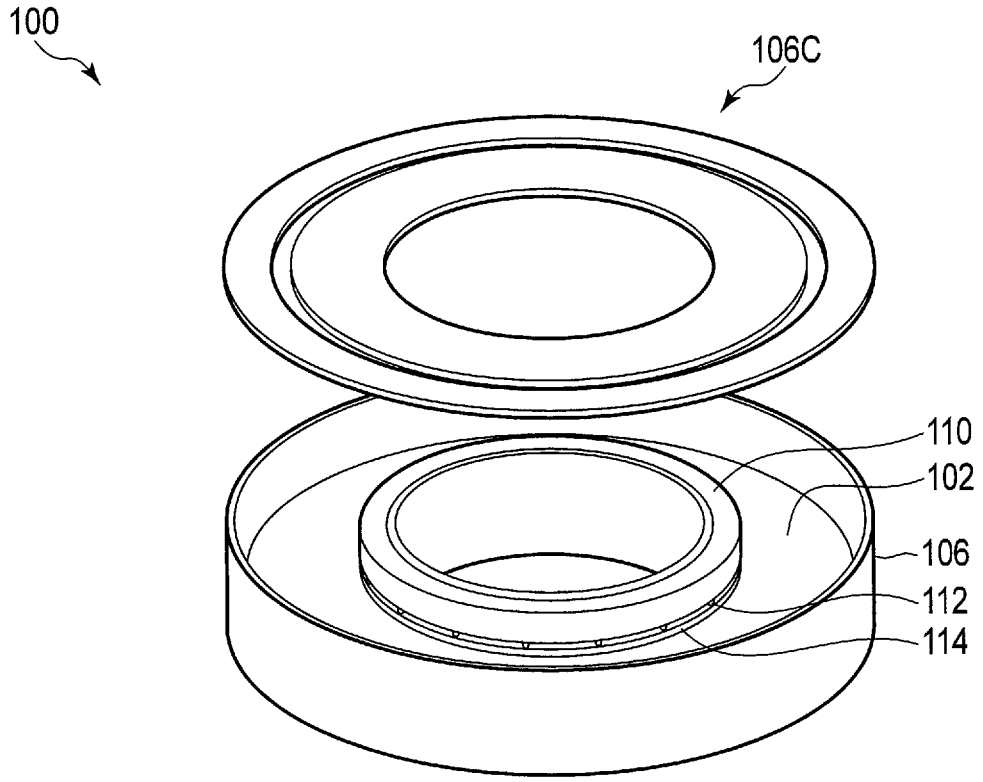
FIG. 5 is a perspective view illustrating another structural example of a sound emitting apparatus according to an embodiment.

Note that, as illustrated in FIG. 5, the case 106 may further include a cover part 106C having an annular slit. The cover part 106C is attached to the supporting part 106A and the enclosure part 106B and faces the upper surface of the annular plate 102.

In the example illustrated in FIG. 1B, the supporting members 108 and 110 are annular. The supporting members 108 and 110 are used to attach the annular plate 102 to the case 106. The support of the annular plate 102 may be surface support. As illustrated in FIG. 1C, the supporting member 110 is fixed to the case 106 by, for example, bolt fastening, and the supporting member 110 is provided with female threaded holes. In a state where the supporting member 108 and the supporting part 106A of the case 106 sandwich an inner edge part of the annular plate 102, bolts are fastened to the holes of the supporting member 110, and the supporting member 108 is pressed against the case 106 by the tips of the bolts. Thus, the annular plate 102 is attached to the case 106.

The pressurization actuators 112 and the pressure member 114 correspond to a pressing part configured to apply pressure to the annular plate 102 in order to adjust the natural frequency corresponding to the vibration mode of the annular plate 102. In the example illustrated in FIG. 1B, the pressure member 114 has an annular shape. The pressure member 114 includes an elastic plate 116 and a thin plate 118. The elastic plate 116 is a member for vibration insulation, and is made, for example, of rubber. The elastic plate 116 and the thin plate 118 are joined to each other. The elastic plate 116 is attached to the annular plate 102. Each of the pressurization actuators 112 has one end attached to the supporting member 110 and the other end attached to the pressure member 114.

The pressurization actuator 112 generates a pressure applied to the annular plate 102. The pressurization actuator 112 is desirably small and lightweight. As the pressurization actuator 112, for example, a stack piezo actuator may be used. When the pressurization actuator 112 is a stack piezo actuator, one end of the pressurization actuator 112 is fixed to the supporting member 110, the other end of the pressurization actuator 112 is fixed to the pressure member 114, and the supporting member 110 has a sufficient thickness so as not to be deformed by the pressure by the pressurization actuators 112.

Figure 6:
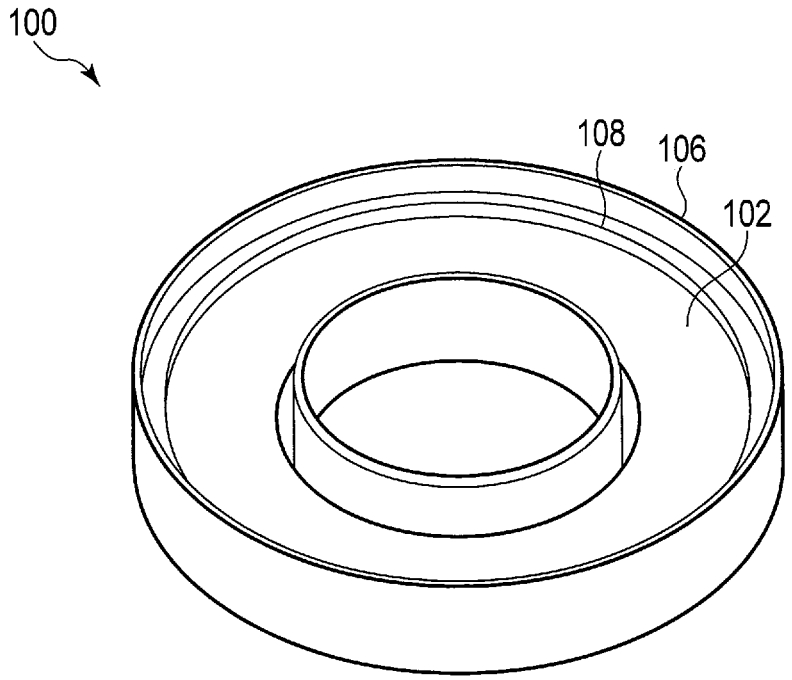
FIG. 6 is a perspective view illustrating a further structural example of a sound emitting apparatus according to an embodiment.

Note that the support of the annular plate 102 is not limited to the inner edge fixation in which the inner edge part of the annular plate 102 is fixed to the case 106 and the outer edge part of the annular plate 102 is free. As illustrated in FIG. 6, the support of the annular plate 102 may be an outer edge fixation in which the outer edge part of the annular plate 102 is fixed to the case 106 and the inner edge of the annular plate 102 is free. However, the inner edge fixation is preferable from the viewpoint of sound radiation efficiency.

In addition, from the viewpoint of sound radiation efficiency, it is preferable to apply a vibration to a portion where displacement becomes large. In the inner edge fixation, as illustrated in FIG. 1C, the excitation actuators 104 are arranged on an outer edge side of the annular plate 102. In the outer edge fixation, the excitation actuators 104 are arranged on an inner edge side of the annular plate 102.

In order to further increase the sound radiation efficiency, plastic cardboard or the like may be attached to the annular plate 102.

Figure 7A:
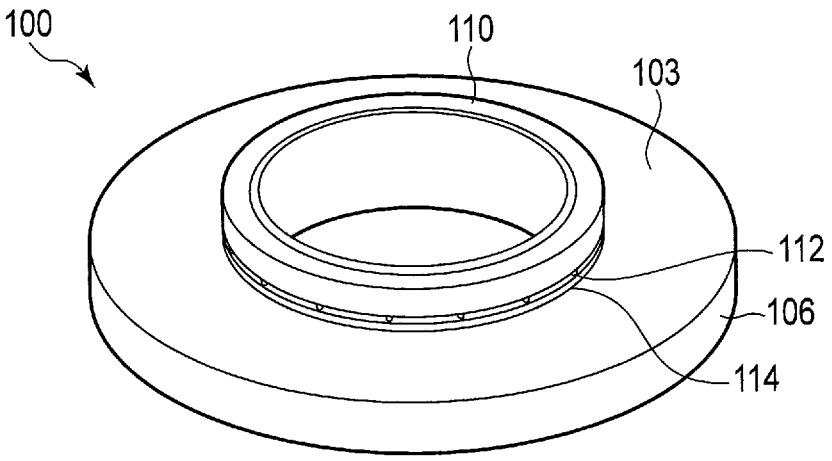
FIG. 7A is a perspective view illustrating still another structural example of a sound emitting apparatus according to an embodiment.
Figure 7B:
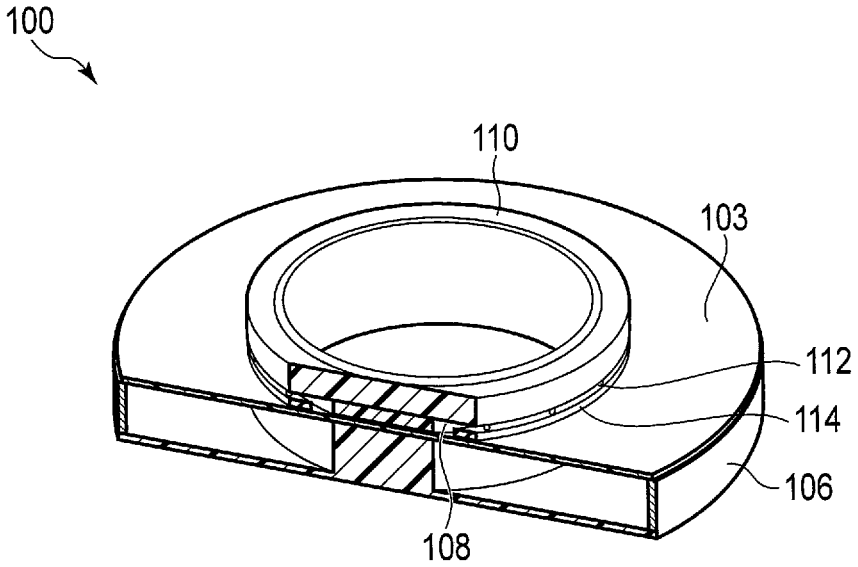
FIG. 7B is a partially cutaway cross-sectional view of the sound emitting apparatus illustrated in FIG. 7A.

The annular plate 102 is an example of an annular (ring-shaped) elastic member. The elastic member may be referred to as a diaphragm. The elastic member may be a vibration membrane. FIG. 7A schematically illustrates a structural example of the sound emitting apparatus 100 in a case where a vibration membrane 103 is used as the elastic member, and FIG. 7B illustrates the sound emitting apparatus 100 illustrated in FIG. 7A in a partially cutaway state. When the vibration membrane 103 is used instead of the annular plate 102, an inner edge part and an outer edge part of the vibration membrane 103 are both fixed to the case 106 as illustrated in FIGS. 7A and 7B.

Figure 8:
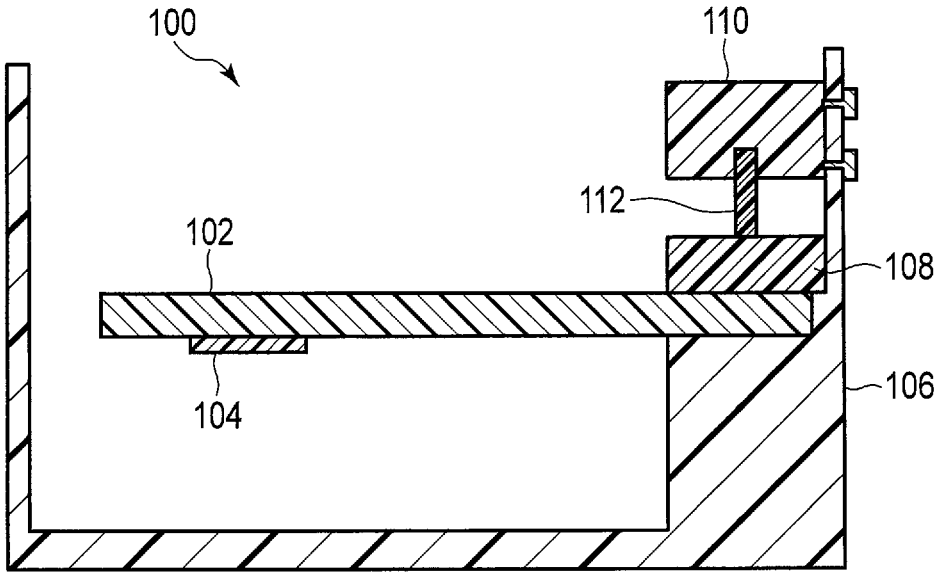
FIG. 8 is a cross-sectional view illustrating another structural example of a sound emitting apparatus according to an embodiment.

FIG. 8 schematically illustrates another structural example of the sound emitting apparatus 100. In the example illustrated in FIG. 8, the pressure by the pressurization actuators 112 is applied to the annular plate 102 via the supporting member 108. The pressurization actuators 112 are used to attach the annular plate 102 to the case 106 and also to change the natural frequency.

Figure 9:
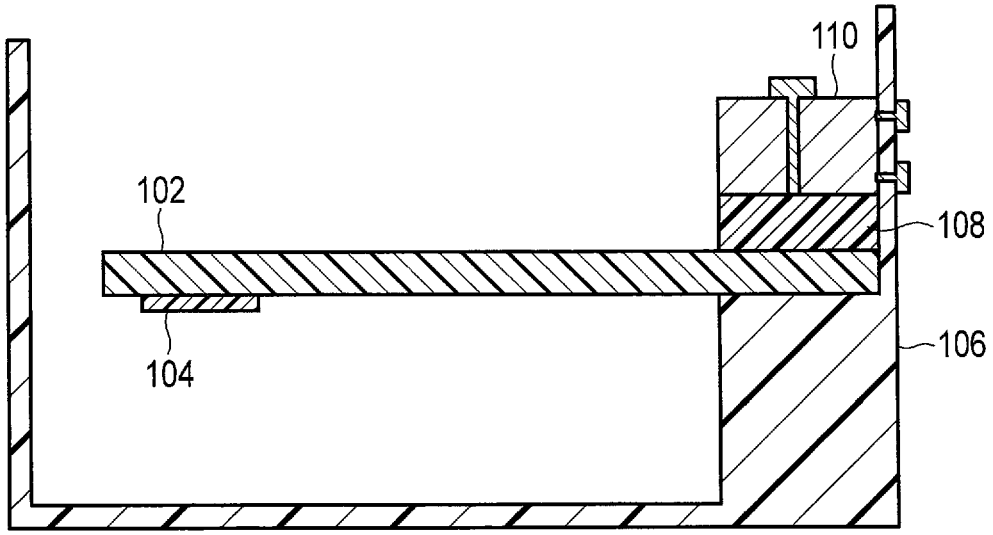
FIG. 9 is a cross-sectional view illustrating a further structural example of a sound emitting apparatus according to an embodiment.
Figure 10:
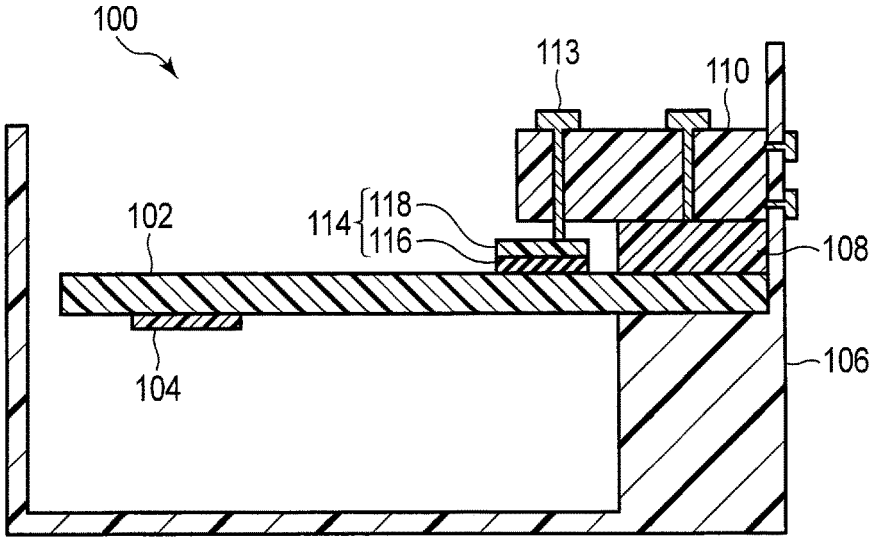
FIG. 10 is a cross-sectional view illustrating still another structural example of a sound emitting apparatus according to an embodiment.

FIG. 9 schematically illustrates a further structural example of the sound emitting apparatus 100. In the example illustrated in FIG. 9, the sound emitting apparatus 100 does not include the pressing part (specifically, the pressurization actuators 112 and the pressure member 114). For example, when the target frequency is constant as in the case where the rotational blades rotate at a constant speed, it is not necessary to adjust the natural frequency corresponding to the vibration mode of the annular plate 102. However, there may occur a difference between the design natural frequency and the actual natural frequency. In order to reduce or eliminate such difference, as illustrated in FIG. 10, a pressure may be applied to the annular plate 102 using a bolt 113. In the example illustrated in FIG. 10, a female threaded hole is provided in the supporting member 110, the bolt 113 is fastened to the hole, and the tip of the bolt 113 is pressed against the annular plate 102 via the pressure member 114. The pressing force to the annular plate 102 is adjusted by the rotation of the bolt 113.

Figure 11:
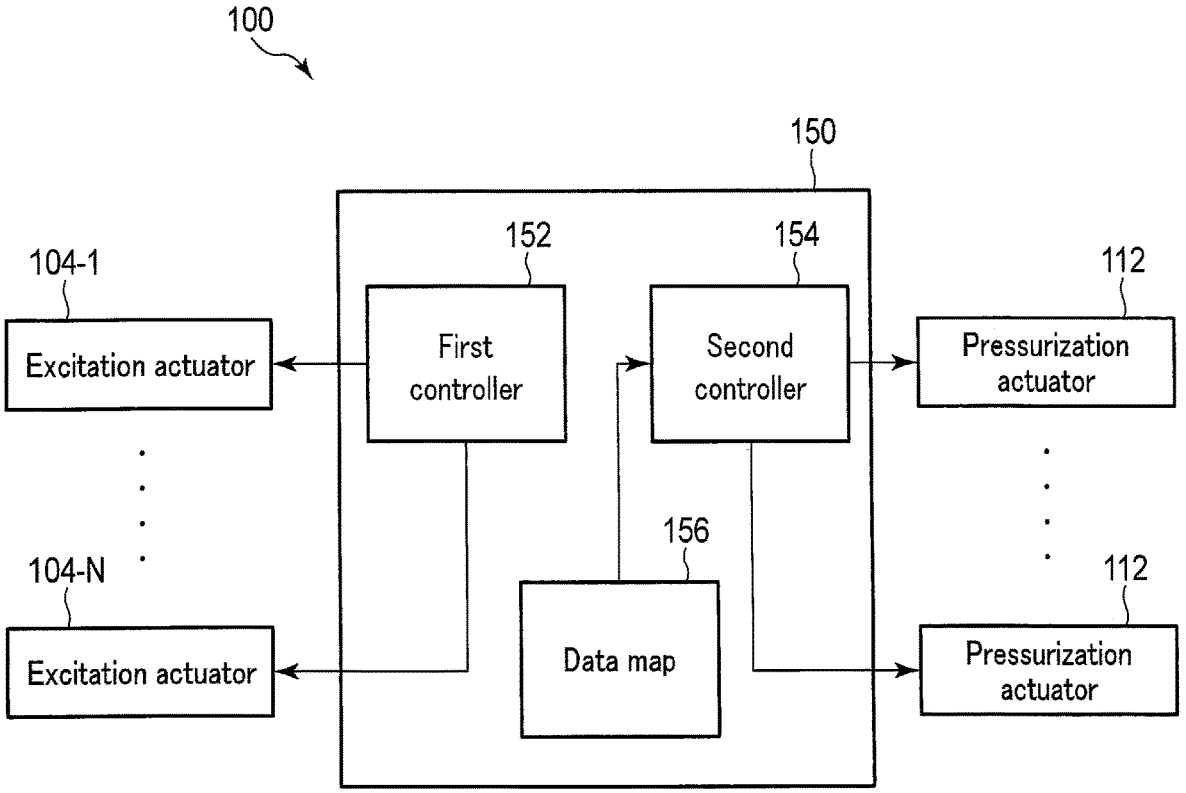
FIG. 11 is a block diagram illustrating a control circuit included in the sound emitting apparatus illustrated in FIG. 1.

FIG. 11 schematically illustrates the control circuit 150 of the sound emitting apparatus 100. As illustrated in FIG. 11, the control circuit 150 includes a first controller 152, a second controller 154, and a data map 156. As an example, the control circuit 150 includes a processing circuit and a memory. The processing circuit includes, for example, a general-purpose processor such as a central processing unit (CPU). The memory includes a volatile memory and a nonvolatile memory, and stores data such as the data map 156 and a control program. At least a part of processing described below regarding the first controller 152 and the second controller 154 may be implemented by a general-purpose processor executing a control program. The control circuit 150 may include a dedicated processor such as an application specific integrated circuit (ASIC) or a field programmable gate array (FPGA) instead of or in addition to the general-purpose processor.

The first controller 152 controls excitation actuators 104-1 to 104-N. For example, the first controller 152 generates drive signals for driving the excitation actuators 104-1 to 104-N, and sends the drive signals to the excitation actuators 104-1 to 104-N. There is a phase difference depending on the order of the circumferential Lobe mode and the predetermined angular interval between the drive signals for the two excitation actuators 104 separated by the predetermined angular interval. Thus, the vibration mode of the annular plate 102 rotates, and the Lobe mode characteristics of the blade noise can be simulated. The sound emitting apparatus 100 is configured to excite a Lobe mode of an order equal to the order of the target Lobe mode in use for blade noise reduction. For example, in a case where the target Lobe mode is the fourth order Lobe mode, the sound emitting apparatus 100 is configured to excite the fourth order Lobe mode on the annular plate 102.

Figure 12A:
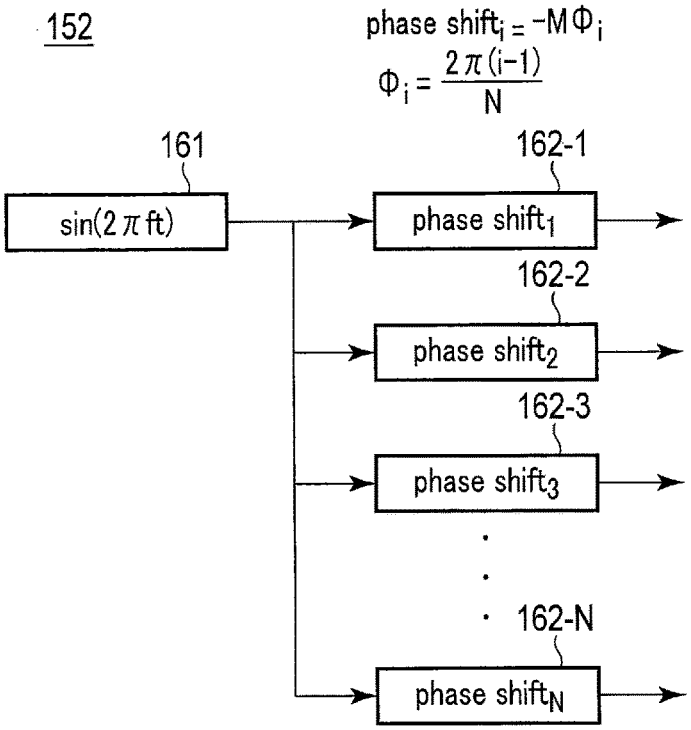
FIG. 12A is a block diagram illustrating an example of a drive circuit included in a first controller illustrated in FIG. 11.

FIG. 12A schematically illustrates an example of a drive circuit included in the first controller 152. In the example illustrated in FIG. 12A, the first controller 152 includes a driving signal generation unit 161 and phase shifters 162-1 to 162-N. The driving signal generation unit 161 generates a drive signal. The drive signal is branched into N and supplied to the phase shifters 162-1 to 162-N. The phase shifter **162-*i* applies a phase shift of $-M\phi_i$ to the drive signal, where $\phi_i=2\pi(i-1)/N$, M is the order of the circumferential Lobe mode, and N is the number of excitation actuators 104. The drive signal to which the phase shift of $-M\phi_i$ is applied by the phase shifter 162-*i* is sent to the excitation actuator 104-*i***.

Figure 12B:
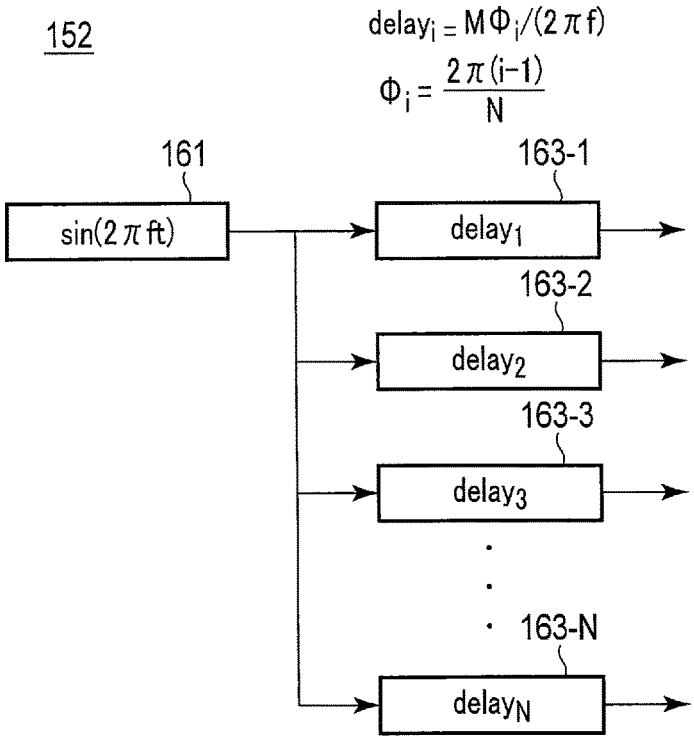
FIG. 12B is a block diagram illustrating another example of a drive circuit included in a first controller illustrated in FIG. 11.

FIG. 12B schematically illustrates another configuration example of a drive circuit included in the first controller 152. In the example illustrated in FIG. 12B, the first controller 152 includes the driving signal generation unit 161 and delay units 163-1 to 163-N. The drive signal output from the driving signal generation unit 161 is branched into N and supplied to the delay units 163-1 to 163-N. The delay unit **163-*i* delays the drive signal by a time of $M\phi_i/2\pi f$, where $\phi_i=2\pi(i-1)/N$, and f is the frequency of the drive signal. The drive signal delayed by the time of $M\phi_i/2\pi f$ by the delay unit 163-*i* is sent to the excitation actuator 104-*i***.

Figure 13:
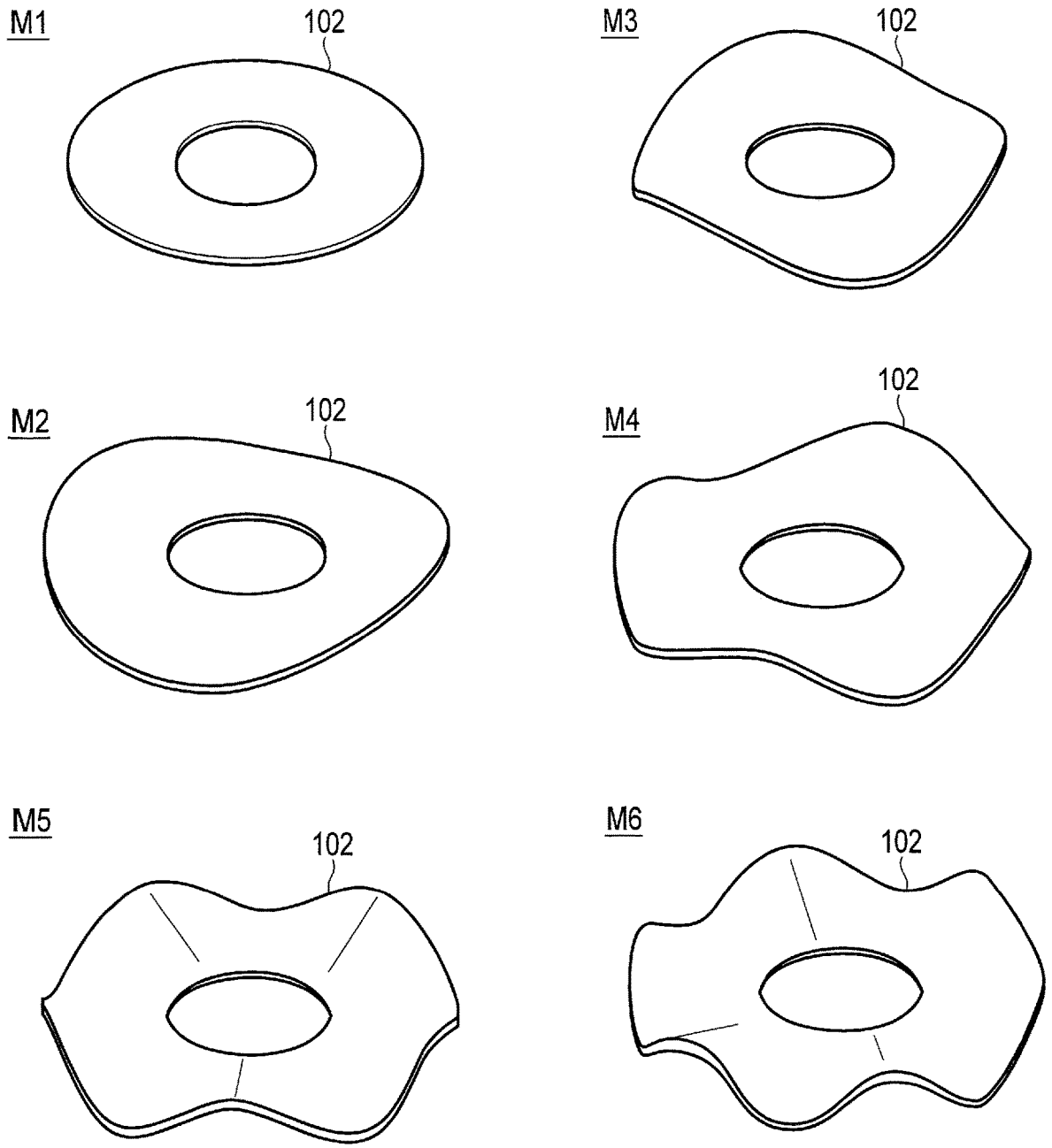
FIG. 13 is a diagram illustrating a vibration mode of an annular plate illustrated in FIG. 1.

FIG. 13 schematically illustrates vibration modes of the annular plate 102 corresponding to the first to sixth order Lobe modes. In FIG. 13, Mi represents the i-th order Lobe mode. As illustrated in FIG. 13, the number of antinodes at which the displacement is maximized depends on the order of the circumferential Lobe mode.

Figure 14A:
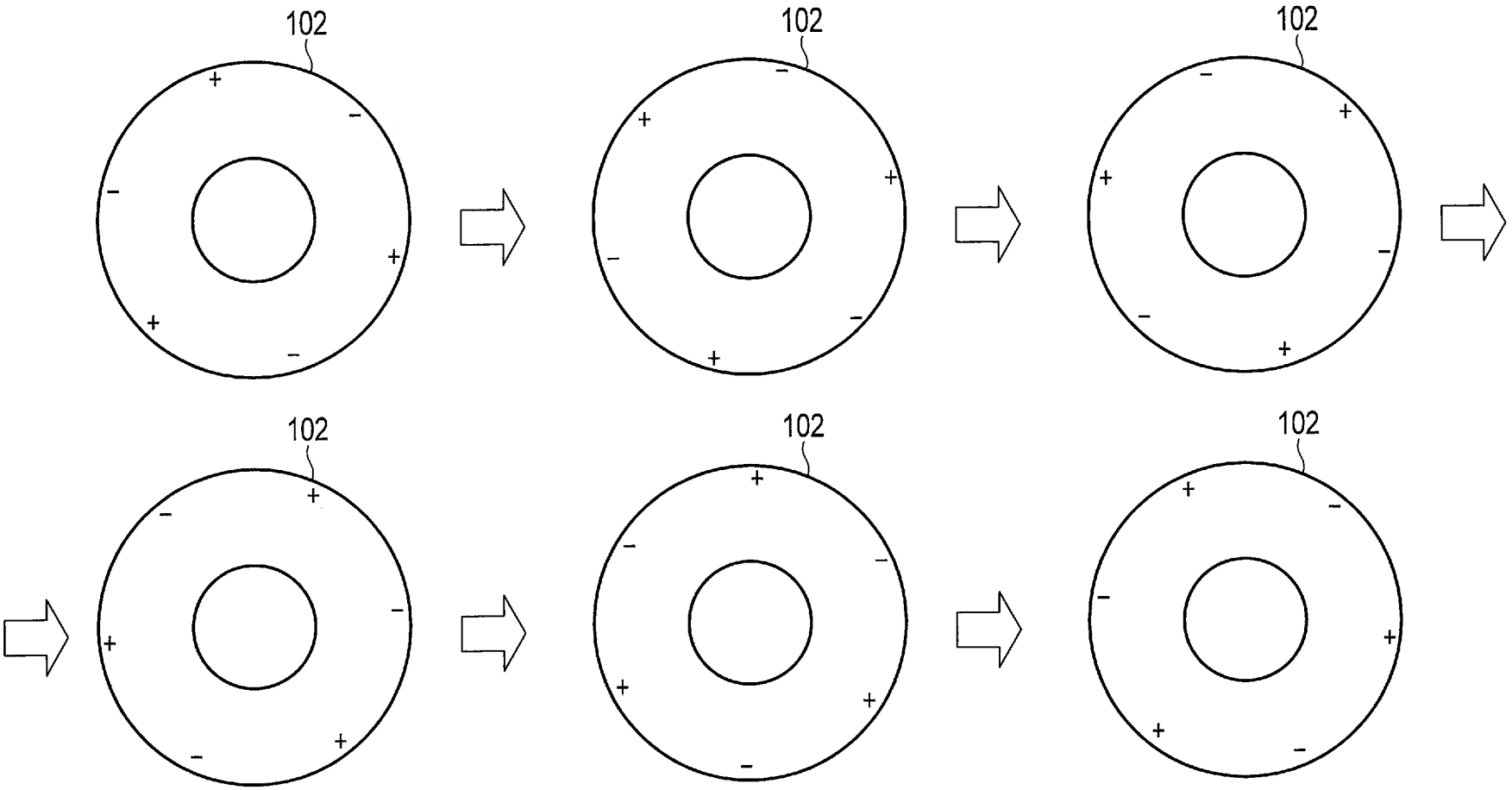
FIG. 14A is a diagram illustrating a state in which the vibration mode of the annular plate illustrated in FIG. 1 rotates.
Figure 14B:
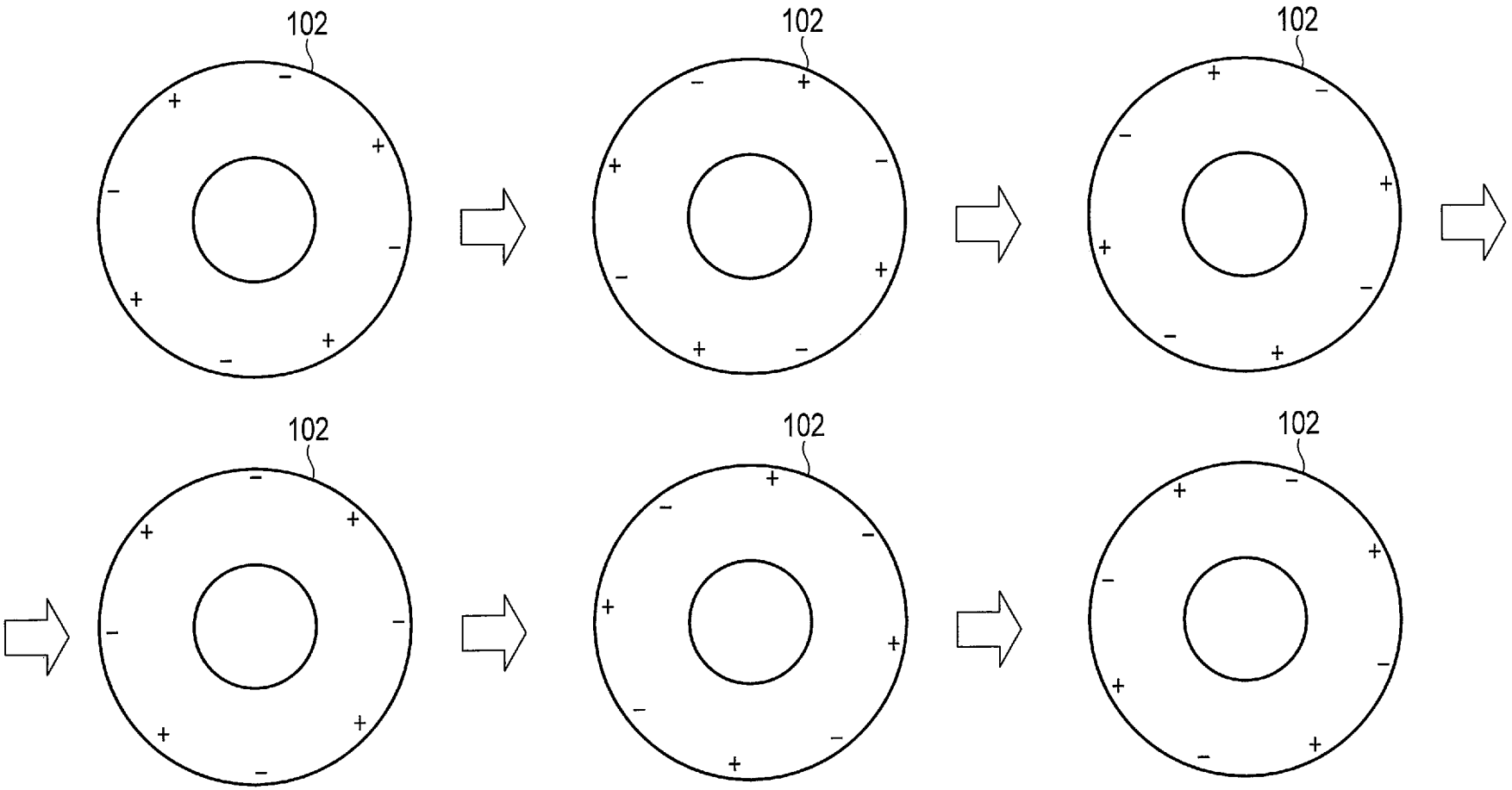
FIG. 14B is a diagram illustrating a state in which the vibration mode of the annular plate illustrated in FIG. 1 rotates.

FIG. 14A schematically illustrates a state where the vibration mode of the annular plate 102 corresponding to the third order Lobe mode rotates, and FIG. 14B schematically illustrates a state where the vibration mode of the annular plate 102 corresponding to the fourth order Lobe mode rotates. In FIGS. 14A and 14B, "+" represents an antinode at which the displacement is upward, and "−" represents an antinode at which the displacement is downward. As illustrated in FIGS. 14A and 14B, the vibration mode of the annular plate 102 rotates with time.

Referring back to FIG. 11, the second controller 154 controls the pressurization actuators 112. For example, the second controller 154 generates a drive signal for driving the pressurization actuators 112, and sends the drive signal to the pressurization actuators 112. The second controller 154 determines a pressure value to be applied to the annular plate 102 with reference to the data map 156 created in advance, and generates a drive signal based on the determined pressure value. The data map 156 includes information indicating the relationship between the pressing force to the annular plate 102 and the natural frequency or the target frequency.

The data map 156 may be created by performing modal analysis, such as by hammering. The data map 156 may be created by performing, for each of pressing forces, processing of applying a vibration to the annular plate 102 with the excitation actuators 104 while sweeping the frequency and specifying the frequency at which the sound pressure radiated from the annular plate 102 becomes the highest as the natural frequency.

FIG. 15 schematically illustrates, as an example for a certain annular plate, the relationship between the pressing force to the annular plate 102 and the natural frequency. As illustrated in FIG. 15, the natural frequency increases as the pressing force to the annular plate 102 increases.

In the sound emitting apparatus 100 having the above-described configuration, the three or more excitation actuators 104 are arranged on the annular plate 102 at a predetermined angular interval, and there is a phase difference depending on the order of the Lobe mode to be excited on the annular plate 102 and the predetermined angular interval between the drive signals for the two excitation actuators 104 separated by the predetermined angular interval. Thus, the Lobe mode excited on the annular plate 102 is rotated. As a result, the Lobe mode characteristics of the blade noise can be simulated. The sound emitting apparatus 100 radiates a sound by vibrating the annular plate 102 using the excitation actuators 104, and is lighter than a case where a plurality of speakers is discretely arranged. Furthermore, it is possible to suppress the occurrence of disturbance in the sound field and the flow of the blades.

Since a sound wave corresponding to the Lobe mode is radiated from the annular plate 102, the sound source characteristics of the sound emitting apparatus 100 approach the circumferential continuous sound source characteristics, and the similarity with the characteristics of the noise generated by the rotation of the blades increases, as compared with the technology in which the speakers are discretely arranged. The annular plate 102 is designed such that the natural frequency corresponding to the vibration mode of the annular plate 102 matches the target frequency. Thus, the sound radiation efficiency of the annular plate 102 increases, and sufficient sound radiation performance can be achieved even when the output (size) of the excitation actuators 104 is small. Furthermore, the natural frequency can be adjusted by the pressing part. Therefore, the blade noise can be reduced even when the target frequency changes with a change in rotation speed during driving of the rotational blades.

[Method of Arranging the Excitation Actuators]

The method of arranging the excitation actuators includes, but is not limited to, an N=4M arrangement, an N=2M+α arrangement, and a λ/4 gap arrangement described below.

The N=4M arrangement is a method of arranging the excitation actuators where the number of excitation actuators is equal to four times the order M of the Lobe mode. The N=4M arrangement is also referred to as a λ/4 arrangement. λ represents a circumferential angle of 2n/M. In the N=4M arrangement, the number of excitation actuators increases, but since the phase shifts to be applied are 0 degrees, 90 degrees, 180 degrees, and 270 degrees, it is possible to drive the circumferential Lobe mode using one 90 degree phase shifter.

Figure 16A:
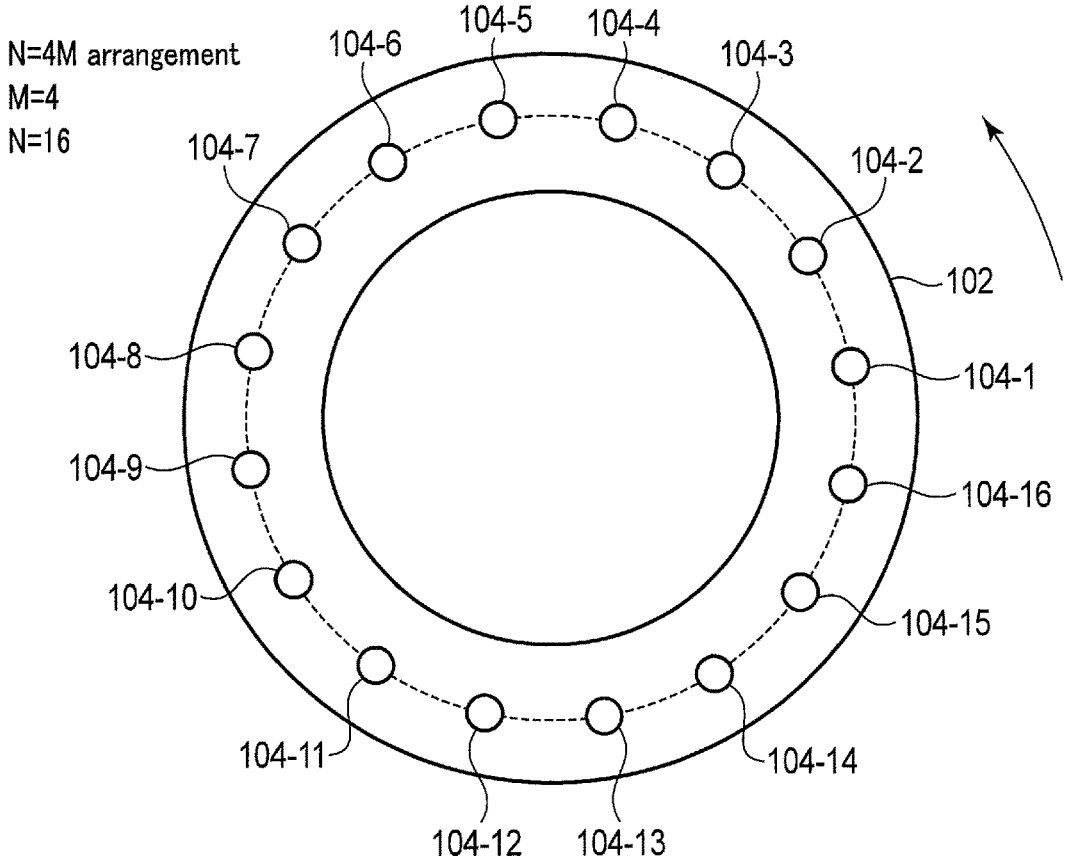
FIG. 16A is a diagram illustrating an example of an N=M4 arrangement according to an embodiment.

FIG. 16A schematically illustrates an example of the N=4M arrangement. In the example illustrated in FIG. 16A, the circumferential Lobe mode is the fourth order Lobe mode, and 16 excitation actuators 104-1 to 104-16 are arranged on the annular plate 102 at intervals of 22.5 degrees. The phase shift for the excitation actuator 104-*i* is $-M\phi_i$, where $\phi_i=2\pi(i-1)/N$. That is, the phase shift for each of the excitation actuators 104-1, 104-5, 104-9, and 104-13 is 0 degrees, the phase shift for each of the excitation actuators 104-2, 104-6, 104-10, and 104-14 is −90 degrees, the phase shift for each of the excitation actuators 104-3, 104-7, 104-11, and 104-15 is −180 degrees, and the phase shift for each of the excitation actuators 104-4, 104-8, 104-12, and 104-16 is −270 degrees.

Figure 16B:
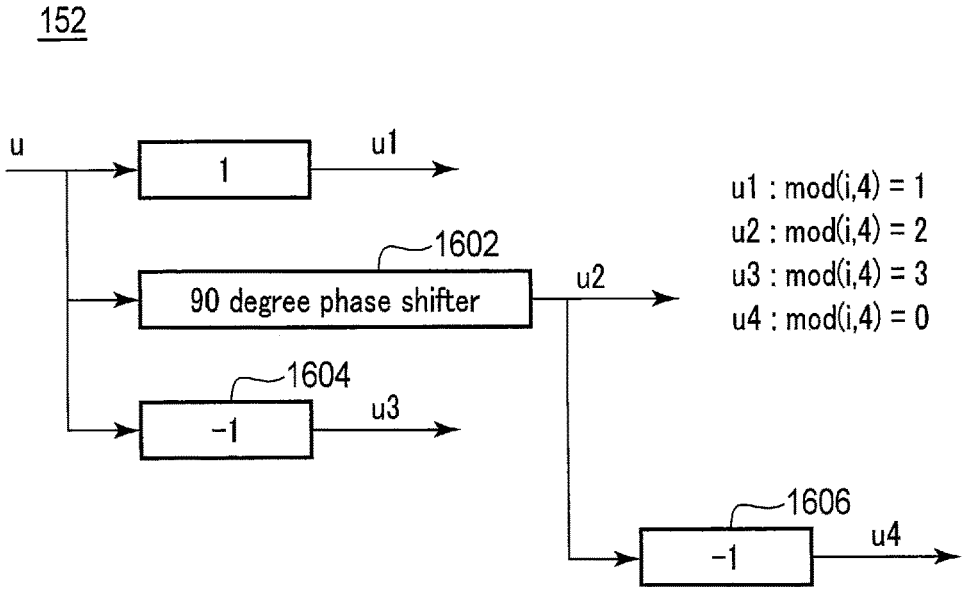
FIG. 16B is a block diagram illustrating a drive circuit that may be used for the excitation actuator arrangement illustrated in FIG. 16A.

FIG. 16B schematically illustrates an example of a drive circuit of the first controller 152 used for the N=4M arrangement illustrated in FIG. 16A. In the example illustrated in FIG. 16B, the first controller 152 includes a 90 degree phase shifter 1602 and inverting circuits 1604 and 1606. A drive signal u is output from the driving signal generation unit 161 (FIG. 12A) and is branched into three. A first branch drive signal u is output as it is as a drive signal u1. The drive signal u1 is sent to the excitation actuator 104-*i*, where i satisfies mod(i,4)=1. Specifically, the drive signal u1 is sent to the excitation actuators 104-1, 104-5, 104-9, and 104-13. A second branch drive signal u is supplied to the 90 degree phase shifter 1602. The 90 degree phase shifter 1602 applies a −90 degree phase shift to the second branch drive signal u to generate a drive signal u2. The drive signal u2 is branched into two. A first branch drive signal u2 is sent to the excitation actuator 104-*i*, where i satisfies mod(i,4)=2. Specifically, the first branch drive signal u2 is sent to the excitation actuators 104-2, 104-6, 104-10, and 104-14. A second branch drive signal u2 is supplied to the inverting circuit 1606. The inverting circuit 1606 inverts the second branch drive signal u2 to generate a drive signal u4. The drive signal u4 is sent to the excitation actuator 104-*i*, where i satisfies mod(i,4)=4. Specifically, the drive signal u4 is sent to the excitation actuators 104-4, 104-8, 104-12, and 104-16. A third branch drive signal u is supplied to the inverting circuit 1604. The inverting circuit 1604 inverts the third branch drive signal u to generate a drive signal u3. The drive signal u3 is sent to the excitation actuator 104-*i*, where i satisfies mod(i,4)=3. Specifically, the drive signal u3 is sent to the excitation actuators 104-3, 104-7, 104-11, and 104-15.

Figure 17A:
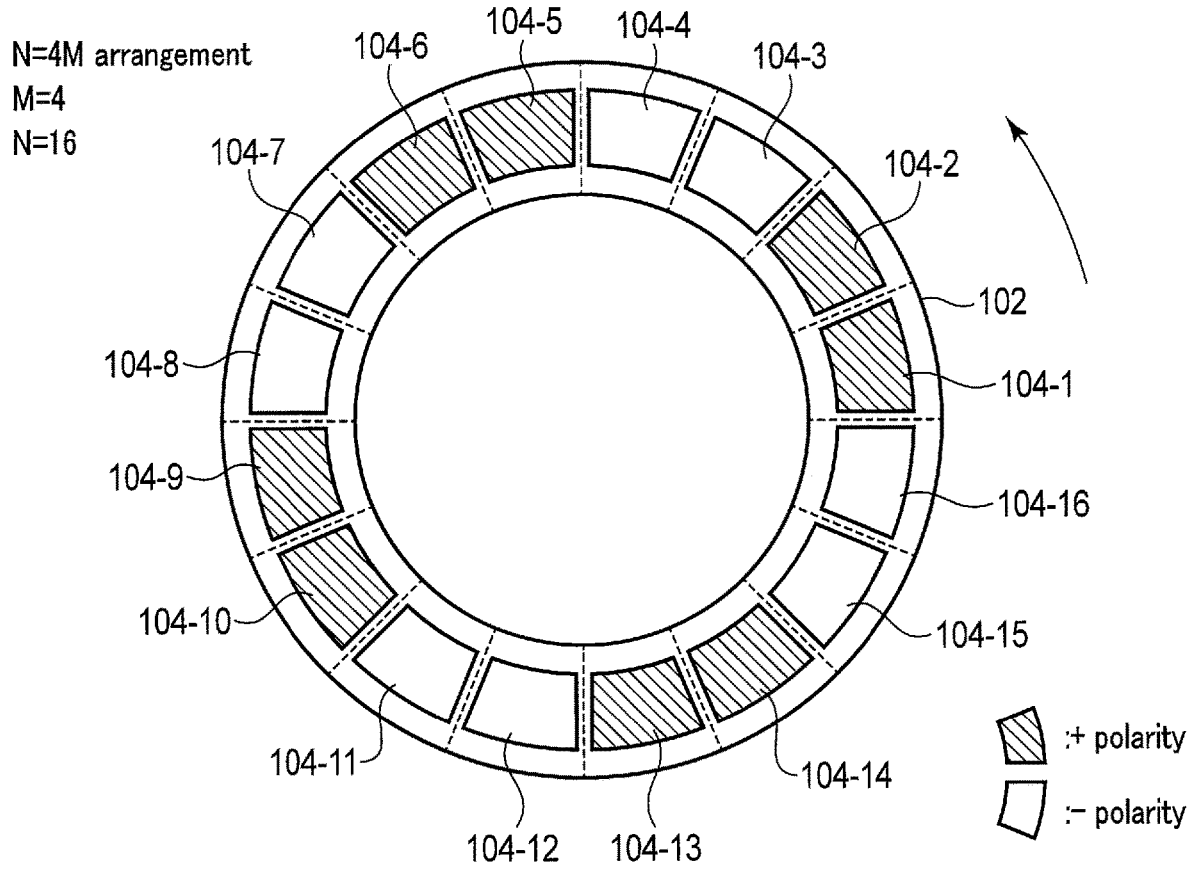
FIG. 17A is a diagram illustrating another example of an N=M4 arrangement according to an embodiment.

FIG. 17A schematically illustrates another example of the N=4M arrangement. Also in the example illustrated in FIG. 17A, the circumferential Lobe mode is the fourth order Lobe mode, and 16 excitation actuators 104-1 to 104-16 are arranged on the annular plate 102 at equal angular intervals. In this example, a sector-shaped piezoelectric element is used as the excitation actuators 104. The sector-shaped piezoelectric element is provided on the annular plate 102 by applying a piezoelectric material to the annular plate 102. The excitation actuators 104-1, 104-2, 104-5, 104-6, 104-9, 104-10, 104-13, and 104-14 are positive piezoelectric elements, and the excitation actuators 104-3, 104-4, 104-7, 104-8, 104-11, 104-12, 104-15, and 104-16 are negative piezoelectric elements. A set of two piezoelectric elements having a positive polarity and a set of two piezoelectric elements having a negative polarity are alternately arranged.

Figure 17B:
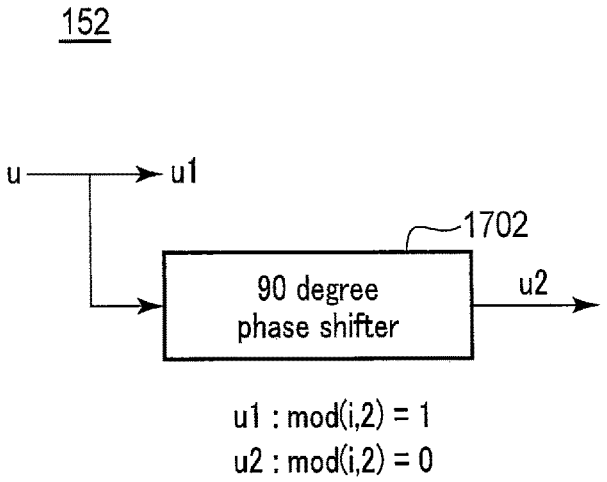
FIG. 17B is a block diagram illustrating a drive circuit that may be used for the excitation actuator arrangement illustrated in FIG. 17A.

FIG. 17B schematically illustrates an example of a drive circuit of the first controller 152 used for the N=4M arrangement illustrated in FIG. 17A. As illustrated in FIG. 17B, the first controller 152 includes a 90 degree phase shifter 1702. The drive signal u is output from the driving signal generation unit 161 (FIG. 12A) and is branched into two. A first branch drive signal u is output as it is as a drive signal u1. The drive signal u1 is sent to the excitation actuators 104-1, 104-3, 104-5, 104-7, 104-9, 104-11, 104-13, and 104-15. A second branch drive signal u is supplied to the 90 degree phase shifter 1702. The 90 degree phase shifter 1702 applies a phase shift of −90 degrees to the second branch drive signal to generate a drive signal u2. The drive signal u2 is sent to the excitation actuators 104-2, 104-4, 104-6, 104-8, 104-10, 104-12, 104-14, and 104-16.

Figure 18:
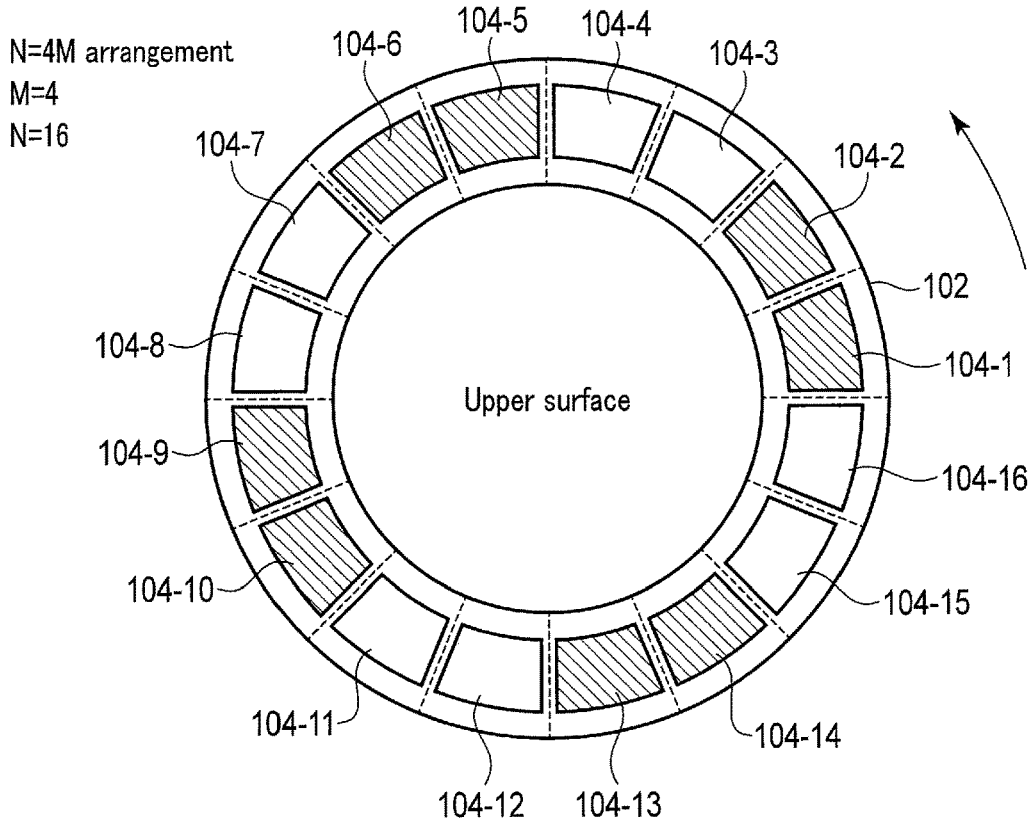
FIG. 18 is a diagram illustrating a further example of the N=M4 arrangement according to an embodiment.
Figure 18:
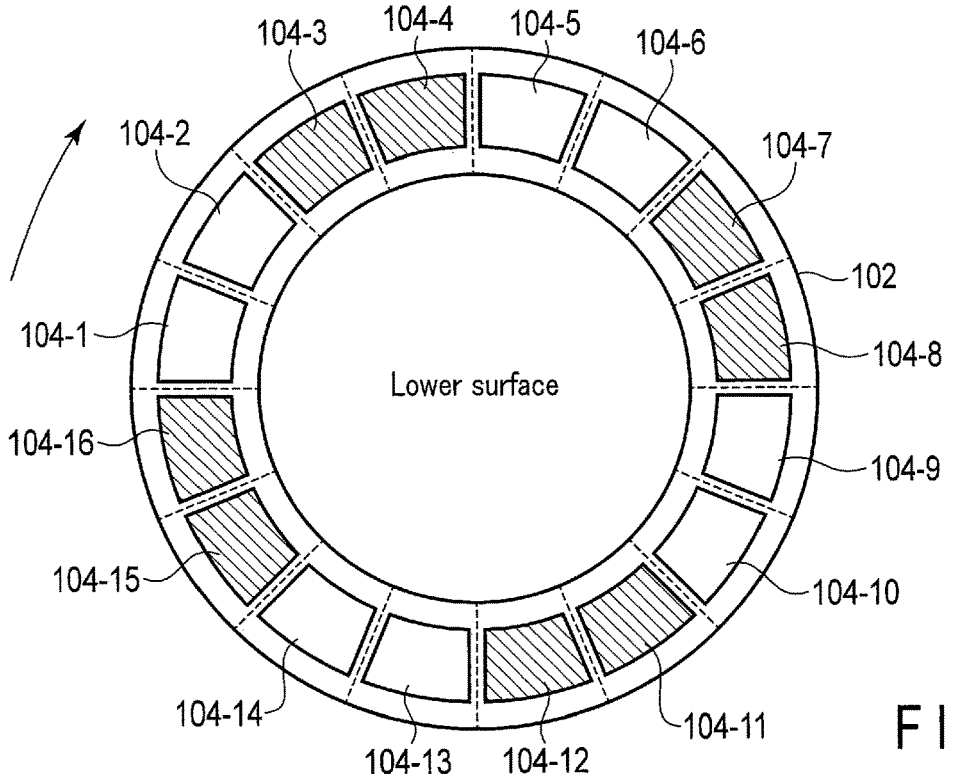

In the example illustrated in FIG. 17A, the excitation actuators 104 are a unimorph piezoelectric element. The excitation actuators 104 may be a bimorph piezoelectric element including a positive piezoelectric element and a negative piezoelectric element. FIG. 18 schematically illustrates an example of the N=4M arrangement in a case where each of the excitation actuators 104 is a bimorph piezoelectric element. In FIG. 18, the upper side indicates the upper surface of the annular plate 102, and the lower side indicates the lower surface of the annular plate 102. As illustrated in FIG. 18, the excitation actuator 104-*i* (i=1, 2, 5, 6, 9, 10, 13, 14) includes a positive piezoelectric element applied to the upper surface of the annular plate 102 and a negative piezoelectric element applied to the lower surface of the annular plate 102 so as to face the positive piezoelectric element. The excitation actuator 104-*i* (i=3, 4, 7, 8, 11, 12, 15, 16) includes a negative piezoelectric element applied to the upper surface of the annular plate 102 and a positive piezoelectric element applied to the lower surface of the annular plate 102 so as to face the negative piezoelectric element across the annular plate 102. By using a bimorph piezoelectric element as the excitation actuator 104, it is possible to increase the excitation force to the annular plate 102. The drive circuit illustrated in FIG. 17B can also be used for the excitation actuator arrangement illustrated in FIG. 18.

Thus, in the N=4M arrangement, it is possible to excite the circumferential Lobe mode using one 90 degree phase shifter. Since the excitation actuators 104 are small and light, the N=4M arrangement is sufficiently possible. When the excitation actuators 104 are implemented by application of a piezoelectric material, further weight and size reduction of the apparatus can be achieved.

The N=2M+α arrangement is a method of arranging the number of excitation actuators obtained by adding a to twice the order M of the Lobe mode, where α is an integer of 1 or more. From the viewpoint of spatial aliasing, a is desirably 3 or more. In the N=2M+α arrangement, when N is an even number other than 3M, N/2-1 phase shifters are required. For example, in a case where the circumferential Lobe mode is the seventh order Lobe mode and 16 excitation actuators 104 are arranged on the annular plate 102, seven phase shifters are required. When N is equal to 3M, two phase shifters are sufficient. The value N is determined in consideration of a balance between the number of phase shifters and the number of excitation actuators.

Figure 19A:
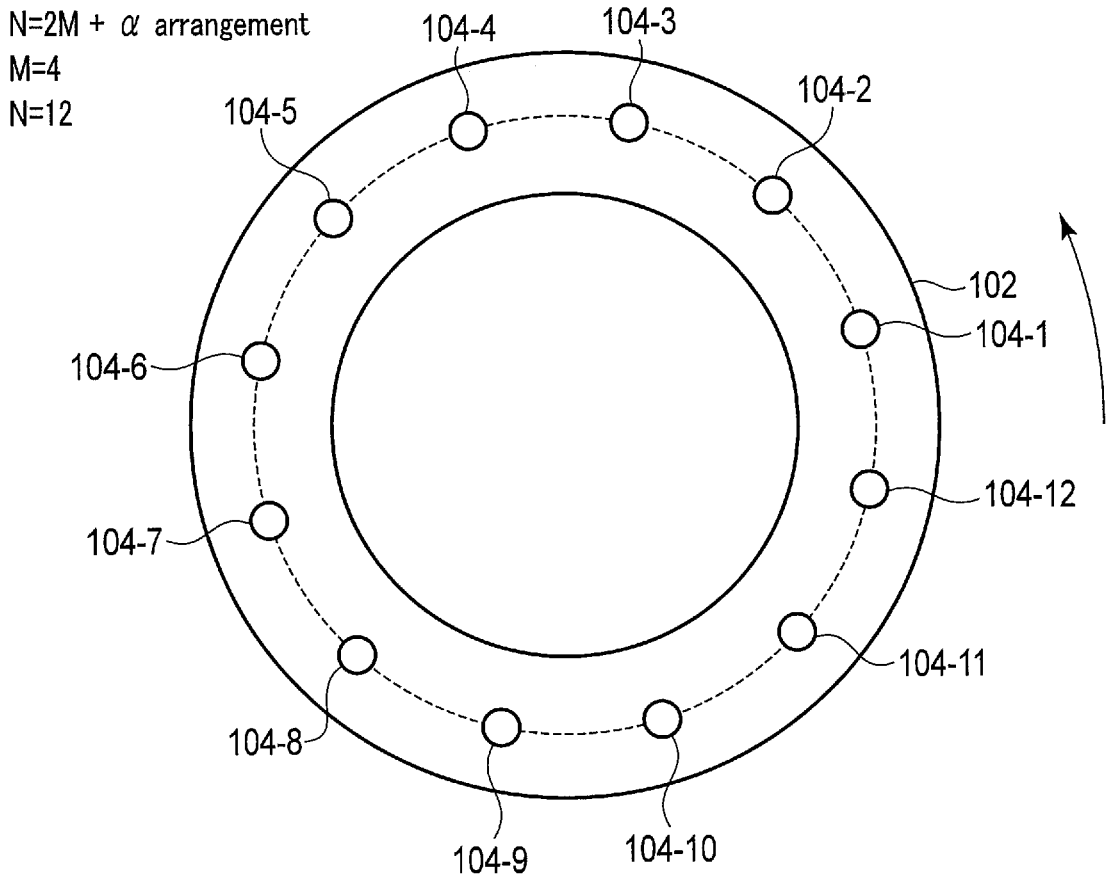
FIG. 19A is a diagram illustrating an example of an N=2M+a arrangement according to an embodiment.

FIG. 19A schematically illustrates an example of the N=2M+α arrangement. In the example illustrated in FIG. 19A, the circumferential Lobe mode is the fourth order Lobe mode, and 12 excitation actuators 104-1 to 104-12 are arranged on the annular plate 102 at intervals of 30 degrees.

Figure 19B:
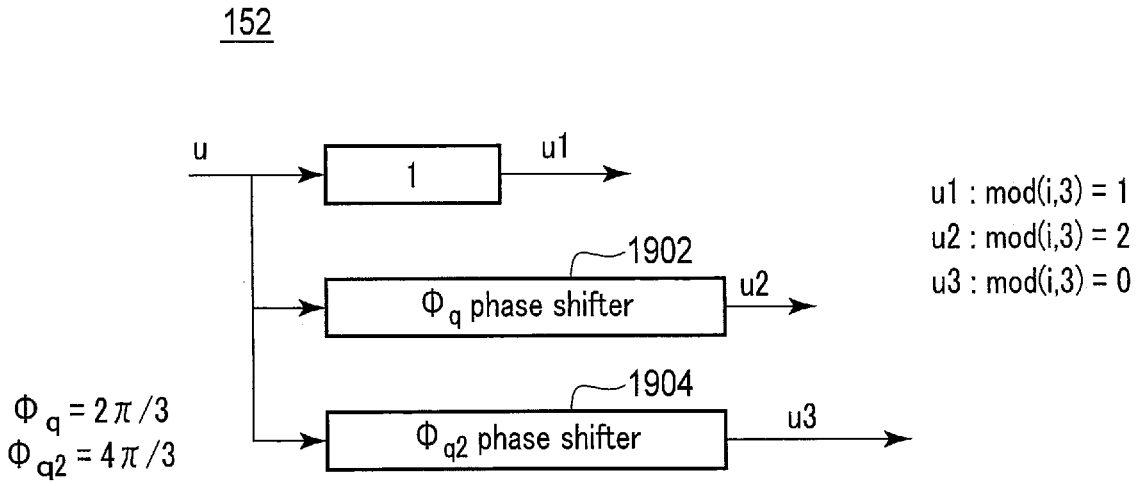
FIG. 19B is a block diagram illustrating a drive circuit that may be used for the excitation actuator arrangement illustrated in FIG. 19A.

FIG. 19B schematically illustrates an example of the drive circuit of the first controller 152 used when N=3M is satisfied in the N=2M+α arrangement illustrated in FIG. 19A. As illustrated in FIG. 19B, the first controller 152 includes a 120 degree phase shifter 1902 and a 240 degree phase shifter 1904. A drive signal u is output from the driving signal generation unit 161 (FIG. 12A) and is branched into three. A first branch drive signal u is output as it is as a drive signal u1. The drive signal u1 is sent to the excitation actuators 104-1, 104-4, 104-7, and 104-10. A second branch drive signal u is supplied to the 120 degree phase shifter 1902. The 120 degree phase shifter 1902 applies a phase shift of −120 degrees to the second branch drive signal u to generate a drive signal u2. The drive signal u2 is sent to the excitation actuators 104-2, 104-5, 104-8, and 104-11. A third branch drive signal u is supplied to the 240 degree phase shifter 1904. The 240 degree phase shifter 1904 applies a phase shift of −240 degrees to the third branch drive signal u to generate a drive signal u3. The drive signal u3 is sent to the excitation actuators 104-3, 104-6, 104-9, and 104-12.

The λ/4 gap arrangement is a method in which 2M-2 piezoelectric elements are arranged and two of the piezoelectric elements are arranged with a gap of an angle of λ/4. The λ/4 gap arrangement is a method of exciting a surface wave of the annular plate 102, and cannot be used to excite the vibration mode of the annular plate 102. However, when the application is object floating, the λ/4 gap arrangement can be adopted.

Figure 20:
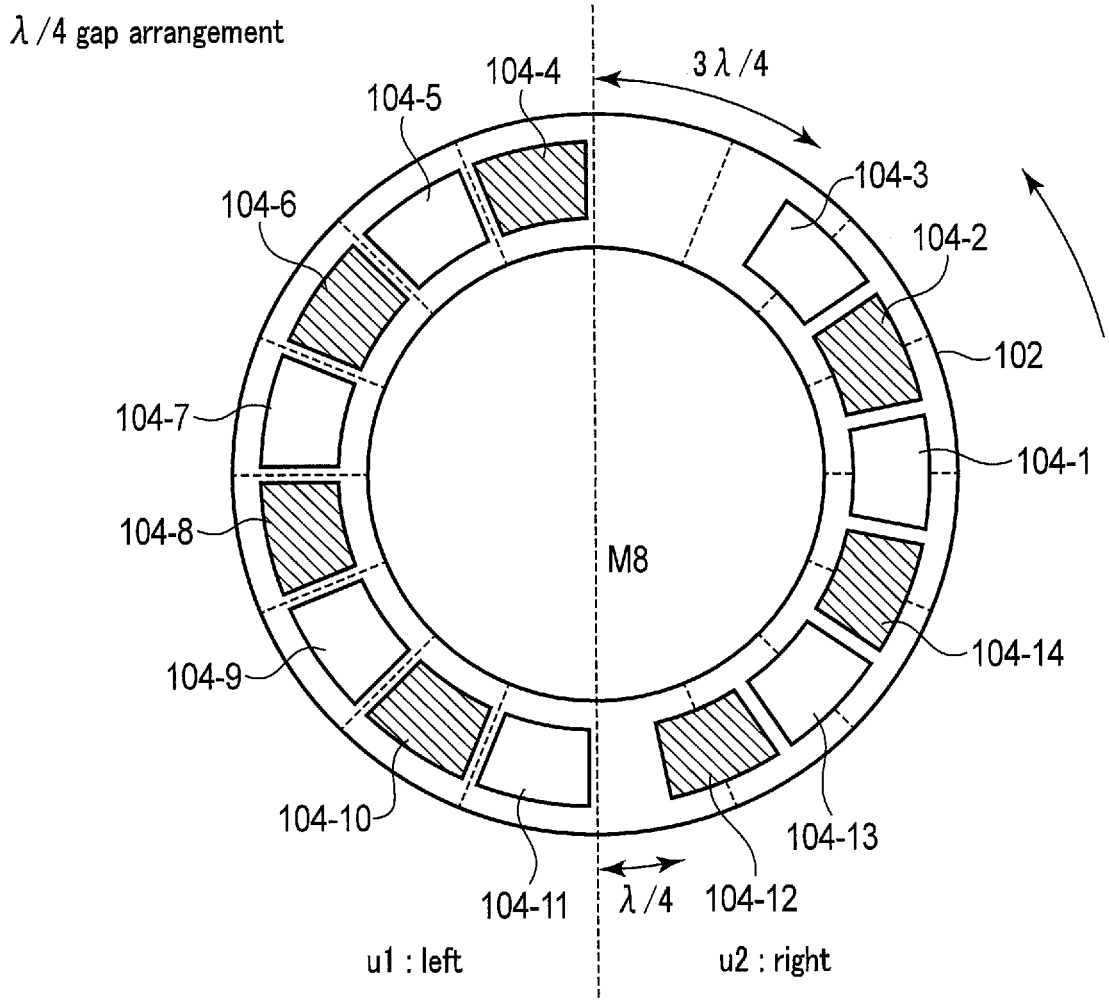
FIG. 20 is a diagram illustrating an example of a λ/4 gap arrangement according to an embodiment.
Figure 20:
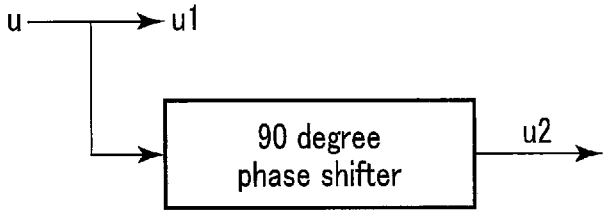

FIG. 20 schematically illustrates an example of the λ/4 gap arrangement. In the example illustrated in FIG. 20, 14 excitation actuators 104-1 to 104-14 are arranged on the annular plate 102. The excitation actuators 104-2, 104-4, 104-6, 104-8, 104-10, 104-12, and 104-14 are positive piezoelectric elements, and the excitation actuators 104-1, 104-3, 104-5, 104-7, 104-9, 104-11, and 104-13 are negative piezoelectric elements. There is a gap of λ/4 between the excitation actuators 104-11 and 104-12, and there is a gap of 3λ/4 between the excitation actuators 104-3 and 104-4. The drive signal u1 is sent to the excitation actuators 104-4 to 104-11, and the drive signal u2 is sent to the excitation actuators 104-1 to 104-3 and 104-12 to 104-14. The drive signal u2 is a signal obtained by applying a phase shift of −90 degrees to the drive signal u1.

[Phase Shifter]

The delay unit time-shifts a signal, and it is easy to construct a drive circuit using the delay unit. However, it is necessary to adjust the delay time each time the rotation frequency of the rotational blades changes. This results in a change in path characteristics from the sound emitting apparatus to a microphone, which will be described later. Therefore, it is necessary to change the path characteristics each time the rotation frequency of the rotational blade changes, which is inconvenient. On the other hand, since the phase shifter does not depend on the frequency, it is not necessary to change the phase shift amount and the path characteristics.

The 90 degree phase shifter is also referred to as a Hilbert transformer, and can be realized by using the following FIR coefficients of an FIR filter.

$$g(i) = \frac{\sin^2\left(\pi\left(i - \frac{Lf}{2}\right)/2\right)}{\pi\left(i - \frac{Lf}{2}\right)/2}$$

$$g\left(\frac{Lf}{2}\right) = 0$$

Here, g(i) is the i-th coefficient, and Lf is a filter length.

Figure 21:
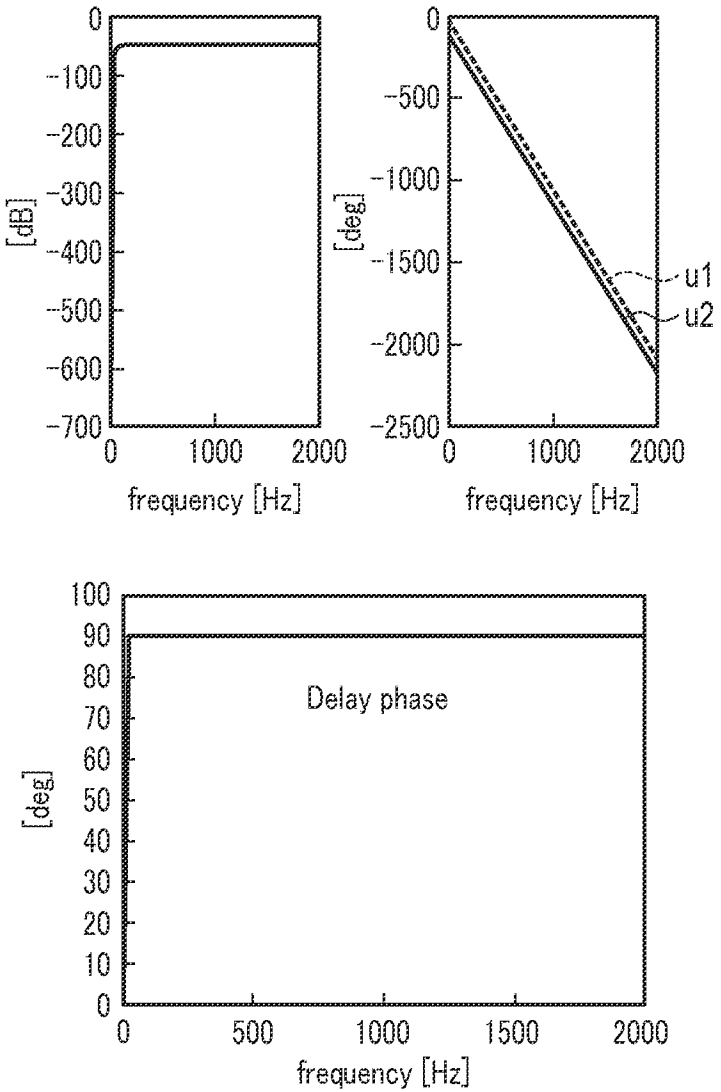
FIG. 21 is a diagram for illustrating a phase shifter according to an embodiment.
Figure 21:
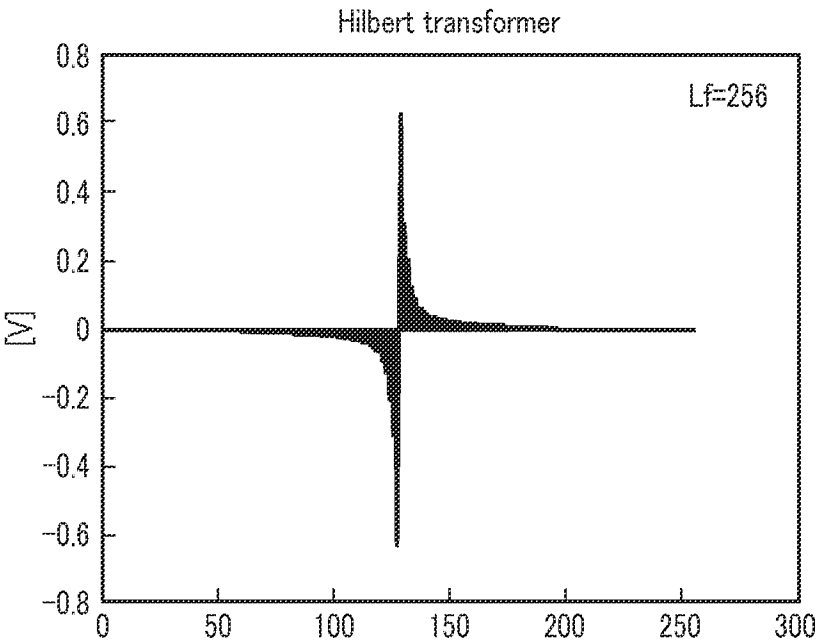
Figure 22:
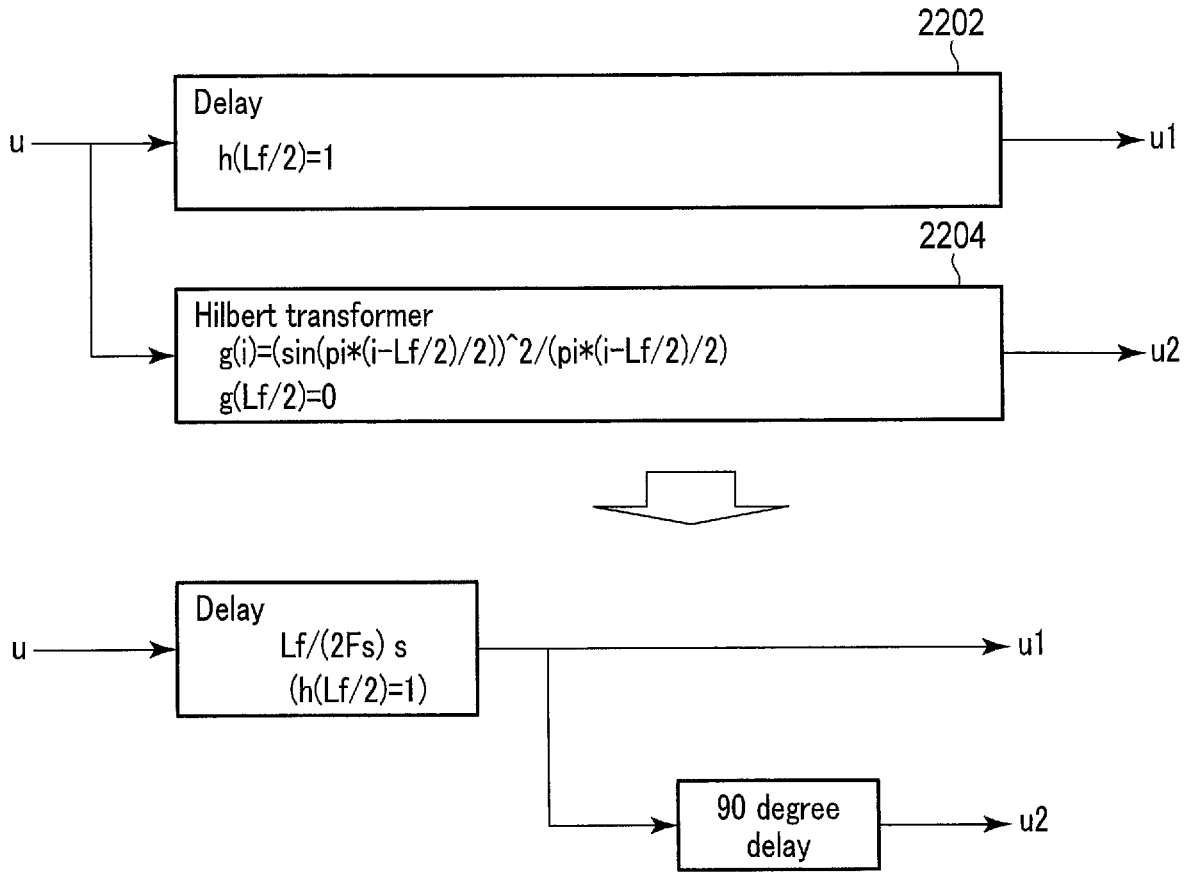
FIG. 22 is a block diagram illustrating a phase shifter that applies a 90 degree phase shift according to an embodiment.

The left side drawing of FIG. 21 illustrates the characteristics of the Hilbert transformer when the filter length Lf is 256. FIG. 22 schematically illustrates a 90 degree phase shifter using a Hilbert transformer. As illustrated in FIG. 22, the 90 degree phase shifter includes a delay unit 2202 and a Hilbert transformer 2204. The Hilbert transformer 2204 applies a phase shift of π/2 to a signal u to generate a signal u2. The Hilbert transformer 2204 using an FIR filter includes a delay of Lf/2 Fs seconds, where Fs is a sampling frequency. The delay unit 2202 delays the signal u by a delay time generated by the Hilbert transformer 2204 to generate a signal u1. The delay unit 2202 may be implemented using an FIR filter having a filter coefficient h(Lf/2)=1. As illustrated in the right side drawing of FIG. 21, a phase difference between an output u1 of the delay unit 2202 for an input u and an output u2 of the Hilbert transformer 2204 for the input u is 90 degrees regardless of the frequency.

Phase shifters applying phase shifts other than 90 degrees can be implemented using a Hilbert transformer by synthesis of trigonometric functions.

Figure 23:
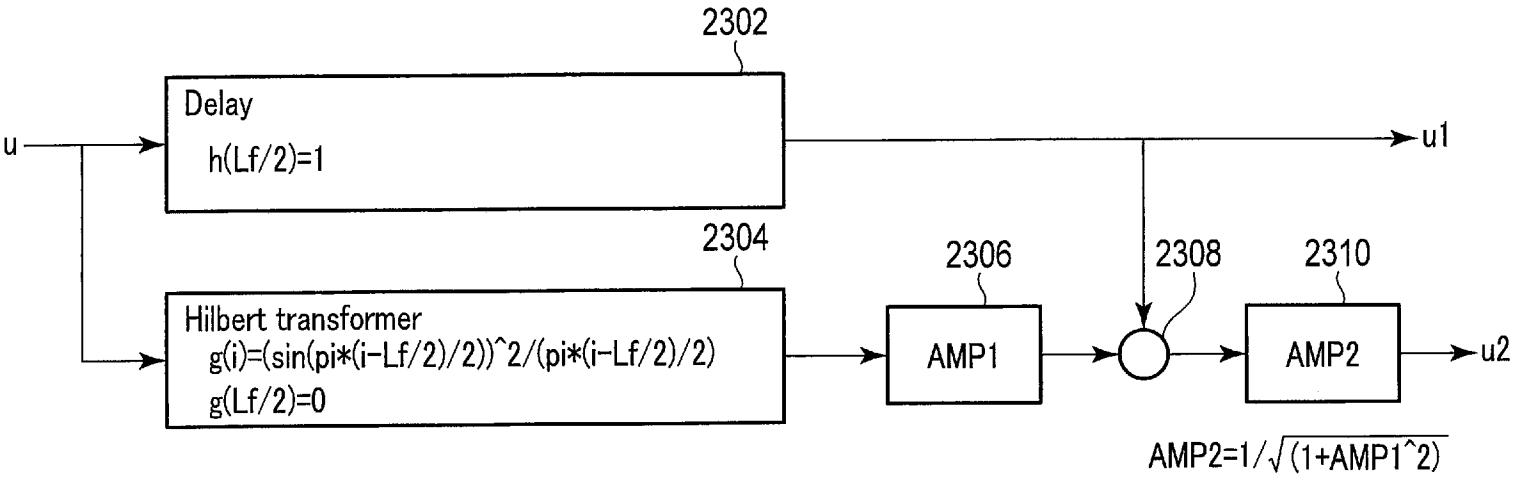
FIG. 23 is a block diagram illustrating a phase shifter that applies an arbitrary phase shift according to an embodiment.

FIG. 23 schematically illustrates a phase shifter that applies a phase shift of θ to an input signal. The phase shifter illustrated in FIG. 23 includes a delay unit 2302, a Hilbert transformer 2304, an amplifier 2306, an element 2308, and an amplifier 2310. The element 2308 is an adder when 0°<θ<90° or 270°<θ<360°, and is a subtractor when 90°<θ<180° or 180°<θ<270°.

The signal u is branched into two and supplied to the delay unit 2302 and the Hilbert transformer 2304. The delay unit 2302 delays the signal u by a delay time equal to a delay time generated by the Hilbert transformer 2204. The output signal of the Hilbert transformer 2304 is amplified by the amplifier 2306. The amplifier 2306 has a gain of tan θ when 0°<θ<90° or 270°<θ<360°, and has a gain of −tan θ when 90°<θ<180° or 180°<θ<270°. The element 2308 adds the signal u1 to the output signal of the amplifier 2306 or subtracts the signal u1 from the output signal of the amplifier 2306. The amplifier 2310 amplifies the output signal of the element 2308. The amplifier 2310 has a gain of $1/\sqrt{1+\tan^2\theta}$. A phase difference between the output signal u1 of the delay unit 2302 and the output signal u2 of the amplifier 2310 is θ.

$$0^\circ<\theta<90^\circ \text{ or } 270^\circ<\theta<360^\circ$$

$$j(i)=(h(i)+\text{amp1}\times g(i))\times\text{amp2}$$

$$\text{amp1}=\tan\theta$$

$$\text{amp 2}=\frac{1}{\sqrt{1+\text{amp1}^2}}\quad 90^\circ<\theta<180^\circ \text{ or } 180^\circ<\theta<270^\circ$$

$$j(i)=(-h(i)+\text{amp 1}\times g(i))\times\text{amp 2}$$

$$\text{amp 1}=-\tan\theta$$

$$\text{amp 2}=\frac{1}{\sqrt{1+\text{amp1}^2}}$$

Figure 24:
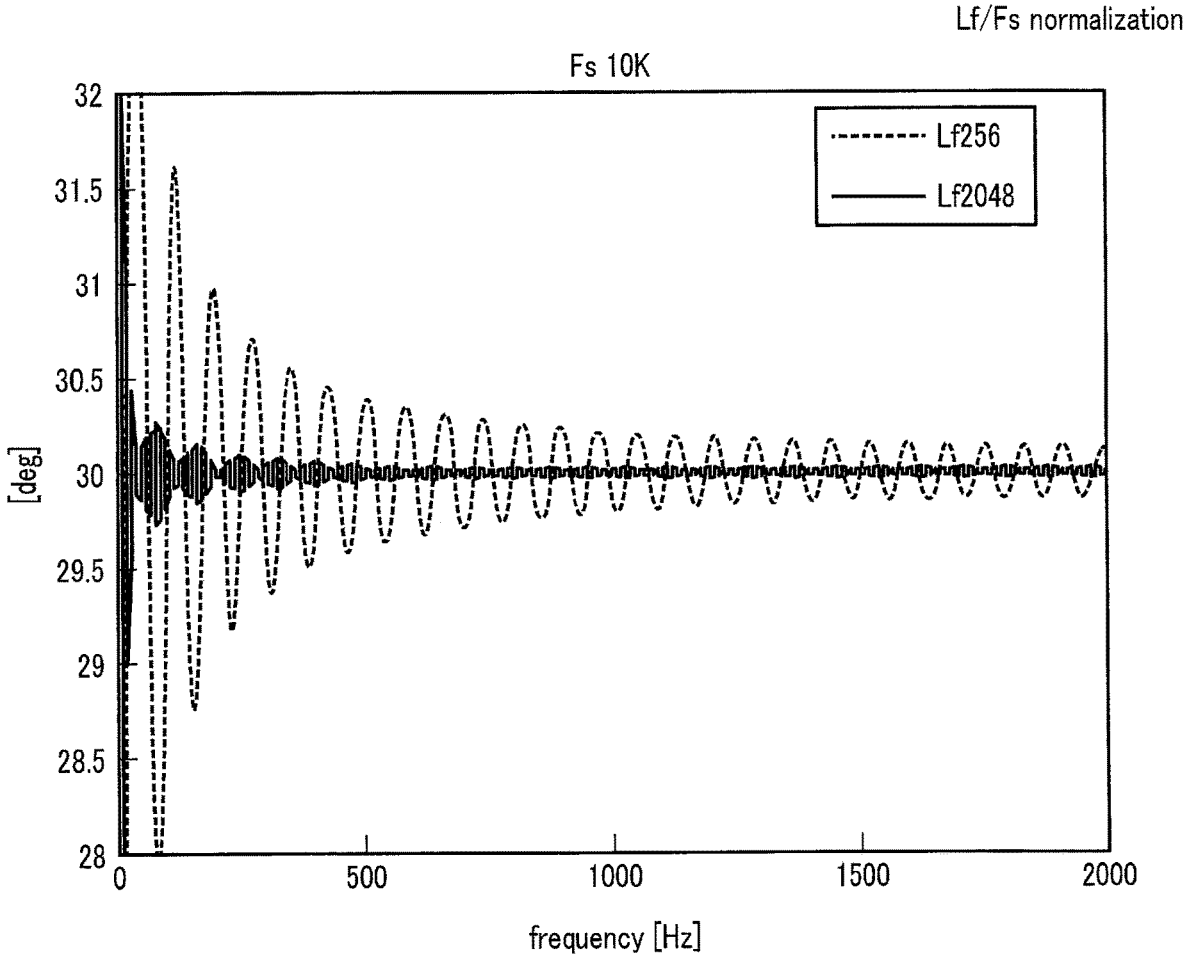
FIG. 24 is a diagram illustrating a delay error occurring in a phase shifter according to an embodiment.

As illustrated in FIG. 24, in the case of an arbitrary phase shift, a delay error occurs at a low frequency depending on the filter length Lf. Since the graph illustrated in FIG. 24 can be normalized by Lf/Fs, for example, in a setting of Lf/Fs=512/10000, the error range is 0.5 degrees or less at 200 Hz or more. The filter length Lf is set in accordance with the used frequency band and the sampling frequency.

Hereinafter, the phase shifter that applies the phase shift of θ to the input signal using the FIR filter may be referred to as a filter j(θ).

Figure 25:
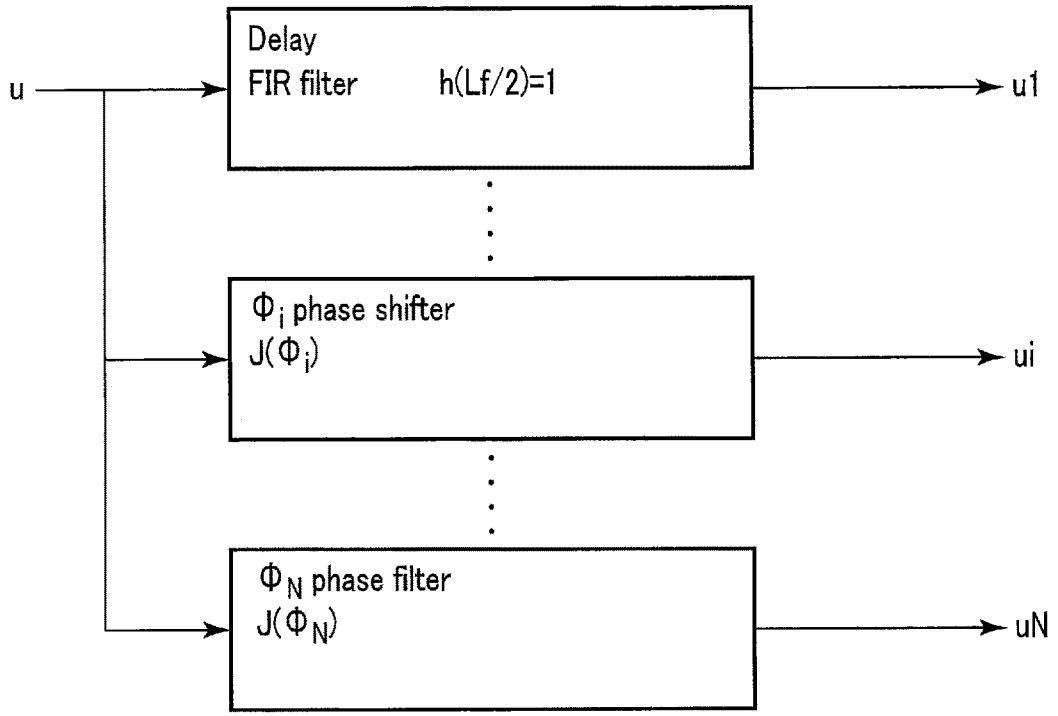
FIG. 25 is a block diagram illustrating a drive circuit using a filter J(θ) according to an embodiment.

FIG. 25 schematically illustrates an example of constructing the drive circuit illustrated in FIG. 12A using the filter J(θ). The drive circuit illustrated in FIG. 25 includes a delay unit and (N−1) filters $J(\theta_2)$, . . . $J(\theta_N)$. In this drive circuit, a time delay of Lf/2 Fs seconds is applied as a whole, but the phase difference is maintained. In this drive circuit, it is not necessary to adjust the parameter (specifically, the phase shift amount) of the phase shifter with respect to a change in rotation frequency. This leads to fixation of path characteristics from the input of the sound emitting apparatus to the microphone in the blade noise reduction apparatus, and thus the drive circuit illustrated in FIG. 25 has a great advantage as compared with the drive circuit that generates a phase difference between signals only by the delay unit as illustrated in FIG. 12B.

Figure 26:
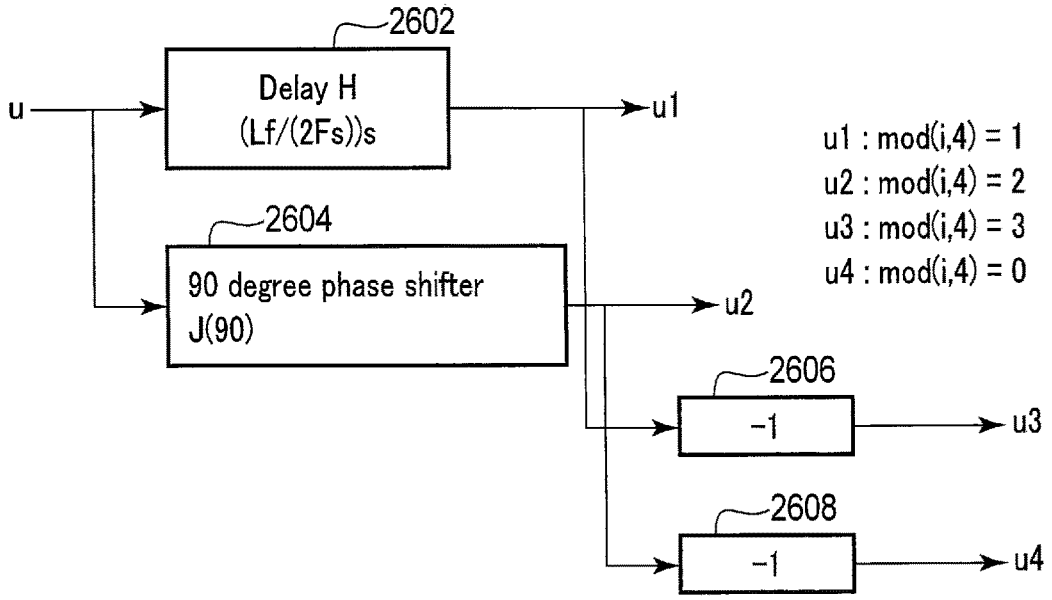
FIG. 26 is a block diagram illustrating a drive circuit using a filter J(θ) according to an embodiment.

FIG. 26 schematically illustrates an example of constructing the drive circuit illustrated in FIG. 16B using a filter J(90). The drive circuit illustrated in FIG. 26 includes a delay unit 2602, a 90 degree phase shifter (filter J(90)) 2604, and inverting circuits 2606 and 2608. The delay unit 2602 delays the signal u by Lf/2 Fs seconds. The output of the delay unit 2602 is branched into two, one is output as the signal u1, and the other is supplied to the inverting circuit 2606. The inverting circuit 2606 inverts the signal from the delay unit 2602 to generate a signal u3. The 90 degree phase shifter 2604 applies a phase shift of −90 degrees to the signal u. The output of the 90 degree phase shifter 2604 is branched into two, one is output as a signal u2, and the other is supplied to the inverting circuit 2608. The inverting circuit 2608 inverts the signal from the 90 degree phase shifter 2604 to generate a signal u4.

Figure 27:
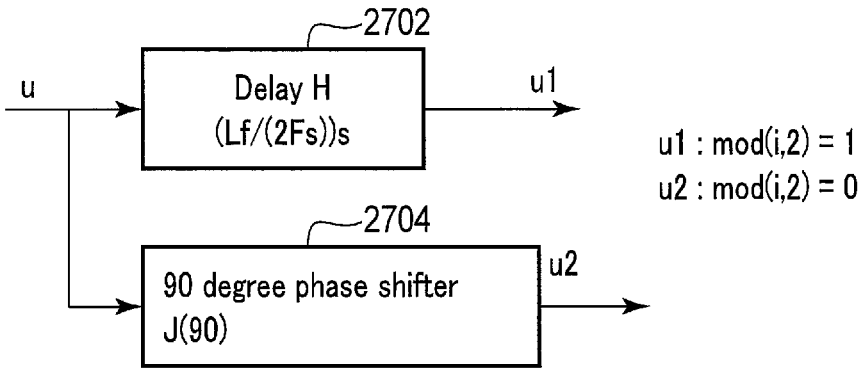
FIG. 27 is a block diagram illustrating a drive circuit using a filter J(θ) according to an embodiment.

FIG. 27 schematically illustrates an example of constructing the drive circuit illustrated in FIG. 17B using a filter J(90). The drive circuit illustrated in FIG. 27 includes a delay unit 2702 and a 90 degree phase shifter (filter J(90)) 2704. The delay unit 2702 generates the signal u1 by delaying the signal u by Lf/2 Fs seconds. The 90 degree phase shifter 2704 applies a phase shift or −90 degrees to the signal u to generate the signal u2.

Figure 28:
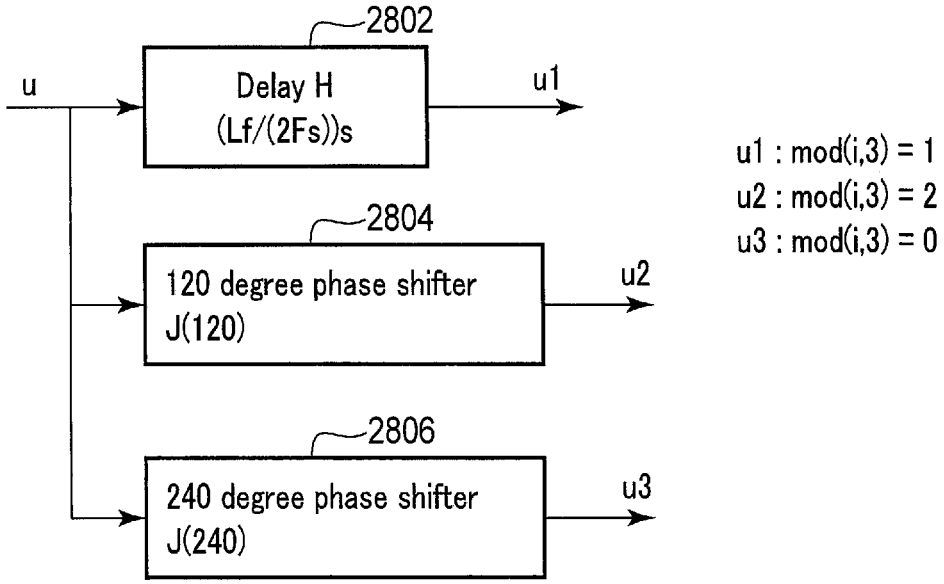
FIG. 28 is a block diagram illustrating a drive circuit using a filter J(θ) according to an embodiment.

FIG. 28 schematically illustrates an example of constructing the drive circuit illustrated in FIG. 19B using a filter J(120) and a filter J(240). The drive circuit illustrated in FIG. 28 includes a delay unit 2802, a 120 degree phase shifter (filter J(120)) 2804, and a 240 degree phase shifter (filter J(240)) 2806. The delay unit 2802 generates the signal u1 by delaying the signal u by Lf/2 Fs seconds. The 120 degree phase shifter 2804 applies a phase shift of −120 degrees to the signal u to generate the signal u2. The 240 degree phase shifter 2806 applies a phase shift of −240 degrees to the signal u to generate the signal u3.

Figure 29:
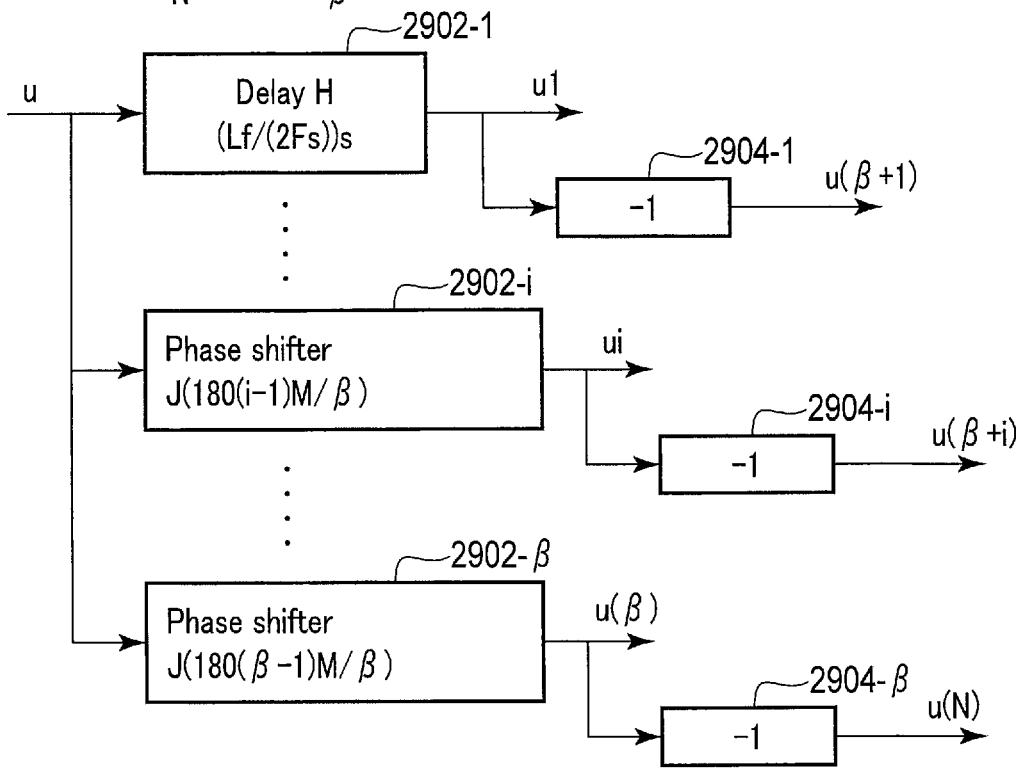
FIG. 29 is a block diagram illustrating a drive circuit using a filter J(θ) according to an embodiment.

FIG. 29 schematically illustrates the drive circuit when the number of excitation actuators is an even number and is larger than 2M+1 (N=2β>2M+1). Here, β is half the number of excitation actuators. The drive circuit illustrated in FIG. 29 includes a delay unit 2902-1, phase shifters (J(180M/β), . . . , J(180(i−1)M/β)) 2902-2, . . . , and 2902-β, and inverting circuits 2904-1, . . . , and 2904-β.

The delay unit 2902-1 delays the drive signal u from the driving signal generation unit 161 (FIG. 12A) by Lf/2 Fs seconds. The output signal of the delay unit 2902-1 is branched into two, one of which is sent to the excitation actuator 104-1 as a signal u1, and the other is supplied to the inverting circuit 2904-1. The inverting circuit 2904-1 inverts the signal from the delay unit 2902-1 to generate a signal u(β+1). The signal u(β+1) is sent to the excitation actuator 104-(β+1).

The phase shifter **2902-*i* applies a phase shift of −180(i−1)M/β to the drive signal u from the driving signal generation unit 161 (FIG. 12A). The output signal of the phase shifter 2902-*i* is branched into two, one of which is sent to the excitation actuator 104-*i* as a signal ui, and the other is supplied to the inverting circuit 2904-*i***. The inverting circuit

2904-*i* inverts the signal from the phase shifter 2902-*i* to generate a signal u(β+i). The signal u(β+i) is sent to the excitation actuator 104-(β+i).

[Multiple Lobe Mode Drive]

The sound emitting apparatus 100 illustrated in FIG. 1 has efficient radiation performance for one frequency and one Lobe mode (hereinafter, it is described as a mode (fi, Mi)). In order to drive a plurality of modes (fi, Mi), a plurality of annular plates is required. As a method of arranging the plurality of annular plates, a method of arranging the annular plates in the horizontal direction and a method of arranging the annular plates in the vertical direction are conceivable.

Figure 30A:
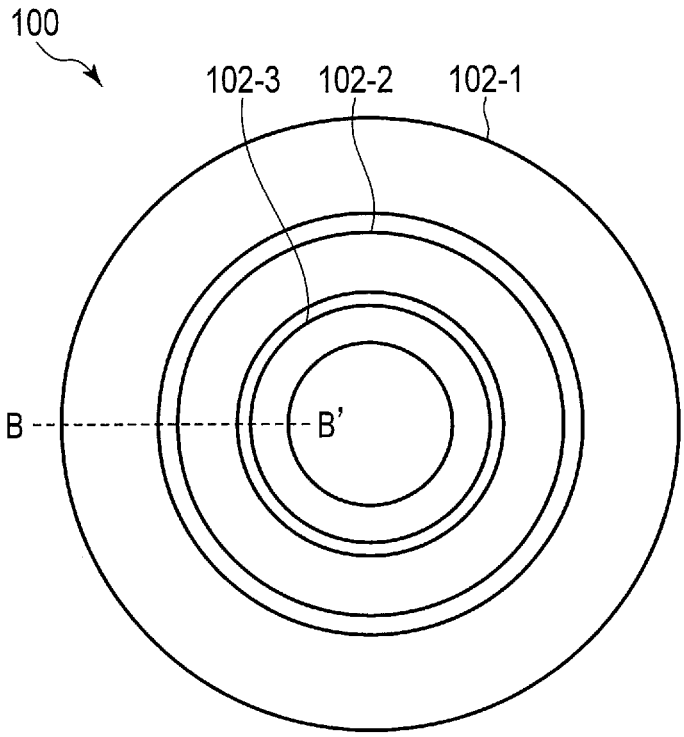
FIG. 30A is a top view illustrating another structural example of a sound emitting apparatus according to an embodiment.
Figure 30B:
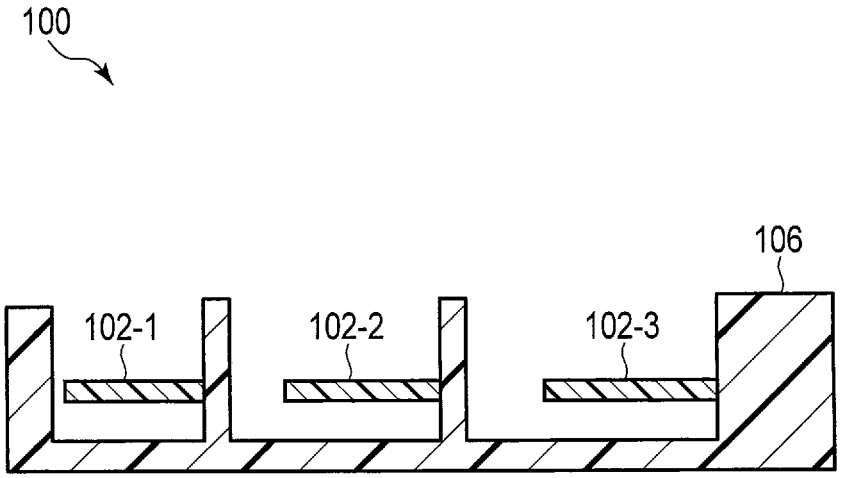
FIG. 30B is a cross-sectional view of the sound emitting apparatus illustrated in FIG. 30A.

FIG. 30A schematically illustrates another structural example of the sound emitting apparatus 100 according to the embodiment, and FIG. 30B schematically illustrates a cross section of the sound emitting apparatus 100 taken along line B-B' illustrated in FIG. 30A. In the example illustrated in FIGS. 30A and 30B, the sound emitting apparatus 100 includes annular plates 102-1, 102-2, and 102-3 arranged in the horizontal direction. The annular plates 102-1, 102-2, and 102-3 are fixed to the case 106, the annular plate 102-2 is arranged inside the annular plate 102-1, and the annular plate 102-3 is arranged inside the annular plate 102-2. The annular plate 102 located on the outer side has a larger outer radius. Specifically, the outer radius of the annular plate 102-1 is larger than the outer radius of the annular plate 102-2, and the outer radius of the annular plate 102-2 is larger than the outer radius of the annular plate 102-3. Therefore, the annular plate 102-3 is for a high frequency, and the annular plate 102-1 is for a low frequency. For example, when the same Lobe mode is output, the annular plate 102-3 is for a high frequency, and the annular plate 102-1 is for a low frequency. In addition, when a plurality of Lobe modes is output at the same frequency, the annular plate 102-3 is for a low-order Lobe mode, and the annular plate 102-1 is for a high-order Lobe mode. This is because the natural frequency of the same Lobe mode decreases as the outer radius increases.

Figure 31:
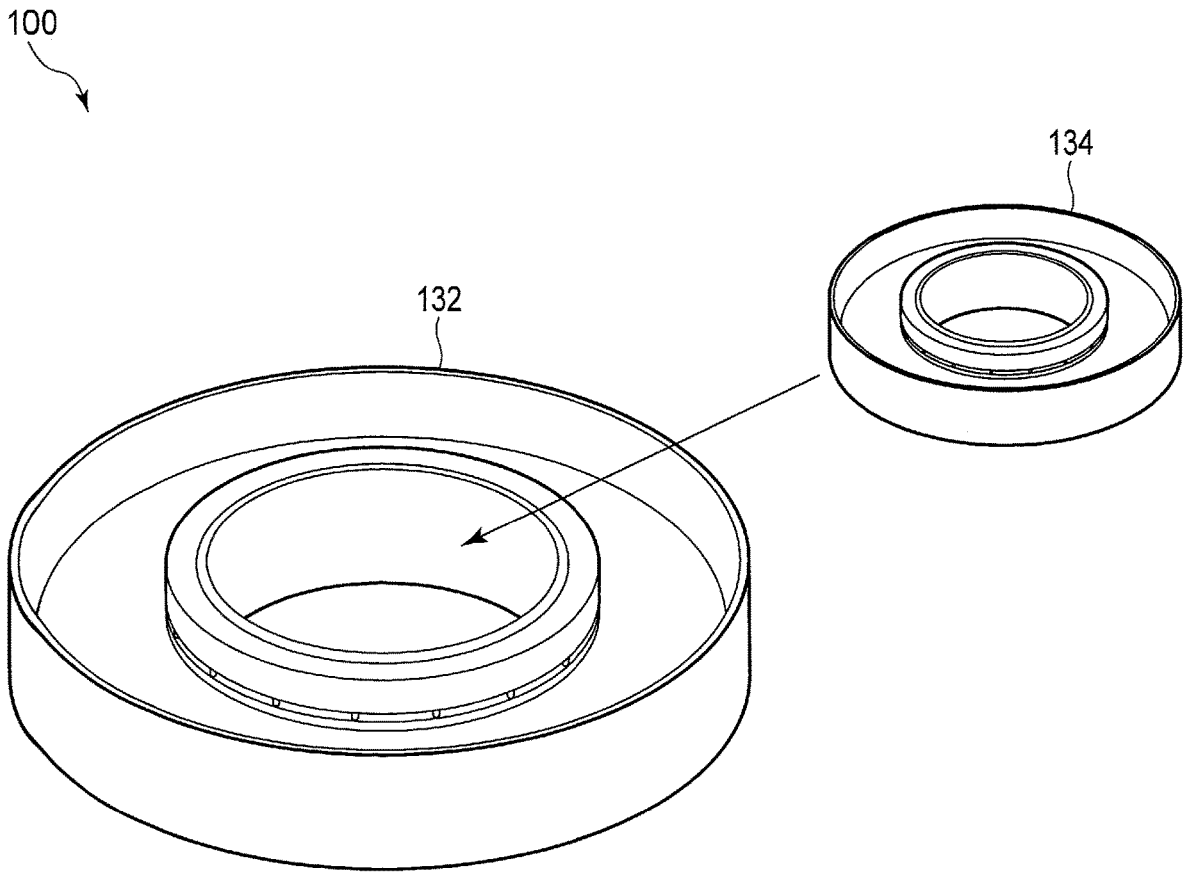
FIG. 31 is an exploded view illustrating a further structural example of a sound emitting apparatus according to an embodiment.

FIG. 31 schematically illustrates a further structural example of the sound emitting apparatus 100 according to the embodiment. In the example illustrated in FIG. 31, the sound emitting apparatus 100 includes sound emitting parts 132 and 134 each having the same structure as that illustrated in FIG. 1, and the sound emitting part 134 is arranged inside the sound emitting part 132. In other words, the sound emitting apparatus 100 includes two sound emitting apparatuses having different sizes to be nested.

Figure 32A:
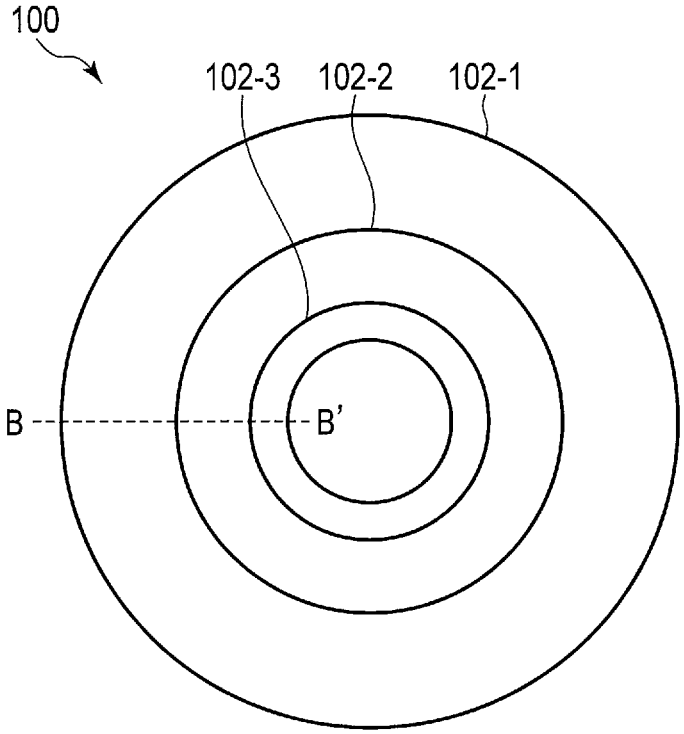
FIG. 32A is a top view illustrating still another structural example of a sound emitting apparatus according to an embodiment.
Figure 32B:
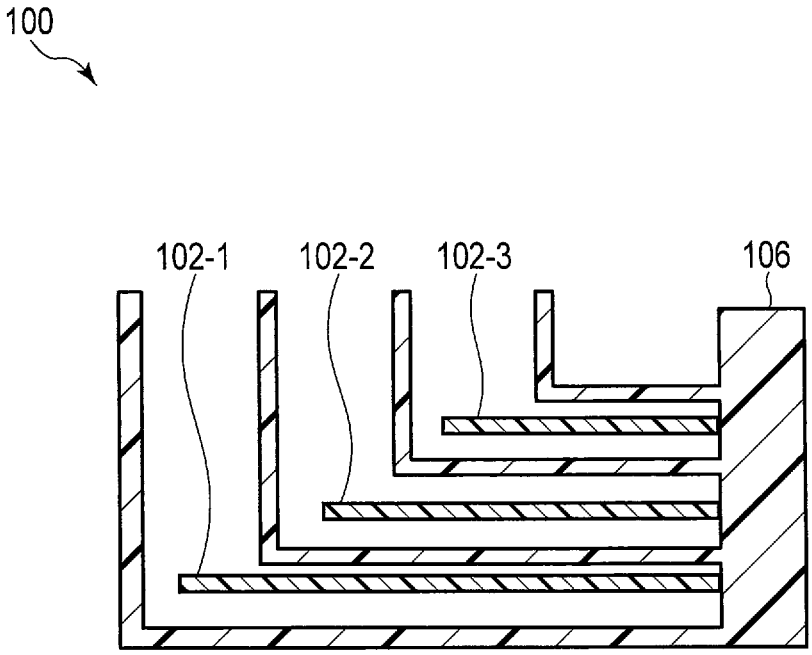
FIG. 32B is a cross-sectional view of the sound emitting apparatus illustrated in FIG. 32A.

FIG. 32A schematically illustrates still another structural example of the sound emitting apparatus 100 according to the embodiment, and FIG. 32B schematically illustrates a cross section of the sound emitting apparatus 100 taken along line B-B' illustrated in FIG. 32A. In the example illustrated in FIGS. 32A and 32B, the sound emitting apparatus 100 includes annular plates 102-1, 102-2, and 102-3 arranged in the vertical direction. The annular plates 102-1, 102-2, and 102-3 are fixed to the case 106, the annular plate 102-2 is arranged above the annular plate 102-1, and the annular plate 102-3 is arranged above the annular plate 102-2. The inner radii of the annular plates 102-1, 102-2, and 102-3 are equal to each other, and the outer radius of the annular plate 102-1 is larger than the outer radius of the annular plate 102-2, and the outer radius of the annular plate 102-2 is larger than the outer radius of the annular plate 102-3. Therefore, the annular plate 102-3 is for a high frequency, and the annular plate 102-1 is for a low frequency.

[Lobe Mode Switching]

In a specific excitation actuator arrangement, it is possible to switch the Lobe mode. An example of a method of switching the Lobe mode using a small number of phase shifters will be described below.

Figures 33, 34:
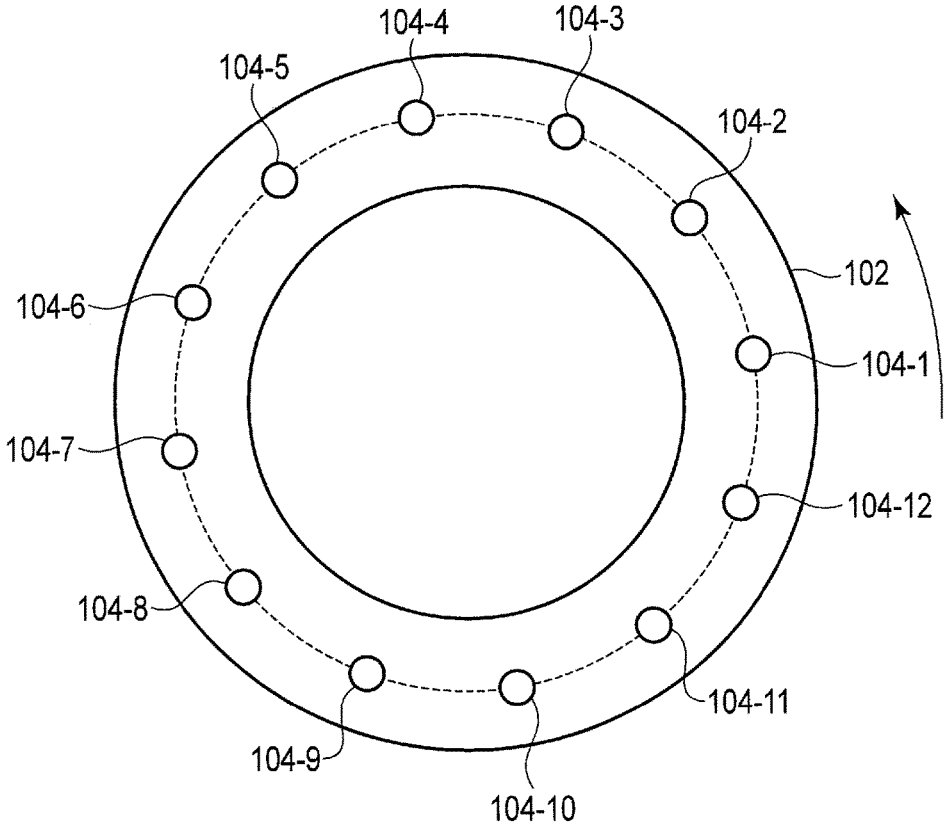
FIG. 33 is a diagram illustrating the number of excitation actuators in an N=3M arrangement and the number of excitation actuators in an N=4M arrangement with respect to the M-th order Lobe mode.
FIG. 34 is a diagram illustrating an excitation actuator arrangement according to an embodiment.

FIG. 33 illustrates the number of excitation actuators in the N=3M arrangement and the number of excitation actuators in the N=4M arrangement with respect to the M-th order Lobe mode. As illustrated in FIG. 33, for example, when the circumferential Lobe mode is the third order Lobe mode, the number of excitation actuators in the N=3M arrangement is 9, and the number of excitation actuators in the N=4M arrangement is 12. As described above, in the N=3M arrangement, the drive circuit can be constituted by two phase shifters, and in the N=4M arrangement, the drive circuit can be constituted by one phase shifter.

When the 12 excitation actuators 104-1 to 104-12 are arranged on the annular plate 102 at intervals of 30 degrees as illustrated in FIG. 34, the sound emitting apparatus 100 can selectively excite one of three vibration modes corresponding to the first, third, and fourth order Lobe modes to the annular plate 102 by using the excitation actuators 104-1 to 104-12 and the three phase shifters.

Figure 35A:
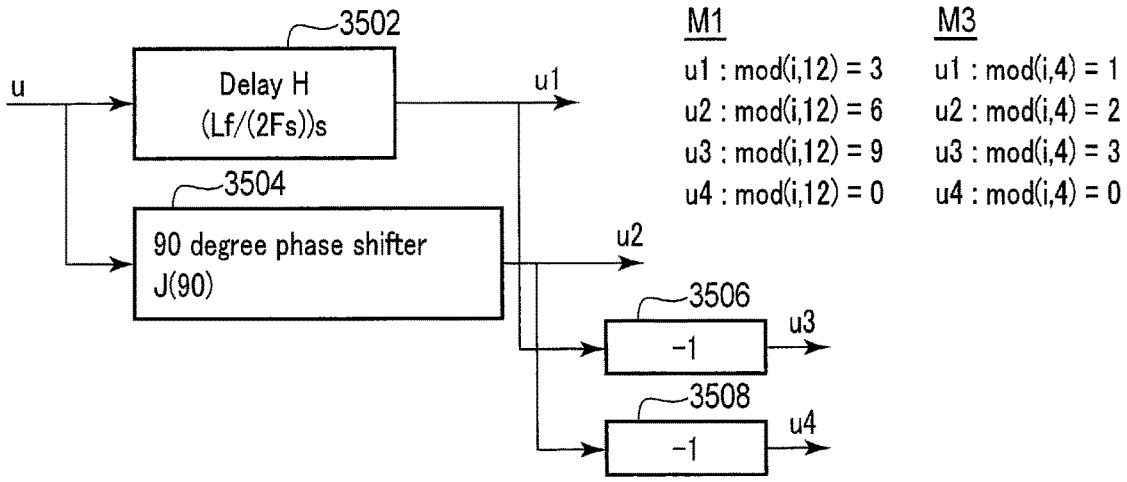
FIG. 35A is a block diagram illustrating a drive circuit that may be used for the excitation actuator arrangement illustrated in FIG. 34.
Figure 35B:
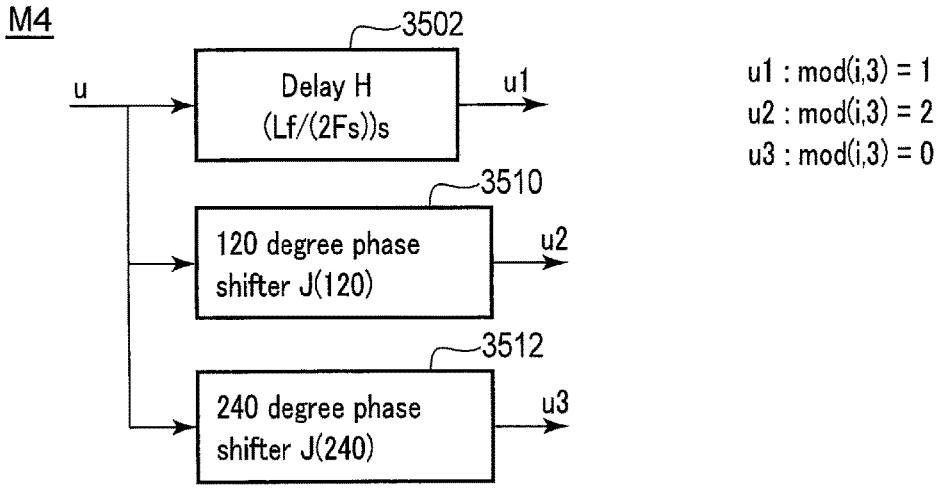
FIG. 35B is a block diagram illustrating a drive circuit that may be used for the excitation actuator arrangement illustrated in FIG. 34.

FIG. 35A schematically illustrates a circuit for exciting the first and third order Lobe modes included in the drive circuit of the first controller 152, and FIG. 35B schematically illustrates a circuit for exciting the fourth order Lobe mode included in the drive circuit of the first controller 152. As illustrated in FIGS. 35A and 35B, the drive circuit includes a delay unit 3502, a 90 degree phase shifter 3504, inverting circuits 3506 and 3508, a 120 degree phase shifter 3510, and a 240 degree phase shifter 3512.

In FIG. 35A, the phase difference between the drive signals u1 and u2 is 90 degrees, the phase difference between the drive signals u1 and u3 is 180 degrees, and the phase difference between the drive signals u1 and u4 is 270 degrees.

When the first order Lobe mode is excited, the drive signal u1 is sent to the excitation actuator 104-3, the drive signal u2 is sent to the excitation actuator 104-6, the drive signal u3 is sent to the excitation actuator 104-9, and the drive signal u4 is sent to the excitation actuator 104-12. The first order Lobe mode is excited using four excitation actuators 104 arranged at intervals of 90 degrees and the 90 degree phase shifter 3504.

When the third order Lobe mode is excited, the drive signal u1 is sent to the excitation actuators 104-1, 104-5, and 104-9, the drive signal u2 is sent to the excitation actuators 104-2, 104-6, and 104-10, the drive signal u3 is sent to the excitation actuators 104-3, 104-7, and 104-11, and the drive signal u4 is sent to the excitation actuators 104-4, 104-8, and 104-12. The third order Lobe mode is excited using 12 excitation actuators 104 arranged at intervals of 30 degrees and the 90 degree phase shifter 3504.

In FIG. 35B, the phase difference between the drive signals u1 and u2 is 120 degrees, and the phase difference between the drive signals u1 and u3 is 240 degrees. When the fourth order Lobe mode is excited, the drive signal u1 is sent to the excitation actuators 104-1, 104-4, 104-7, and 104-10, the drive signal u2 is sent to the excitation actuators 104-2, 104-5, 104-8, and 104-11, and the drive signal u3 is sent to the excitation actuators 104-3, 104-6, 104-9, and 104-12. The fourth order Lobe mode is excited using 12 excitation actuators 104 arranged at intervals of 30 degrees, the 120 degree phase shifter 3510, and the 240 degree phase shifter 3512.

Figure 36:
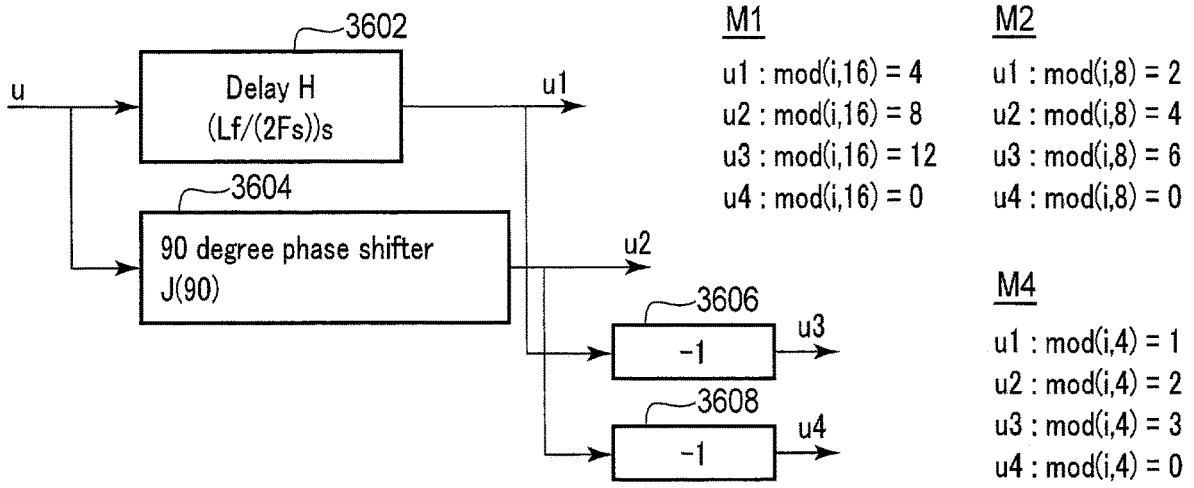
FIG. 36 is a block diagram illustrating a drive circuit that may be used for the excitation actuator arrangement illustrated in FIG. 16A.

When the 16 excitation actuators 104-1 to 104-16 are arranged on the annular plate 102 at intervals of 22.5 degrees as illustrated in FIG. 36, the sound emitting apparatus 100 can selectively excite one of three vibration modes corresponding to the first, second, and fourth order Lobe modes to the annular plate 102 by using the excitation actuators 104-1 to 104-16 and the one phase shifter.

FIG. 36 schematically illustrates a circuit for exciting the first, second, and fourth order Lobe modes included in the drive circuit of the first controller 152. The drive circuit illustrated in FIG. 36 includes a delay unit 3602, a 90 degree phase shifter 3604, and inverting circuits 3606 and 3608. In FIG. 36, the phase difference between the drive signals u1 and u2 is 90 degrees, the phase difference between the drive signals u1 and u3 is 180 degrees, and the phase difference between the drive signals u1 and u4 is 270 degrees.

When the first order Lobe mode is excited, the drive signal u1 is sent to the excitation actuator 104-4, the drive signal u2 is sent to the excitation actuator 104-8, the drive signal u3 is sent to the excitation actuator 104-12, and the drive signal u4 is sent to the excitation actuator 104-16. The first order Lobe mode is excited using four excitation actuators 104 arranged at intervals of 90 degrees and the 90 degree phase shifter 3604.

When the second order Lobe mode is excited, the drive signal u1 is sent to the excitation actuators 104-2 and 104-10, the drive signal u2 is sent to the excitation actuators 104-4 and 104-12, the drive signal u3 is sent to the excitation actuators 104-6 and 104-14, and the drive signal u4 is sent to the excitation actuators 104-8 and 104-16. The second order Lobe mode is excited using eight excitation actuators 104 arranged at intervals of 45 degrees and the 90 degree phase shifter 3604.

When the fourth order Lobe mode is excited, the drive signal u1 is sent to the excitation actuators 104-1, 104-5, 104-9, and 104-13, the drive signal u2 is sent to the excitation actuators 104-2, 104-6, 104-10, and 104-14, the drive signal u3 is sent to the excitation actuators 104-3, 104-7, 104-11, and 104-15, and the drive signal u4 is sent to the excitation actuators 104-4, 104-8, 104-12, and 104-16. The fourth order Lobe mode is excited using 16 excitation actuators 104 arranged at intervals of 22.5 degrees and the 90 degree phase shifter 3604.

Figure 37:
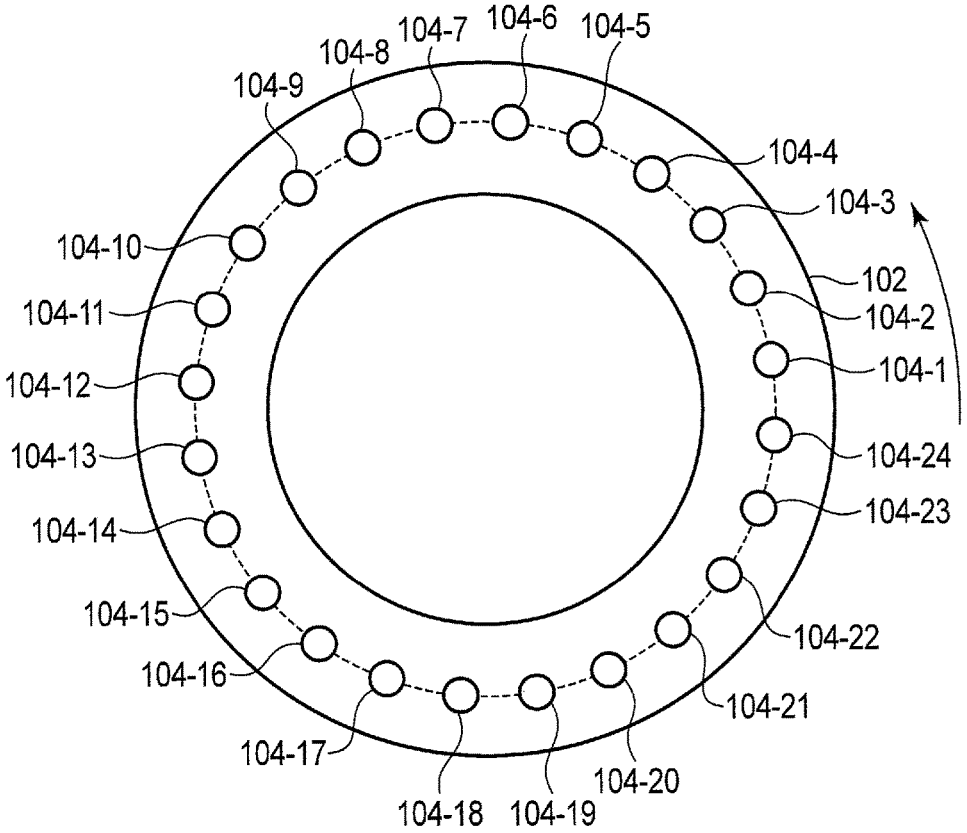
FIG. 37 is a diagram illustrating an excitation actuator arrangement according to an embodiment.

When the 24 excitation actuators 104-1 to 104-24 are arranged on the annular plate 102 at intervals of 15 degrees as illustrated in FIG. 37, the sound emitting apparatus 100 can selectively excite one of six vibration modes corresponding to the first to fourth, sixth, and eighth order Lobe modes to the annular plate 102 by using the excitation actuators 104-1 to 104-24 and the three phase shifters.

Figure 38A:
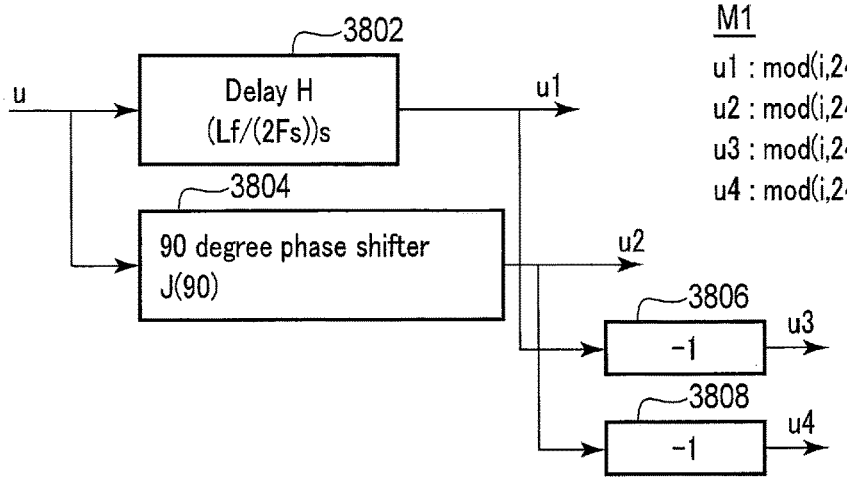
FIG. 38A is a block diagram illustrating a drive circuit that may be used for the excitation actuator arrangement illustrated in FIG. 37.
Figure 38B:
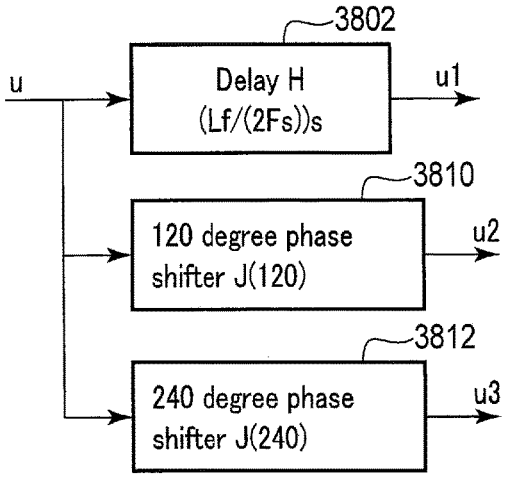
FIG. 38B is a block diagram illustrating a drive circuit that may be used for the excitation actuator arrangement illustrated in FIG. 37.

FIG. 38A schematically illustrates a circuit for exciting the first, second, third, and sixth order Lobe modes included in the drive circuit of the first controller 152, and FIG. 38B schematically illustrates a circuit for exciting the fourth and sixth order Lobe modes included in the drive circuit of the first controller 152. As illustrated in FIGS. 38A and 38B, the drive circuit includes a delay unit 3802, a 90 degree phase shifter 3804, inverting circuits 3806 and 3808, a 120 degree phase shifter 3810, and a 240 degree phase shifter 3812.

In FIG. 38A, the phase difference between the drive signals u1 and u2 is 90 degrees, the phase difference between the drive signals u1 and u3 is 180 degrees, and the phase difference between the drive signals u1 and u4 is 270 degrees. In FIG. 38B, the phase difference between the drive signals u1 and u2 is 120 degrees, and the phase difference between the drive signals u1 and u3 is 240 degrees.

Since the method of exciting the first to fourth order Lobe modes is similar to that described above, the description thereof will be omitted.

When the sixth order Lobe mode is excited, as illustrated in FIG. 38A, the drive signal u1 is sent to the excitation actuators 104-1, 104-5, 104-9, 104-13, 104-17, and 104-21, the drive signal u2 is sent to the excitation actuators 104-2, 104-6, 104-10, 104-14, 104-18, and 104-22, the drive signal u3 is sent to the excitation actuators 104-3, 104-7, 104-11, 104-15, 104-19, and 104-23, and the drive signal u4 is sent to the excitation actuators 104-4, 104-8, 104-12, 104-16, 104-20, and 104-24. The sixth order Lobe mode is excited using 24 excitation actuators 104 arranged at intervals of 15 degrees and the 90 degree phase shifter 3804.

When the eighth order Lobe mode is excited, as illustrated in FIG. 38B, the drive signal u1 is sent to the excitation actuators 104-1, 104-4, 104-7, 104-10, 104-13, 104-16, 104-19, and 104-22, the drive signal u2 is sent to the excitation actuators 104-2, 104-5, 104-8, 104-11, 104-14, 104-17, 104-20, and 104-23, and the drive signal u3 is sent to the excitation actuators 104-3, 104-6, 104-9, 104-12, 104-15, 104-18, 104-21, and 104-24. The eighth order Lobe mode is excited using 24 excitation actuators 104 arranged at intervals of 15 degrees, the 120 degree phase shifter 3810, and the 240 degree phase shifter 3812.

Figure 39:
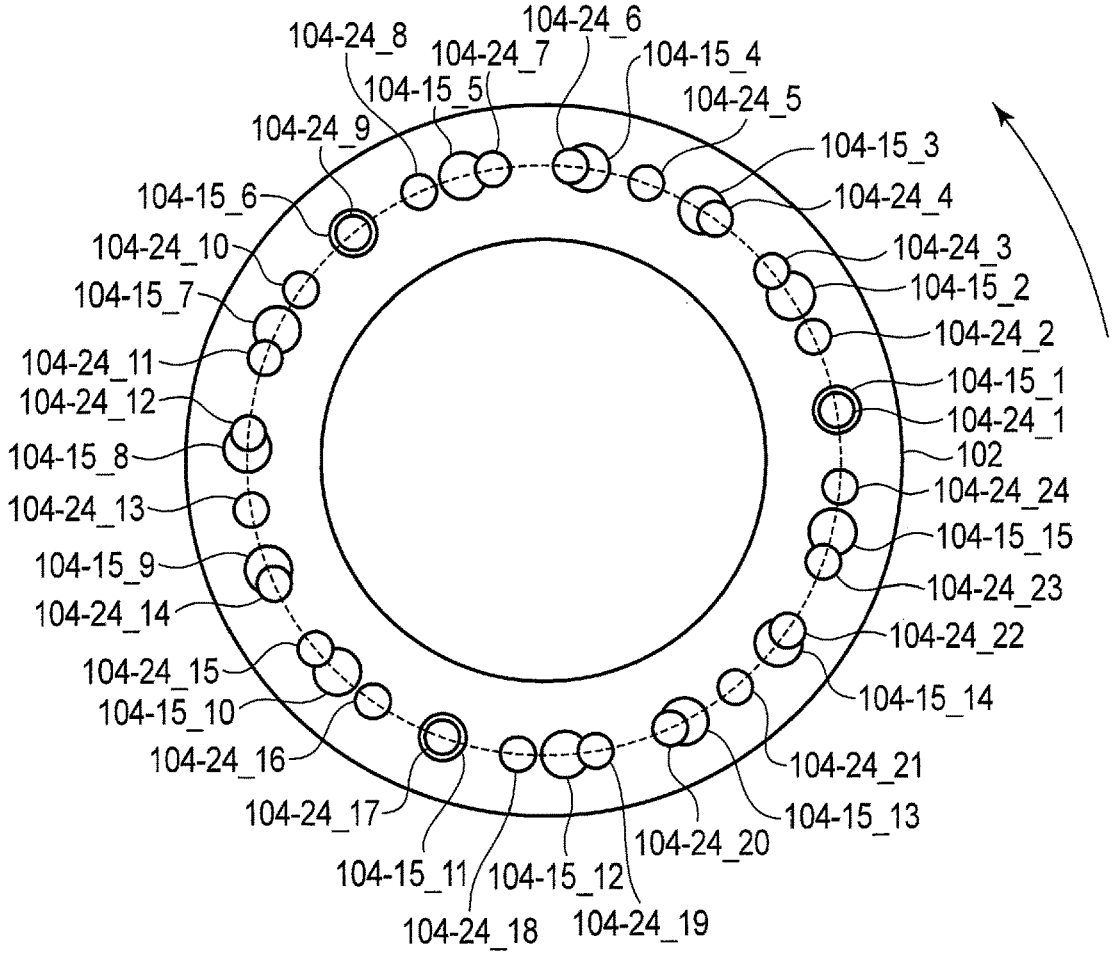
FIG. 39 is a diagram illustrating an excitation actuator arrangement according to an embodiment.

When 36 excitation actuators 104 are arranged on the annular plate 102 as illustrated in FIG. 39, the sound emitting apparatus 100 can selectively excite one of seven vibration modes corresponding to the first to sixth and eighth order Lobe modes to the annular plate 102 by using the excitation actuators 104, the 90 degree phase shifter, the 120 degree phase shifter, and the 240 degree phase shifter. In FIG. 39, excitation actuators 104-15_1 to 104-15_15 are arranged at intervals of 24 degrees, and excitation actuators 104-24_1 to 104-24_24 are arranged at intervals of 15 degrees. The excitation actuators 104-15_1 and 104-24_1 are one excitation actuator, the excitation actuators 104-15_6 and 104-24_9 are one excitation actuator, and the excitation actuators 104-15_11 and 104-24_17 are one excitation actuator.

The sound emitting apparatus 100 can selectively excite one of six vibration modes corresponding to the first to fourth, sixth, and eighth order Lobe modes to the annular plate by using the excitation actuators 104-24_1 to 104-24_24, the 90 degree phase shifter, the 120 degree phase shifter, and the 240 degree phase shifter. The method of exciting the six vibration modes corresponding to the first to fourth, sixth, and eighth order Lobe modes is similar to that described above with reference to FIGS. 37, 38A, and 38B, and thus description thereof is omitted. Further, the sound emitting apparatus 100 can excite the fifth order Lobe mode to the annular plate 102 using the excitation actuators 104-15_1 to 104-15_15, the 120 degree phase shifter, and the 240 degree phase shifter.

Figure 40:
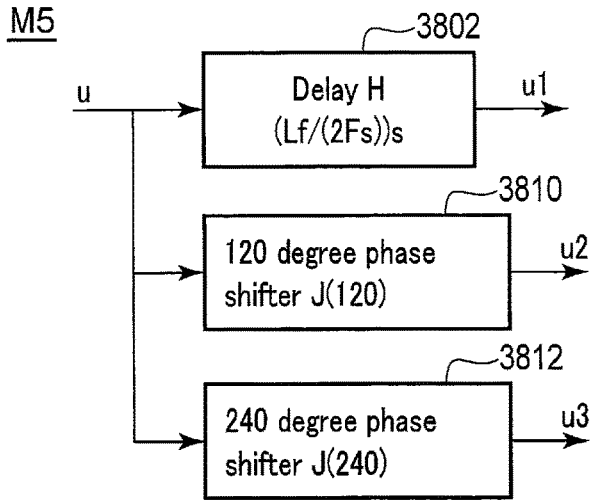
FIG. 40 is a block diagram illustrating a drive circuit that may be used for the excitation actuator arrangement illustrated in FIG. 39.

FIG. 40 schematically illustrates a circuit for exciting the fifth order Lobe mode included in the drive circuit of the first controller 152. As illustrated in FIG. 40, the delay unit 3802, the 120 degree phase shifter 3810, and the 240 degree phase shifter 3812 are provided. That is, the fifth order Lobe mode is excited using a circuit for exciting the fourth order Lobe mode or the sixth order Lobe mode. The drive signal u1 is sent to the excitation actuators 104-15_1, 104-15_4, 104-15_7, 104-15_10, and 104-15_13, the drive signal u2 is sent to the excitation actuators 104-15_2, 104-15_5, 104-15_8, 104-15_11, and 104-15_14, and the drive signal u3 is sent to the excitation actuators 104-15_3, 104-15_6, 104-15_9, 104-15_12, and 104-15_15. The fifth order Lobe mode is excited using 15 excitation actuators 104 arranged at intervals of 24 degrees, the 120 degree phase shifter 3810, and the 240 degree phase shifter 3812.

In the arrangement illustrated in FIG. 39, the interval between the excitation actuators is 3 degrees at minimum. For example, the interval between the excitation actuators 104-15_3 and 104-24_4 is 3 degrees. When the excitation actuators cannot be arranged at intervals of 3 degrees, a group of the excitation actuators 104-15_1 to 104-15_15 and a group of the excitation actuators 104-24_1 to 104-24_24 may be arranged on two concentric circles. In this case, 39 excitation actuators 104 are provided on the annular plate 102.

Note that the 0-th order Lobe mode is excited by sending the same drive signal to all the excitation actuators in each of the above-described arrangements.

[Lobe Mode Separation Sound Collection]

Although the procedure for switching the vibration mode has been described so far, it is possible to separate the Lobe mode by the reverse procedure and collect a sound.

Figure 41:
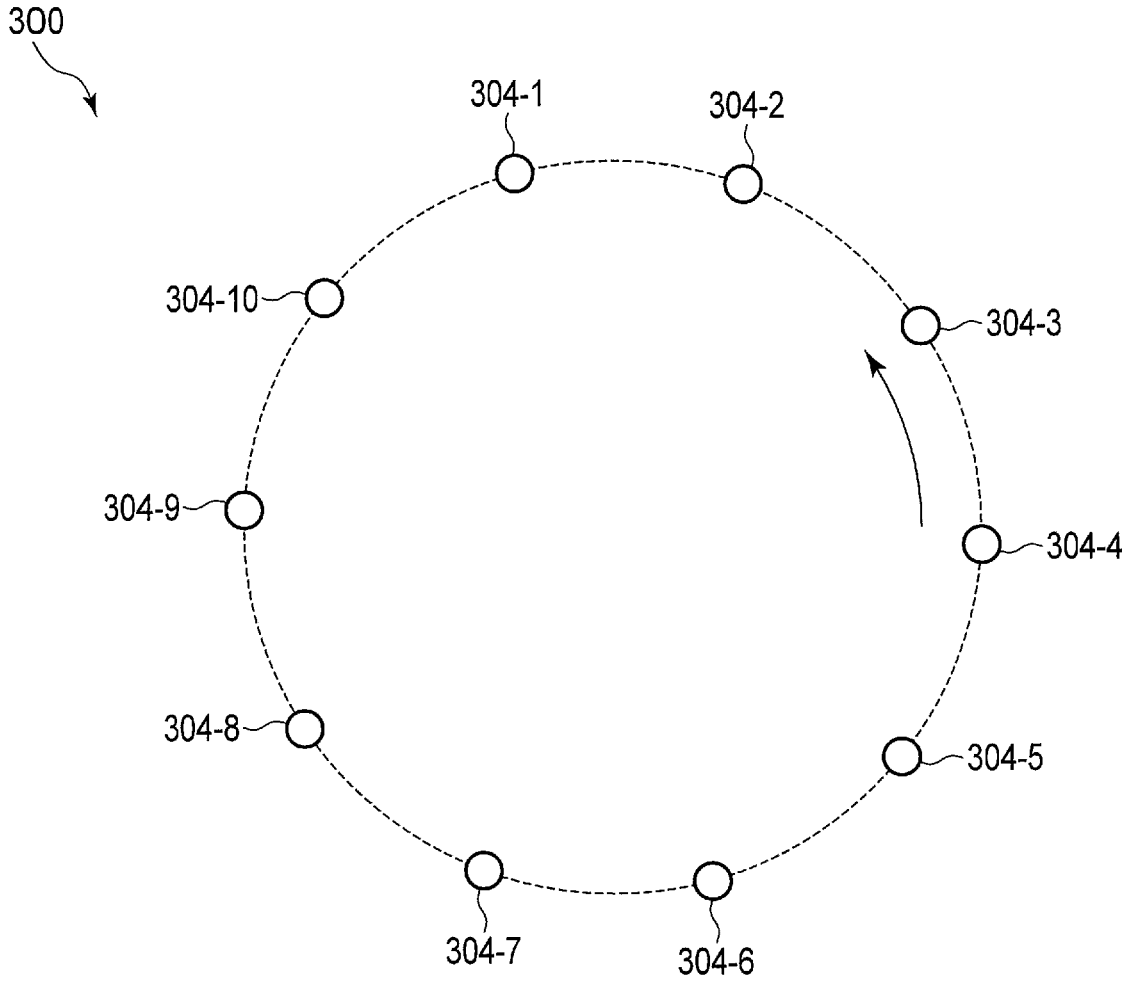
FIG. 41 is a diagram illustrating a structural example of a sound collection device according to an embodiment.

FIG. 41 schematically illustrates a structural example of a sound collection device 300 according to the embodiment. In the example illustrated in FIG. 41, the sound collection device 300 includes Nb microphones 304 (for example, ten microphones 301-1 to 304-10) each configured to convert a sound into an electric signal. The microphones 304-1 to 304-10 are arranged at equal angular intervals in the circumferential direction. The branch numbers are sequentially assigned along the direction opposite to the rotation direction of the Lobe mode indicated by the arrow.

Figure 42A:
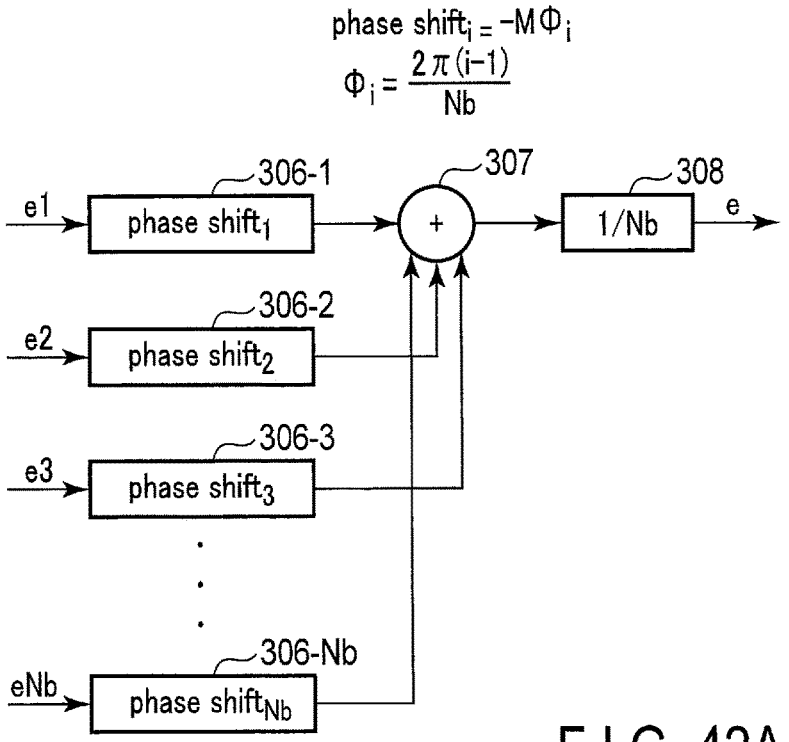
FIG. 42A is a block diagram illustrating an example of a processing circuit included in the sound collection device illustrated in FIG. 41.

FIG. 42A schematically illustrates an example of a processing circuit of the sound collection device 300. In the example illustrated in FIG. 42A, the processing circuit is configured to extract a signal related to the M-th order Lobe mode, and includes Nb phase shifters 306-1 to 306-Nb, an adder 307, and an amplifier 308 having a gain of 1/Nb. Here, Nb represents the number of microphones 304. In FIG. 42A, a signal ei indicates an output signal of the microphone 304-*i*. The phase shifter 306-*i* applies the phase shift of $-M\phi_i$ to the signal ei, where $\phi_i=2\pi(i-1)/N$. The output signals of the phase shifters 306-1 to 306-Nb are added by the adder 307, and the output signal of the adder 307 is amplified (specifically, reduced to 1/Nb) by the amplifier 308. An output signal e of the amplifier 308 is a signal related to the M-th order Lobe mode.

Figure 42B:
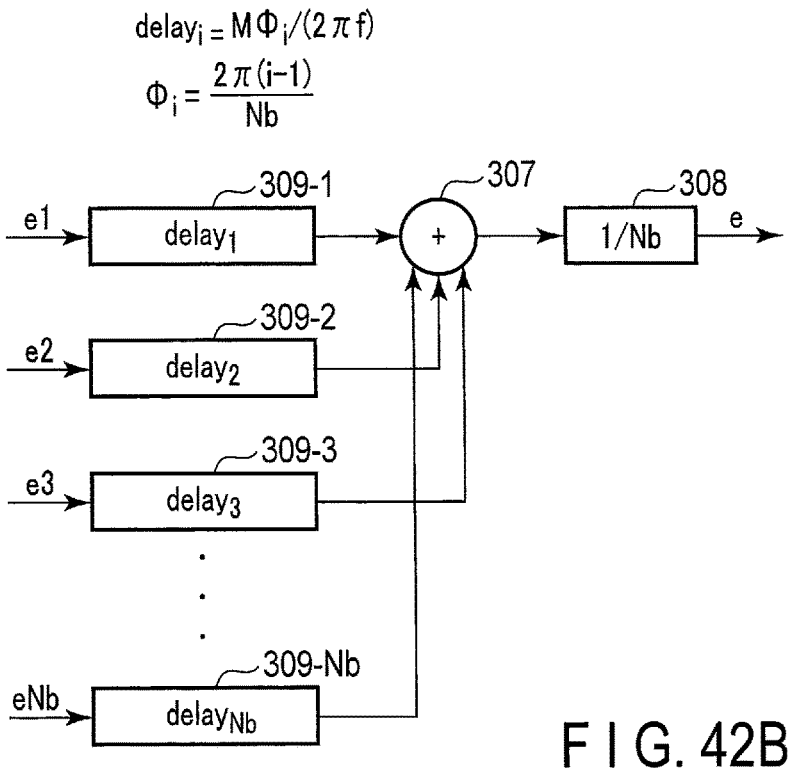
FIG. 42B is a block diagram illustrating another example of a processing circuit included in the sound collection device illustrated in FIG. 41.

FIG. 42B schematically illustrates another example of a processing circuit of the sound collection device 300. In the example illustrated in FIG. 42B, the processing circuit is configured to extract a signal related to the M-th order Lobe mode, and includes Nb delay units 309-1 to 309-Nb, the adder 307, and the amplifier 308 having a gain of 1/Nb. The delay unit 309-*i* delays the signal ei by time of $M\phi_i/2\pi f$, where $\phi_i=2\pi(i-1)/N$. The output signals of the delay units 309-1 to 309-Nb are added by the adder 307, and the output signal of the adder 307 is amplified (specifically, reduced to 1/Nb) by the amplifier 308. An output signal e of the amplifier 308 is a signal related to the M-th order Lobe mode.

By preparing a plurality of circuits illustrated in FIG. 42A, a plurality of Lobe modes can be separated. However, a large number of phase shifters are required. A method of separating a plurality of Lobe modes with a smaller number of phase shifters will be described below.

Figure 43:
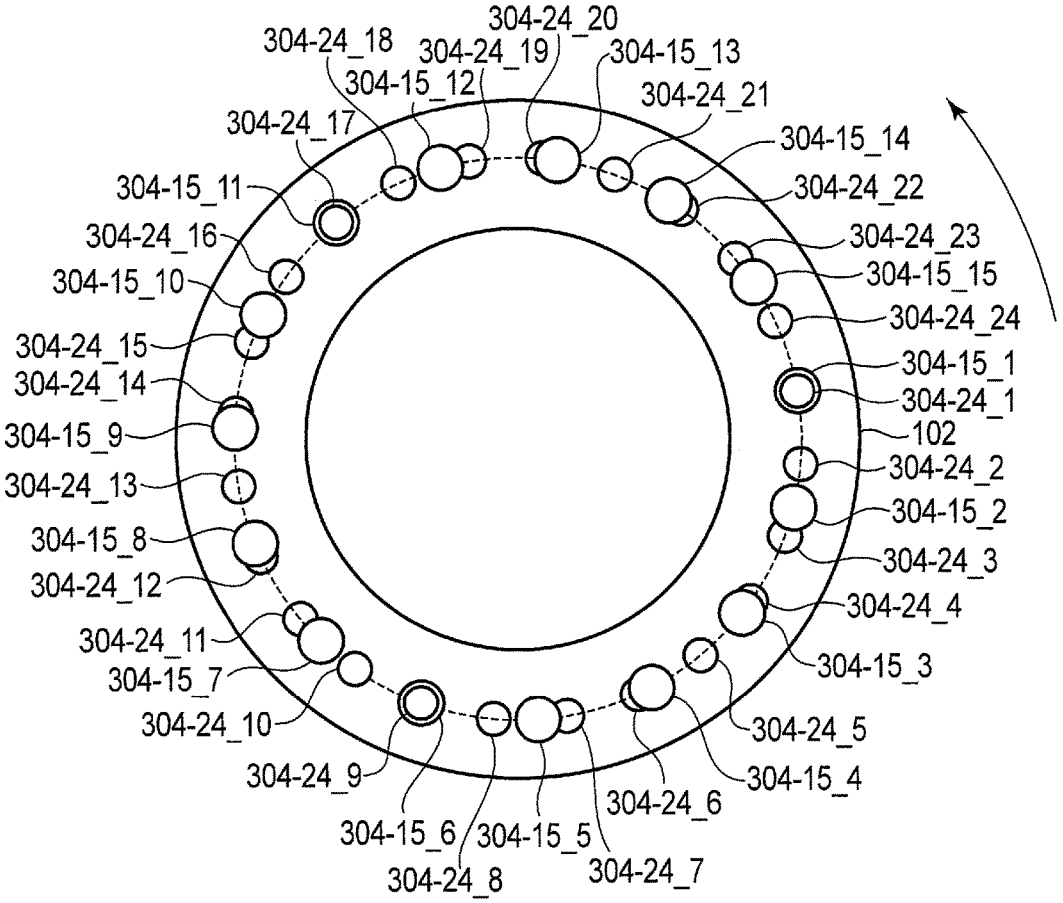
FIG. 43 is a diagram illustrating another structural example of a sound collection device according to an embodiment.

FIG. 43 schematically illustrates another structural example of the sound collection device 300 according to the embodiment. In the example illustrated in FIG. 43, the sound collection device 300 includes 36 microphones 304 arranged in the circumferential direction. In FIG. 43, microphones 304-15_1 to 304-15_15 are arranged at intervals of 24 degrees, and microphones 304-24_1 to 304-24_24 are arranged at intervals of 15 degrees. The microphones 304-15_1 and 304-24_1 are one microphone, the microphones 304-15_6 and 304-24_9 are one microphone, and the microphones 304-15_11 and 304-24_17 are one microphone.

Figure 44A:
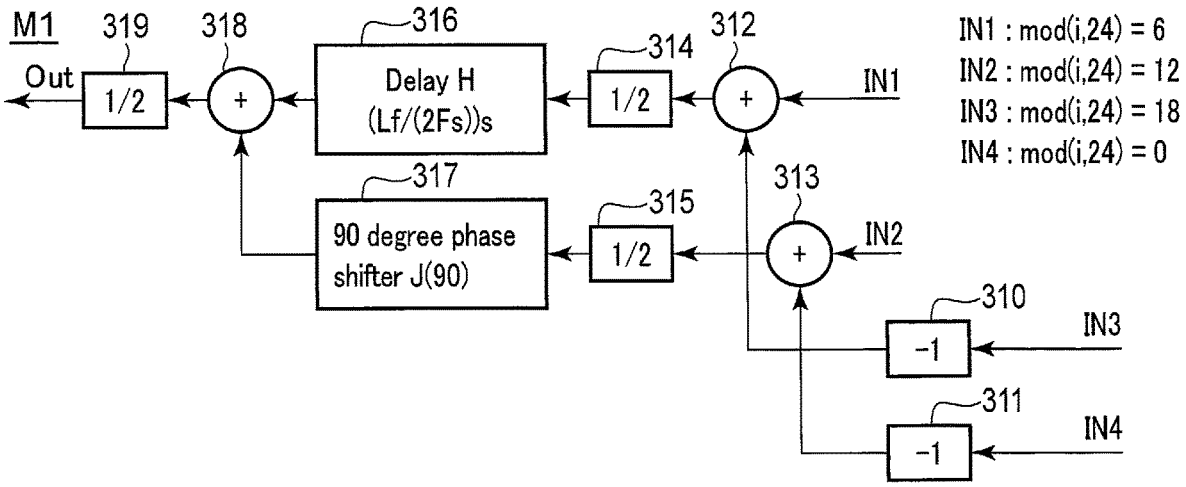
FIG. 44A is a block diagram illustrating an example of a processing circuit included in the sound collection device illustrated in FIG. 43.

FIG. 44A schematically illustrates a circuit for extracting a signal related to the first order Lobe mode included in the processing circuit of the sound collection device 300 illustrated in FIG. 43. As illustrated in FIG. 44A, the processing circuit includes inverting circuits 310 and 311, adders 312, 313, and 318, amplifiers 314, 315, and 319 having a gain of 1/2, a delay unit 316, and a 90 degree phase shifter 317. A signal IN1 is a signal output from the microphone 304-24_6. A signal IN2 is a signal output from the microphone 304-24_12. A signal IN3 is a signal output from the microphone 304-24_18. A signal IN4 is a signal output from the microphone 304-24_24.

An input port of the inverting circuit 310 is connected to the microphone 304-24_18. A first input port of the adder 312 is connected to the microphone 304-24_6, and a second input port of the adder 312 is connected to an output port of the inverting circuit 310. An output port of the adder 312 is connected to an input port of the amplifier 314. An output port of the amplifier 314 is connected to an input port of the delay unit 316. An output port of the delay unit 316 is connected to a first input port of the adder 318. An input port of the inverting circuit 311 is connected to the microphone 304-24_24. A first input port of the adder 313 is connected to the microphone 304-24_12, and a second input port of the adder 313 is connected to an output port of the inverting circuit 311. An output port of the adder 313 is connected to an input port of the amplifier 315. An output port of the amplifier 315 is connected to an input port of the 90-degree phase shifter 317. An output port of the 90-degree phase shifter 317 is connected to a second input port of the adder 318. An output port of the adder 318 is connected to an input port of the amplifier 319. A signal output from the output port of the amplifier 319 is a signal related to the first order Lobe mode.

Figure 44B:
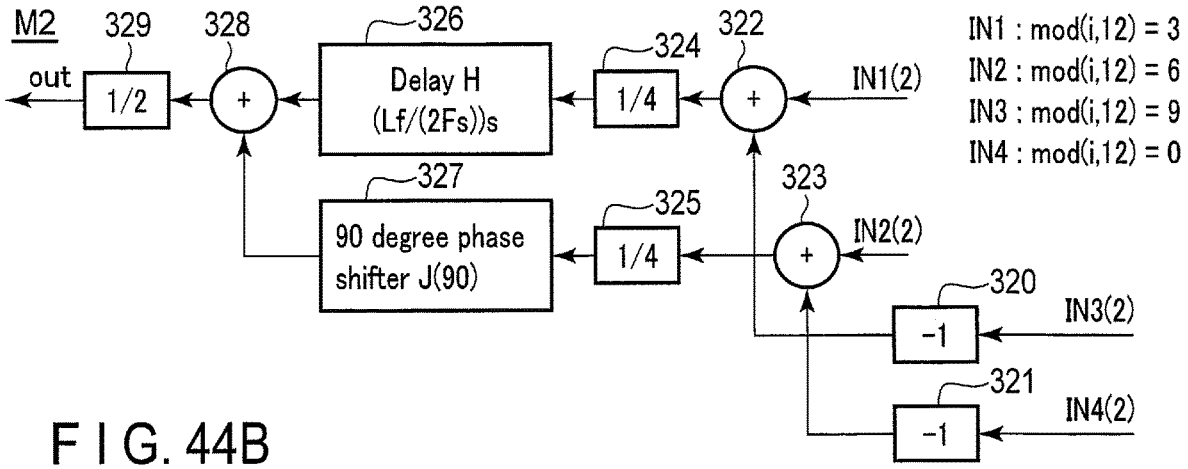
FIG. 44B is a block diagram illustrating an example of a processing circuit included in the sound collection device illustrated in FIG. 43.

FIG. 44B schematically illustrates a circuit for extracting a signal related to the second order Lobe mode included in the processing circuit of the sound collection device 300 illustrated in FIG. 43. As illustrated in FIG. 44B, the processing circuit further includes inverting circuits 320 and 321, adders 322, 323, and 328, amplifiers 324 and 325 having a gain of 1/4, a delay unit 326, a 90 degree phase shifter 327, and an amplifier 329 having a gain of 1/2. A signal IN1(2) is obtained by adding the signals output from the microphones 304-24_3 and 304-24_15. A signal IN2(2) is obtained by adding the signals output from the microphones 304-24_6 and 304-24_18. A signal IN3(2) is obtained by adding the signals output from the microphones 304-24_9 and 304-24_21. A signal IN4(2) is obtained by adding the signals output from the microphones 304-24_12 and 304-24_24.

Since the circuit configuration illustrated in FIG. 44B is similar to the circuit configuration illustrated in FIG. 44A, the description of the connection relationship of the components illustrated in FIG. 44B will be omitted. The adder 322 receives the signal IN1(2) at the first input port and receives the signal IN3(2) inverted by the inverting circuit 320 at the second input port. The adder 323 receives the signal IN2(2) at the first input port and receives the signal IN4(2) inverted by the inverting circuit 321 at the second input port. A signal output from the output port of the amplifier 329 is a signal related to the second order Lobe mode.

Figure 44C:
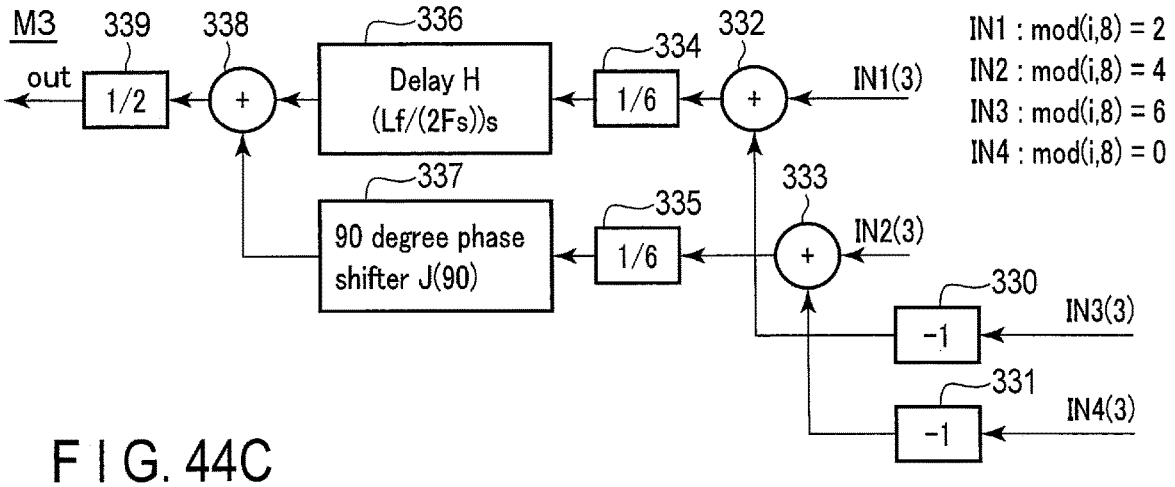
FIG. 44C is a block diagram illustrating an example of a processing circuit included in the sound collection device illustrated in FIG. 43.

FIG. 44C schematically illustrates a circuit for extracting a signal related to the third order Lobe mode included in the processing circuit of the sound collection device 300 illustrated in FIG. 43. As illustrated in FIG. 44C, the processing circuit further includes inverting circuits 330 and 331, adders 332, 333, and 338, amplifiers 334 and 335 having a gain of 1/6, a delay unit 336, a 90 degree phase shifter 337, and an amplifier 339 having a gain of 1/2. A signal IN1(3) is obtained by adding the signals output from the microphones 304-24_2, 304-24_10, and 304-24_18. A signal IN2(3) is obtained by adding the signals output from the microphones 304-24_4, 304-24_12, and 304-24_20. A signal IN3(3) is obtained by adding the signals output from the microphones 304-24_6, 304-24_14, and 304-24_22. A signal IN4(3) is obtained by adding the signals output from the microphones 304-24_8, 304-24_16, and 304-24_24.

Since the circuit configuration illustrated in FIG. 44C is similar to the circuit configuration illustrated in FIG. 44A, the description of the connection relationship of the components illustrated in FIG. 44C will be omitted. The adder 332 receives the signal IN1(3) at the first input port and receives the signal IN3(3) inverted by the inverting circuit 330 at the second input port. The adder 333 receives the signal IN2(3) at the first input port and receives the signal IN4(3) inverted by the inverting circuit 331 at the second input port. A signal output from the output port of the amplifier 339 is a signal related to the third order Lobe mode.

Figure 44D:
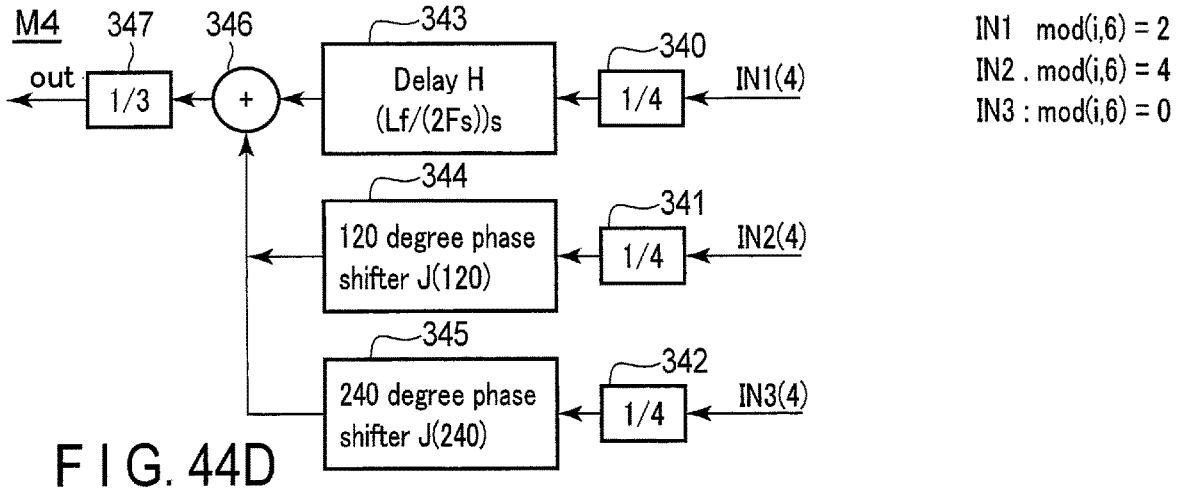
FIG. 44D is a block diagram illustrating an example of a processing circuit included in the sound collection device illustrated in FIG. 43.

FIG. 44D schematically illustrates a circuit for extracting a signal related to the fourth order Lobe mode included in the processing circuit of the sound collection device 300 illustrated in FIG. 43. As illustrated in FIG. 44D, the processing circuit further includes amplifiers 340, 341, and 342 having a gain of 1/4, a delay unit 343, a 120-degree phase shifter 344, a 240 degree phase shifter 345, an adder 346, and an amplifier 347 having a gain of 1/3. A signal IN1(4) is obtained by adding the signals output from the microphones 304-24_2, 304-24_8, 304-24_14, and 304-24_20. A signal IN2(4) is obtained by adding the signals output from the microphones 304-24_4, 304-24_10, 304-24_16, and 304-24_22. A signal IN3(4) is obtained by adding the signals output from the microphones 304-24_6, 304-24_12, 304-24_18, and 304-24_24.

The input port of the amplifier 340 receives the signal IN1(4). An output port of the amplifier 340 is connected to an input port of the delay unit 343. An output port of the delay unit 343 is connected to a first input port of the adder 346. The input port of the amplifier 341 receives the signal IN2(4). An output port of the amplifier 341 is connected to an input port of the 120-degree phase shifter 344. An output port of the 120-degree phase shifter 344 is connected to a second input port of the adder 346. The input port of the amplifier 342 receives the signal IN3(4). An output port of the amplifier 342 is connected to an input port of the 240-degree phase shifter 345. An output port of the 240-degree phase shifter 345 is connected to a third input port of the adder 346. An output port of the adder 346 is connected to an input port of the amplifier 347. A signal output from the output port of the amplifier 347 is a signal related to the fourth order Lobe mode.

Figure 44E:
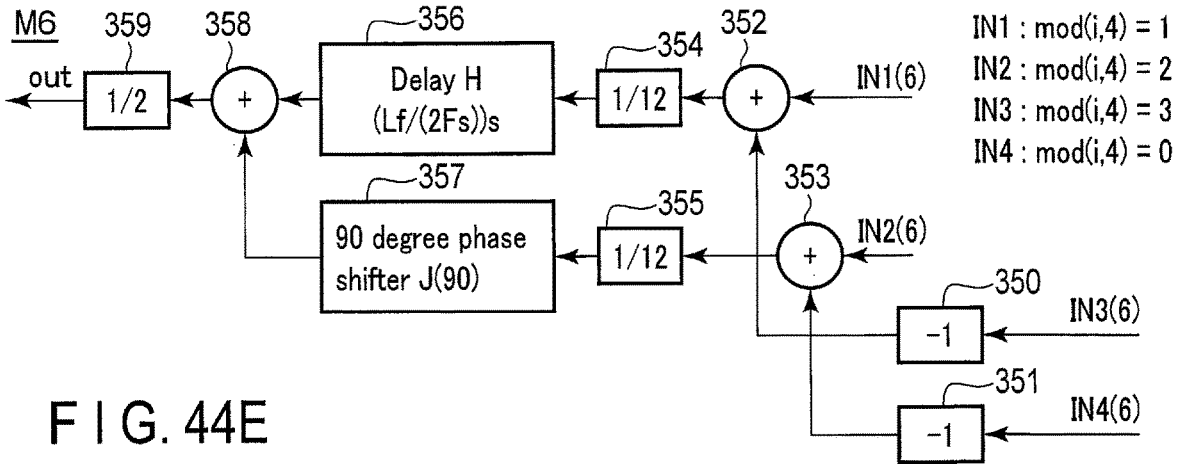
FIG. 44E is a block diagram illustrating an example of a processing circuit included in the sound collection device illustrated in FIG. 43.

FIG. 44E schematically illustrates a circuit for extracting a signal related to the sixth order Lobe mode included in the processing circuit of the sound collection device 300 illustrated in FIG. 43. As illustrated in FIG. 44E, the processing circuit further includes inverting circuits 350 and 351, adders 352, 353, and 358, amplifiers 354 and 355 having a gain of 1/12, a delay unit 356, a 90-degree phase shifter 357, and an amplifier 359 having a gain of 1/2. A signal IN1(6) is obtained by adding the signals output from the microphones 304-24_1, 304-24_5, 304-24_9, 304-24_13, 304-24_17, and 304-24_21. A signal IN2(6) is obtained by adding the signals output from the microphones 304-24_2, 304-24_6, 304-24_10, 304-24_14, 304-24_18, and 304-24_22. A signal IN3(6) is obtained by adding the signals output from the microphones 304-24_3, 304-24_7, 304-24_11, 304-24_15, 304-24_19, and 304-24_23. A signal IN4(6) is obtained by adding the signals output from the microphones 304-24_4, 304-24_8, 304-24_12, 304-24_16, 304-24_20, and 304-24_24.

Since the circuit configuration illustrated in FIG. 44E is similar to the circuit configuration illustrated in FIG. 44A, the description of the connection relationship of the components illustrated in FIG. 44E will be omitted. The adder 352 receives the signal IN1(6) at the first input port and receives the signal IN3(6) inverted by the inverting circuit 350 at the second input port. The adder 353 receives the signal IN2(6) at the first input port and receives the signal IN4(6) inverted by the inverting circuit 351 at the second input port. A signal output from the output port of the amplifier 359 is a signal related to the sixth order Lobe mode.

Figure 44F:
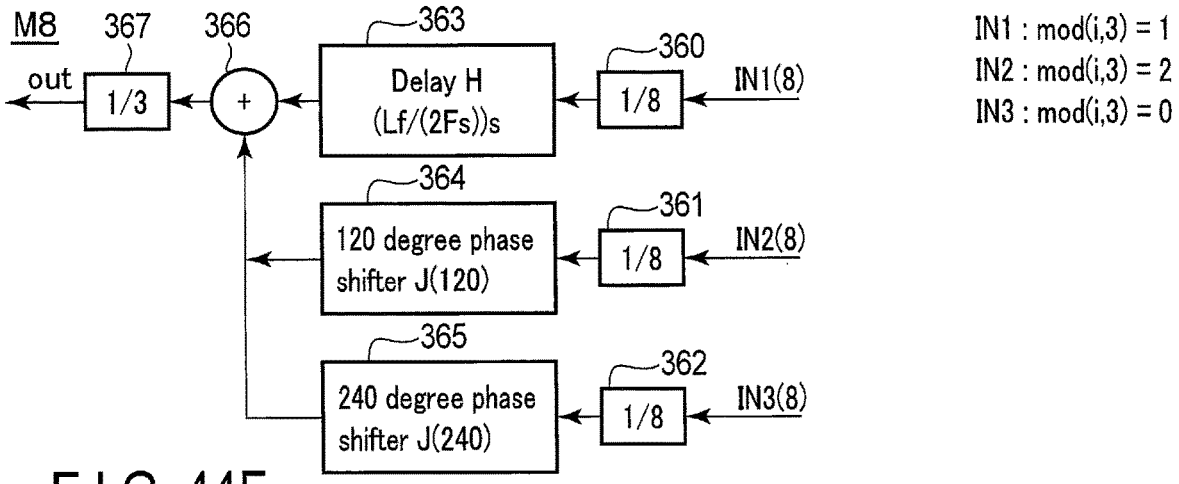
FIG. 44F is a block diagram illustrating an example of a processing circuit included in the sound collection device illustrated in FIG. 43.

FIG. 44F schematically illustrates a circuit for extracting a signal related to the eighth order Lobe mode included in the processing circuit of the sound collection device 300 illustrated in FIG. 43. As illustrated in FIG. 44F, the processing circuit further includes amplifiers 360, 361, and 362 having a gain of 1/8, a delay unit 363, a 120 degree phase shifter 364, a 240 degree phase shifter 365, an adder 366, and an amplifier 367 having a gain of 1/3. A signal IN1(8) is obtained by adding the signals output from the microphones 304-24_1, 304-24_4, 304-24_7, 304-24_10, 304-24_13, 304-24_16, 304-24_19, and 304-24_22. A signal IN2(8) is obtained by adding the signals output from the microphones 304-24_2, 304-24_5, 304-24_8, 304-24_11, 304-24_14, 304-24_17, 304-24_20, and 304-24_23. A signal IN3(8) is obtained by adding the signals output from the microphones 304-24_3, 304-24_6, 304-24_9, 304-24_12, 304-24_15, 304-24_18, 304-24_21, and 304-24_24.

Since the circuit configuration illustrated in FIG. 44F is similar to the circuit configuration illustrated in FIG. 44D, the description of the connection relationship of the components illustrated in FIG. 44F will be omitted. The input port of the amplifier 360 receives the signal IN1(8). The input port of the amplifier 361 receives the signal IN2(8). The input port of the amplifier 362 receives the signal IN3(8). A signal output from the output port of the amplifier 367 is a signal related to the sixth order Lobe mode.

Figure 44G:
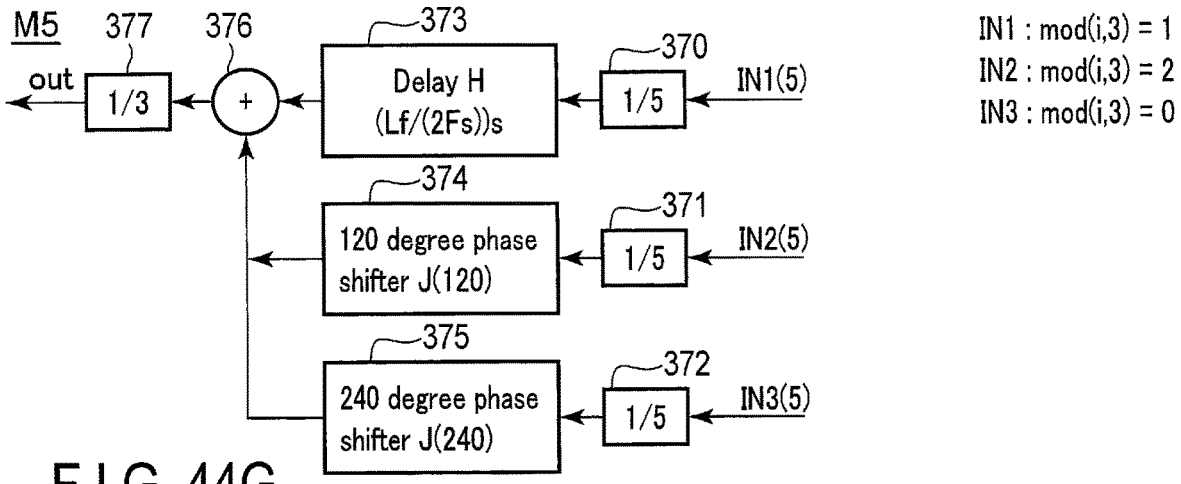
FIG. 44G is a block diagram illustrating an example of a processing circuit included in the sound collection device illustrated in FIG. 43.

FIG. 44G schematically illustrates a circuit for extracting a signal related to the fifth order Lobe mode included in the processing circuit of the sound collection device 300 illustrated in FIG. 43. As illustrated in FIG. 44G, the processing circuit further includes amplifiers 370, 371, and 372 having a gain of 1/5, a delay unit 373, a 120-degree phase shifter 374, a 240-degree phase shifter 375, an adder 376, and an amplifier 377 having a gain of 1/3. A signal IN1(5) is obtained by adding the signals output from the microphones 304-15_1, 304-15_4, 304-15_7, 304-15_10, and 304-15_13. A signal IN2(5) is obtained by adding the signals output from the microphones 304-15_2, 304-15_5, 304-15_8, 304-15_11, and 304-15_14. A signal IN3(5) is obtained by adding the signals output from the microphones 304-15_3, 304-15_6, 304-15_9, 304-15_12, and 304-15_15.

Since the circuit configuration illustrated in FIG. 44G is similar to the circuit configuration illustrated in FIG. 44D, the description of the connection relationship of the components illustrated in FIG. 44G will be omitted. The input port of the amplifier 370 receives the signal IN1(5). The input port of the amplifier 371 receives the signal IN2(5). The input port of the amplifier 372 receives the signal IN3(5). A signal output from the output port of the amplifier 377 is a signal related to the fifth order Lobe mode.

The sound collection device 300 can separate signals corresponding to the first to fourth, sixth, and eighth order Lobe modes from each other by using the 24 microphones and the 8 phase shifters. The sound collection device 300 can separate signals corresponding to the first to sixth and eighth order Lobe modes from each other by using the 35 microphones and the 10 phase shifters.

In addition, it is possible to separate the first, third, and fourth order Lobe modes by using the 12 microphones and the 4 phase shifters arranged at intervals of 30 degrees. It is possible to separate the first, second, and fourth order Lobe modes by using the 16 microphones and the 3 phase shifters arranged at intervals of 22.5 degrees.

Note that, in the case of obtaining a signal related to a single Lobe mode, it is sufficient if the processing circuit of the sound collection device 300 includes a circuit for extracting a signal related to the Lobe mode. For example, the sound collection device 300 includes 4M microphones 304 and the processing circuit as illustrated in FIG. 44E. The circuit illustrated in FIG. 44E is configured to obtain a signal related to the sixth order Lobe mode from the signals output from the 24 microphones 304.

The signal related to the 0-th order Lobe mode is obtained by averaging the signals output from the microphones 304.

[Application 1 (Blade Noise Reduction)]

Next, an example in which the sound emitting apparatus according to the embodiment is applied to blade noise reduction will be described.

Figure 45:
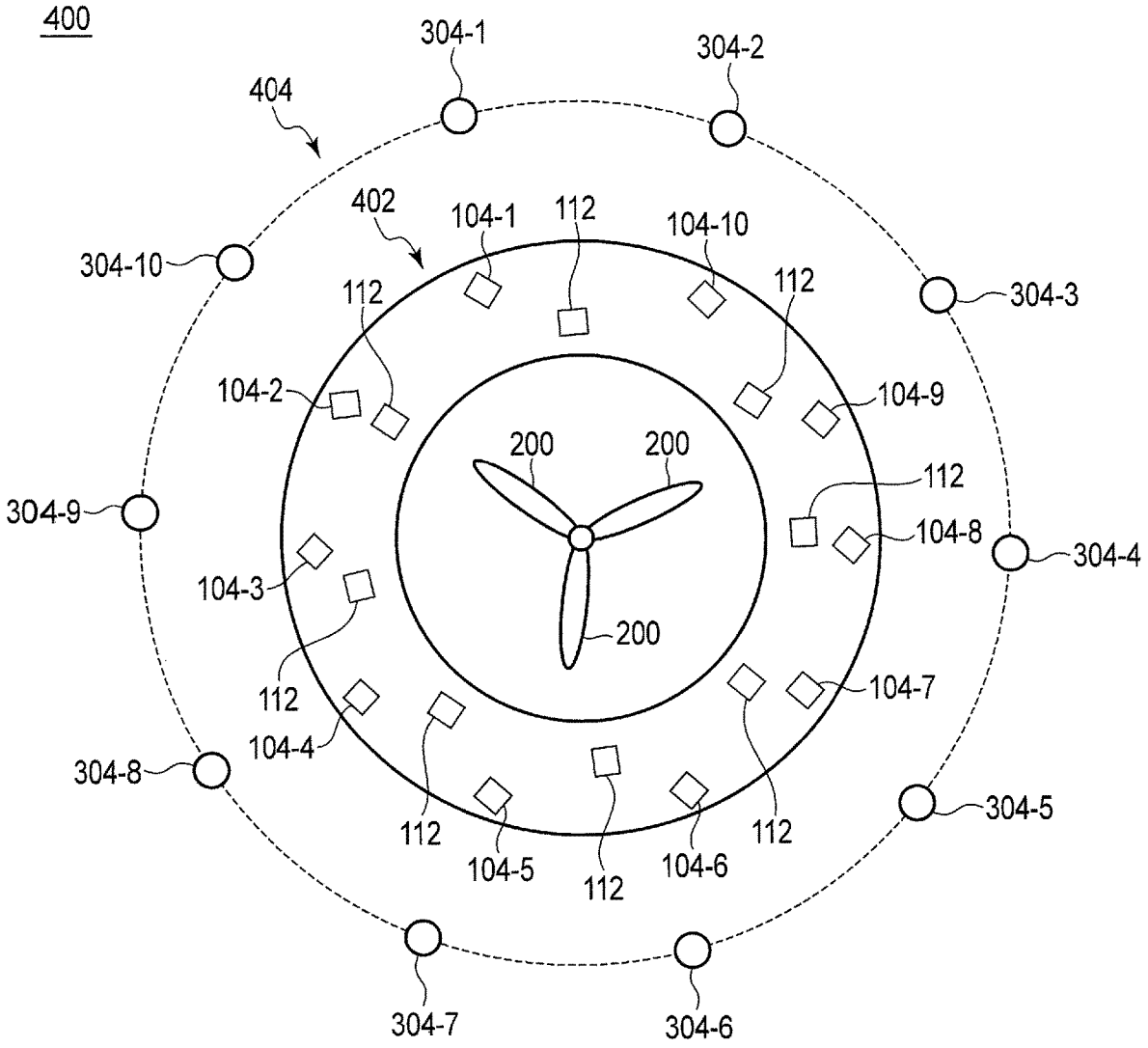
FIG. 45 is a top view illustrating a blade noise reduction apparatus according to an embodiment.

FIG. 45 schematically illustrates an external appearance of a blade noise reduction apparatus 400 according to the embodiment. As illustrated in FIG. 45, the blade noise reduction apparatus 400 includes a sound emitting apparatus 402 and a sound collection device 404. The sound emitting apparatus 402 may be the sound emitting apparatus 100 illustrated in FIG. 1. The sound emitting apparatus 402 includes the annular plate 102, the excitation actuators 104, and the pressurization actuators 112. The number and arrangement of the excitation actuators 104 may be determined based on the order of the target Lobe mode so as to reduce the number of phase shifters required for the drive circuit related to the excitation actuators 104. The sound collection device 404 may be the sound collection device 300 illustrated in FIG. 41. The sound collection device 404 includes the microphones 304. The number and arrangement of the microphones 304 may be determined based on the order of the target Lobe mode so as to reduce the number of phase shifters required for the processing circuit.

The rotational blades 200, which are a noise source, are arranged inside the sound emitting apparatus 402, and the microphones 304 are arranged outside the sound emitting apparatus 402. In a case where the noise source is only the rotational blades and the influence of environmental reflection is low, one microphone is sufficient, and in other cases, it is desirable to use 2M+1 or more microphones.

Figure 46:
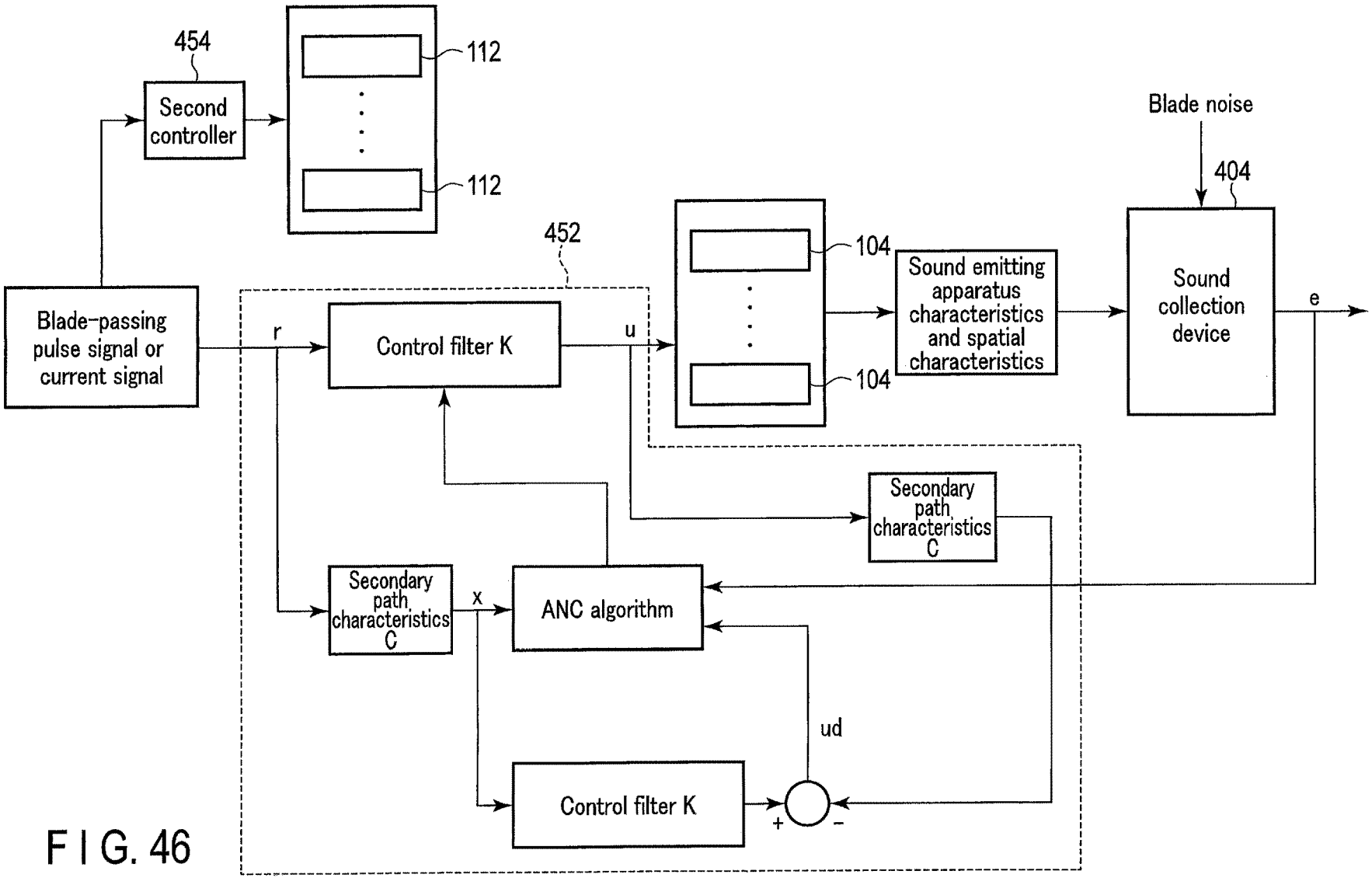
FIG. 46 is a block diagram illustrating an example of a control circuit included in the blade noise reduction apparatus illustrated in FIG. 45.

FIG. 46 schematically illustrates an example of a control circuit of the blade noise reduction apparatus 400. In the example illustrated in FIG. 46, the control circuit is based on feedforward active noise control (ANC). In the feedforward ANC, a blade-passing pulse signal or a blade drive current signal is used as a reference signal. The blade-passing pulse signal is a signal in which the timing at which each rotational blade passes through a certain point is recorded, and is, for example, a signal in which the presence or absence of the blade is output by 0/1 using an optical sensor. The blade drive current signal is a current signal for driving the rotational blades 200. For example, the blade drive current signal is a current signal applied to a motor that rotates the rotational blades 200.

As illustrated in FIG. 46, the control circuit includes a first controller 452 and a second controller 454. The first controller 452 and the second controller 454 correspond respectively to the first controller 152 and the second controller 154 of the sound emitting apparatus 100 illustrated in FIG. 11.

In FIG. 46, a signal r is a reference signal. The signal u is a drive signal for driving the excitation actuators 104 in order to emit a control sound for reducing the noise due to the target Lobe mode. A control filter K is an adaptive filter that converts the reference signal r into the drive signal u. The drive signal u is sent to the excitation actuators 104 through the drive circuit as illustrated, for example, in FIG. 12A or 12B. For example, in a case where the target Lobe mode is the fourth order Lobe mode and the 16 excitation actuators 104 are arranged on the annular plate 102 at intervals of 22.5 degrees, the drive circuit illustrated in FIG. 26 may be used. A signal e is an error signal obtained by the sound collection device 404. Specifically, the error signal e is obtained by combining the output signals of the microphones 304 with the processing circuit as illustrated in FIG. 42A or 42B.

A signal x is an auxiliary signal and is obtained by converting the reference signal r with a filter having secondary path characteristics C. The secondary path characteristics C are transmission characteristics from the drive signal u to the error signal e when no noise is generated. A signal $u_d$ is an auxiliary signal, and is obtained by subtracting a signal obtained by converting the drive signal u with a filter having the secondary path characteristics C from a signal obtained by converting the auxiliary signal x with the control filter K.

The first controller 452 generates the drive signal-u based on the error signal e and the reference signal r. As an ANC algorithm, a known ANC algorithm such as normal Filtered-X or input constraint may be used. Therefore, a detailed description of the generation of the drive signal u will be omitted.

In the normal Filtered-X, the control filter K is updated so that an evaluation function J(t) described below is minimized.

$$J(t)=e^2(t)$$

Here, e(t) represents an error signal at time t.

In this case, the update rule of the control filter K is derived as described below.

$$K(t+1) = K(t) - \frac{2\mu e(t)\phi_x}{|\phi_x|^2+\beta} \tag{1}$$

Here, μ is a step size in the steepest descent method, and β is an arbitrary numerical value (larger than 0), for example, 0.01. K(t) represents the control filter K at the time t, and $\phi_x$ represents time-series data of the auxiliary signal x. The first controller 452 updates the control filter K based on the update rule of the above formula (1).

In the input constraint, the control filter K is updated so that an evaluation function J(t) described below is minimized.

$$J(t)=e^2(t)+au_d^2(t)$$

Here, α is a variable (no constraint when 0, input constraint larger as approaching 1) from 0 to 1 that determines the degree of the input constraint, and $u_d(t)$ represents an auxiliary signal $u_d$ at the time t.

In this case, the update rule of the control filter K is derived as described below.

$$K(t+1)=K(t)-\frac{2\mu(e(t)+\alpha u_d(t))\phi_x}{|\phi_x|^2+\beta} \quad (2)$$

The first controller 452 updates the control filter K based on the update rule of the above formula (2).

The second controller 454 controls the pressurization actuators 112. Specifically, the second controller 454 controls the pressurization actuators 112 such that the natural frequency corresponding to the vibration mode excited on the annular plate 102 matches the target frequency.

Figure 47:
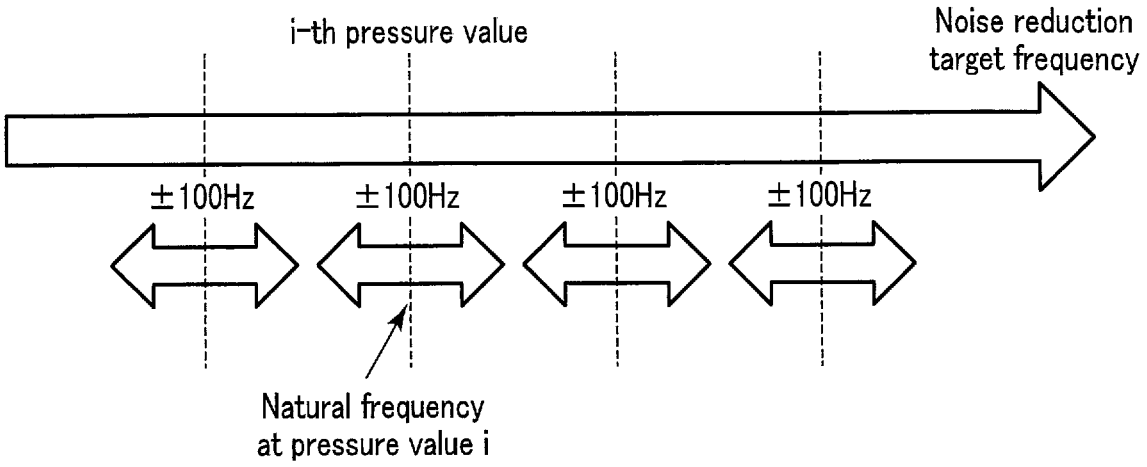
FIG. 47 is a diagram illustrating a data map held by the control circuit illustrated in FIG. 45.

The second controller 454 receives the blade-passing pulse signal or the blade drive current signal, and specifies the frequency corresponding to the target Lobe mode based on the received signal. The second controller 454 refers to the data map with the specified frequency to determine the pressure value to be applied to the annular plate 102. As illustrated in FIG. 47, the data map includes information in which a plurality of pressure values is associated with a plurality of frequency ranges. Each frequency range has a width of, for example, 200 Hz. Each pressure value is set so as to obtain a natural frequency that matches the center frequency of the frequency range. For example, a pressure value at which the natural frequency is 1000 Hz is associated with a frequency range of 900 Hz to 1100 Hz. The second controller 454 generates a drive signal based on the determined pressure value and supplies the drive signal to the pressurization actuators 112.

When the pressing force to the annular plate 102 is changed, the secondary path characteristics vary. Therefore, the first controller 452 stores information in which a plurality of secondary path characteristics is associated with a plurality of pressure values, and uses the secondary path characteristics corresponding to the changed pressing force when the pressing force to the annular plate 102 by the pressurization actuators 112 is changed. Alternatively, an ANC algorithm capable of coping with variations in secondary path characteristics may be used.

Figure 48:
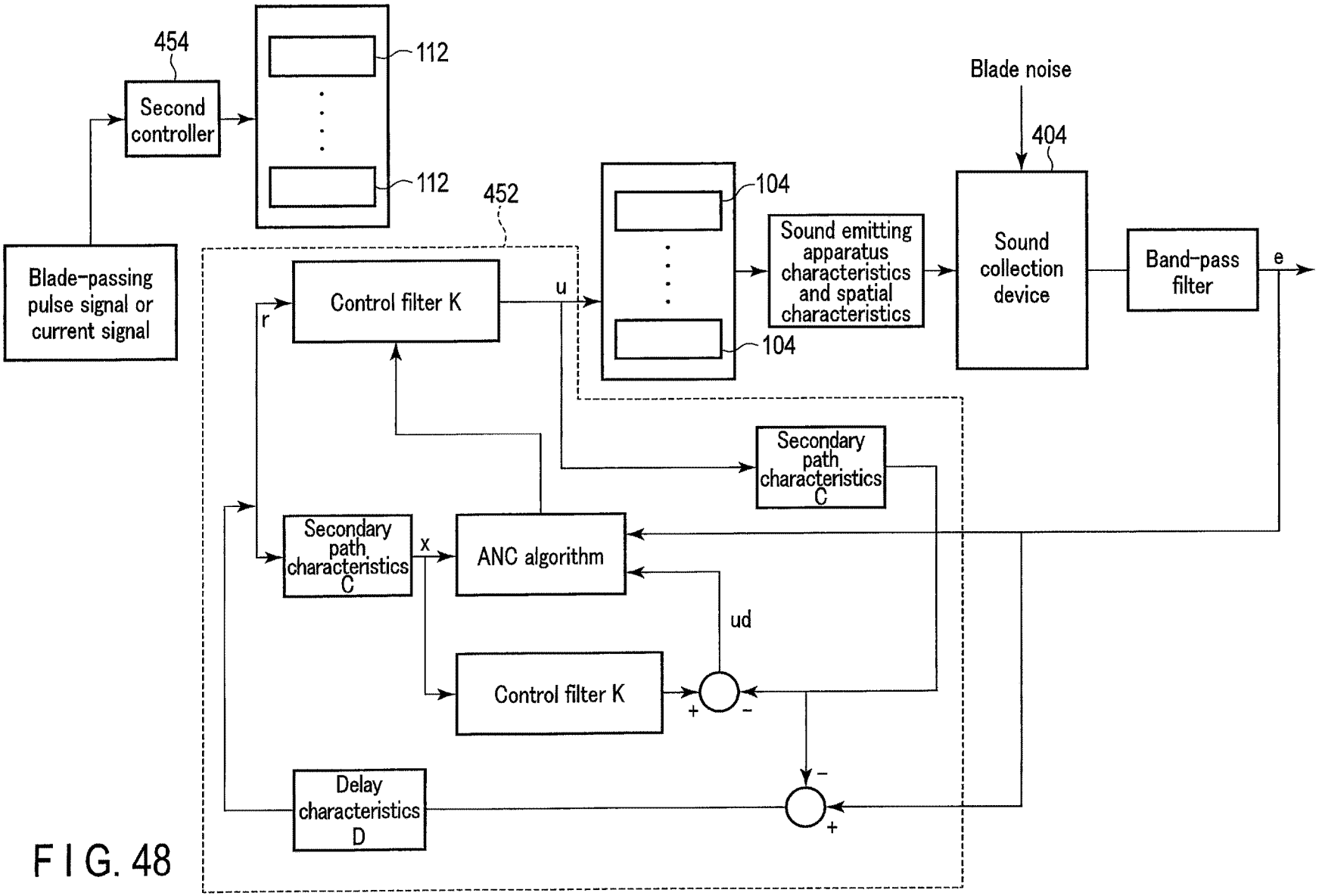
FIG. 48 is a block diagram illustrating another example of the control circuit included in the blade noise reduction apparatus illustrated in FIG. 45.

FIG. 48 schematically illustrates another example of a control circuit of the blade noise reduction apparatus 400. In the example illustrated in FIG. 48, the control circuit is based on feedback ANC. Detailed description of parts similar to those of the feedforward ANC will be omitted. In the feedback ANC, the blade-passing pulse signal or the blade drive current signal is used in the second controller 454, but is not used in the first controller 452.

In FIG. 48, the error signal e is obtained by processing the error signal obtained by the sound collection device 404 with a band-pass filter. The band-pass filter is configured to extract a signal of a frequency band including a target frequency. The signal r is obtained by subtracting a signal obtained by converting the drive signal u with a filter having the secondary path characteristics C from the error signal e and delaying the obtained signal by a predetermined time. The drive signal u is obtained by converting the signal r with the control filter K. A signal x is an auxiliary signal and is obtained by converting the signal r with a filter having the secondary path characteristics C. A signal $u_d$ is an auxiliary signal, and is obtained by subtracting a signal obtained by converting the drive signal u with a filter having the secondary path characteristics C from a signal obtained by converting the auxiliary signal x with the control filter K.

The first controller 452 updates the control filter K based on the update rule of the above formula (1) or (2).

In a case where the phase difference between the signals is obtained by delaying the signals by the delay unit in the sound emitting apparatus 402 and/or the sound collection device 404, it is necessary to reset the delay time every time the target frequency is changed. Furthermore, since the secondary path characteristics change when the delay time is changed, it is necessary to estimate the change in secondary path characteristics. The estimation may be performed by computation, database extraction, or online estimation.

On the other hand, in a case where the phase difference between the signals is obtained by applying the phase shift to the signals by the phase shifter in each of the sound emitting apparatus 402 and the sound collection device 404, it is not necessary to reset the phase shift amount even when the target frequency is changed. Therefore, complicated processing is unnecessary. Further, because the secondary path characteristics do not change, use of a complex ANC algorithm can be avoided. There is a great advantage in feedback ANC where it is difficult to apply online estimation.

Frequency fi of the blade noise can be expressed as the following formula.

$$fi=Bx\Omega/2\pi$$

where B is the number of blades, Ω is the blade rotation speed [rad/s], and x is the order of the Lobe mode.

When the blades include only rotational blades, there is one Lobe mode for one frequency fi. When the blades include rotational blades and stationary blades, there are $M_0$ Lobe modes for one frequency fi. Here, $M_0=Bx-pV$, where V is the number of stationary blades, and p is an integer.

Therefore, the blade noise includes noise due to a large number of Lobe modes.

Since the mode separation is executed by frequency separation, the number of microphones may be one when the blades include only rotational blades. However, in an actual environment, there is an influence of environmental reflection. Therefore, mode separation processing using 2M+1 or more microphones is required.

In a case where L Lobe modes (fi, Mi) are driven, the blade noise reduction apparatus 400 includes a sound emitting apparatus 402 including L annular plates 102 and L control circuits. Here, L is an integer of 2 or more. For example, the sound emitting apparatus 402 may be, for example, the sound emitting apparatus 100 illustrated in FIG. 31A, 32, or 33A. Each of the L control circuits may be the control circuit illustrated in FIG. 46 or 48. The error signal input to each control circuit is a signal related to the Lobe mode (Fi, Mi) corresponding to the control circuit obtained by the processing described in conjunction with FIGS. 41 to 44G.

The higher the target frequency, the more a control sound source (specifically, an annular plate 102) needs to be arranged near the blades. Arranging the annular plate 102 for high frequencies inside as in the case of the sound emitting apparatus 100 illustrated in FIG. 31A is suitable for blade noise reduction.

In general, a higher order Lobe mode is easily attenuated. Therefore, the noise reduction target may be limited to the fourth order or lower Lobe mode. When the noise reduction target is the fourth order or lower Lobe mode, it is sufficient to use 24 microphones.

Note that the blade noise reduction apparatus 400 may be used in combination with a passive blade noise reduction apparatus.

[Application 2 (Object Floating)]

Figure 49:
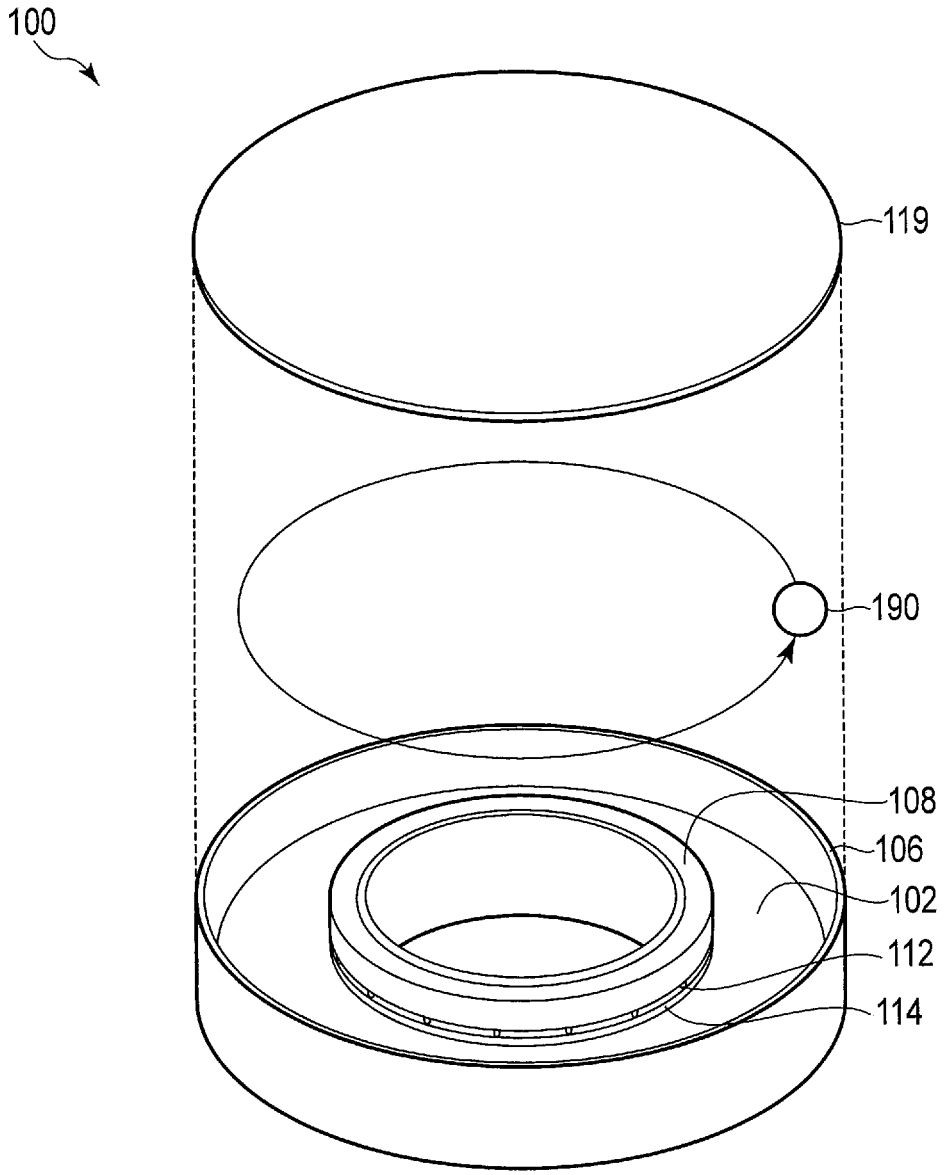
FIG. 49 is a perspective view illustrating an example in which the sound emitting apparatus according to an embodiment is applied to object floating.

FIG. 49 schematically illustrates an example in which the sound emitting apparatus 100 according to the embodiment is applied to object floating. As illustrated in FIG. 49, the sound emitting apparatus 100 includes a reflector plate 119 that reflects a sound wave in addition to the components (such as the annular plate 102) illustrated in FIG. 1. The reflector plate 119 is fixed to the case 106 via a supporting member, which is not illustrated. In a case where the sound emitting apparatus 100 is used for object floating, the natural frequency corresponding to the vibration mode of the annular plate 102 is set to be high to the extent of an ultrasonic region (for example, about 40 kHz), and the frequency of the drive signal for the excitation actuators 104 is set to be in an ultrasonic region. Thus, a floating object 190 such as a droplet can be trapped at the position of the node of a standing wave. Furthermore, since the standing wave rotates, the floating object 190 is rotated. The rotation speed is determined by the vibration frequency of the excitation actuators 104 and the order of the Lobe mode.

The larger the order of the Lobe mode, the shorter the wavelength on the circumference. For this reason, the floating object 190 having a smaller radius can be rotated by exciting a higher order Lobe mode.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sound emitting apparatus comprising:

an elastic member having an annular shape;

three or more excitation actuators arranged at a predetermined angular interval on the elastic member and configured to apply vibration to the elastic member to excite a vibration mode on the elastic member; and a control circuit configured to generate drive signals for driving the three or more excitation actuators, wherein there is a phase difference between drive signals for two excitation actuators separated by the predetermined angular interval to rotate the vibration mode, the phase difference depending on an order of a lobe mode being the vibration mode excited on the elastic member and the predetermined angular interval.

2. The sound emitting apparatus according to claim 1, wherein when the order of the lobe mode is M, wherein M is an integer of 1 or more, the three or more excitation actuators are 2M+1 or more excitation actuators.

3. The sound emitting apparatus according to claim 2, wherein the three or more excitation actuators are 4M excitation actuators, and the phase difference is 90 degrees.

4. The sound emitting apparatus according to claim 2, wherein the three or more excitation actuators are 3M excitation actuators, and the phase difference is 120 degrees.

5. The sound emitting apparatus according to claim 1, wherein the elastic member is configured such that a natural vibration frequency corresponding to the vibration mode matches a frequency corresponding to a lobe mode being a noise reduction target.

6. The sound emitting apparatus according to claim 1, further comprising:

a pressing part configured to apply pressure to the elastic member to adjust a natural vibration frequency corresponding to the vibration mode.

7. The sound emitting apparatus according to claim 1, further comprising:

a case configured to accommodate the elastic member, wherein the elastic member is attached to the case by inner edge fixation in which an inner edge part of the elastic member is fixed to the case and an outer edge part of the elastic member is free.

8. The sound emitting apparatus according to claim 7, wherein the case includes an enclosure part configured to cover a main surface of the elastic member.

9. The sound emitting apparatus according to claim 1, wherein the control circuit includes a phase shifter configured to apply a phase shift to an input signal to generate the phase difference.

10. A blade noise reduction apparatus comprising:

the sound emitting apparatus according to claim 1; and at least one microphone, wherein the control circuit is configured to generate the drive signals based on an output of the at least one microphone.

* * * * *